United States Patent [19]

Morton et al.

[11] Patent Number: 4,750,430

[45] Date of Patent: Jun. 14, 1988

[54] CONTROL FOR TRANSFER SYSTEM HAVING INHAUL AND OUTHAUL WINCHES

[75] Inventors: Walter E. Morton, Galena; Rudolf U. Scharte, Columbus, both of Ohio

[73] Assignee: Hagglunds Denison Corporation, Columbus, Ohio

[21] Appl. No.: 878,693

[22] Filed: Jun. 26, 1986

[51] Int. Cl.[4] ..... B65G 67/58

[52] U.S. Cl. ..... 104/114; 212/76; 340/700; 254/315

[58] Field of Search ..... 212/207, 76, 157, 160; 104/114, 117, 117.1; 414/138; 340/700; 254/279-282, 323-327, 900, 361

[56] References Cited

U.S. PATENT DOCUMENTS

| | | | |
|---|---|---|---|
| 3,361,080 | 1/1968 | Born et al. | 104/114 |
| 3,388,070 | 6/1968 | Born et al. | 254/326 |
| 3,388,890 | 6/1968 | Born et al. | 254/315 |
| 3,466,013 | 9/1969 | Smith . | |
| 3,606,256 | 9/1971 | Ovretveit | 104/114 |
| 3,633,809 | 12/1972 | Born . | |
| 3,679,180 | 7/1972 | Callaghan | 104/114 |
| 3,720,400 | 3/1973 | Potts | 104/114 |
| 3,787,031 | 1/1974 | Lucas | 104/114 |
| 3,828,683 | 8/1974 | Lehrer | 104/114 |
| 4,295,636 | 10/1981 | Langford | 212/76 |
| 4,464,933 | 8/1984 | Santis | 340/700 |
| 4,488,148 | 12/1984 | Kuciera | 340/700 |

*Primary Examiner*—Joseph F. Peters, Jr.
*Assistant Examiner*—Stephen P. Avila
*Attorney, Agent, or Firm*—Thomas S. Baker, Jr.

[57] ABSTRACT

An automatic control system for operating the inhaul and overhaul winches of a high line transfer system automatically changes the velocity of a trolley between set landing and set transfer velocities and between set landing and set terminal velocities at a constant rate with respect to distance. Digital and graphic displays of trolley distance from a receiver ship and a supply ship and a graphic display of trolley velocity relative to the ship it is approaching are provided.

23 Claims, 19 Drawing Sheets

FIG. 2
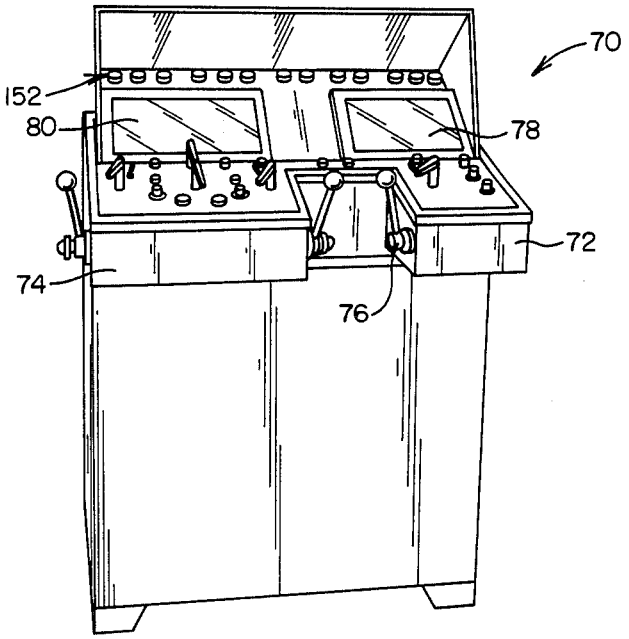
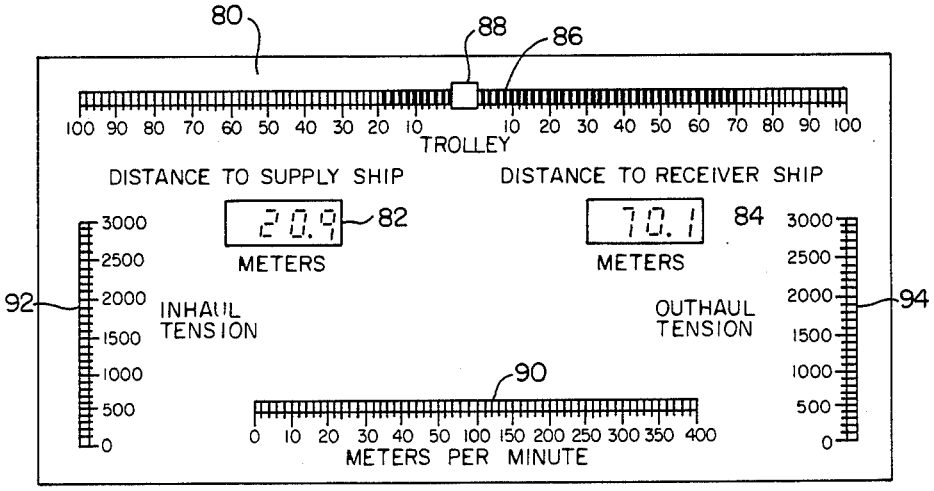
FIG. 3

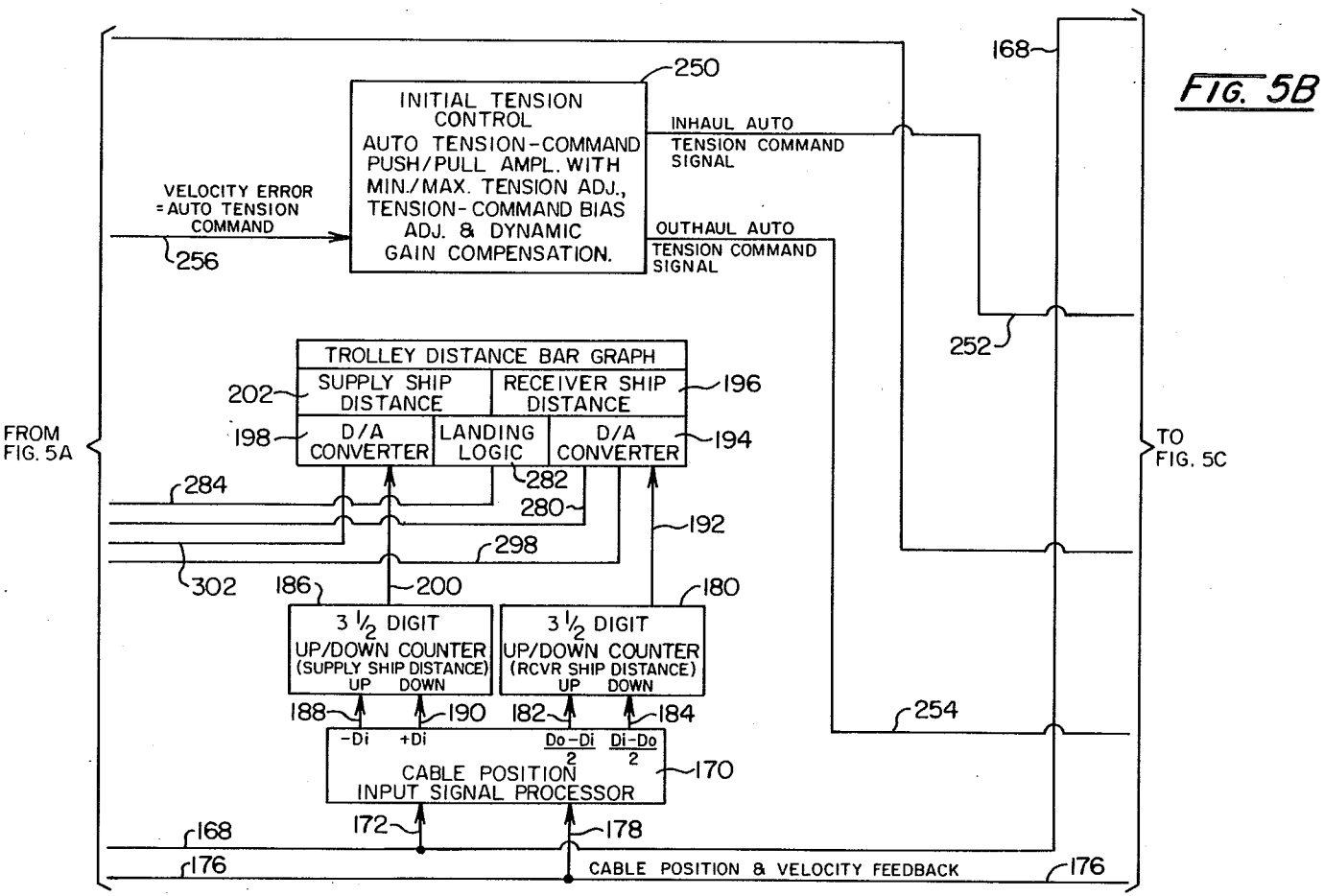
FIG. 5B
TO FIG. 5C
FROM FIG. 5A
INITIAL TENSION CONTROL
AUTO TENSION-COMMAND PUSH/PULL AMPL. WITH MIN./MAX. TENSION ADJ., TENSION-COMMAND BIAS ADJ. & DYNAMIC GAIN COMPENSATION.
INHAUL AUTO TENSION COMMAND SIGNAL
OUTHAUL AUTO TENSION COMMAND SIGNAL
VELOCITY ERROR =AUTO TENSION COMMAND
TROLLEY DISTANCE BAR GRAPH
SUPPLY SHIP DISTANCE
RECEIVER SHIP DISTANCE
D/A CONVERTER
LANDING LOGIC
D/A CONVERTER
3 1/2 DIGIT UP/DOWN COUNTER (SUPPLY SHIP DISTANCE)
3 1/2 DIGIT UP/DOWN COUNTER (RCVR SHIP DISTANCE)
UP
DOWN
CABLE POSITION INPUT SIGNAL PROCESSOR
-Di
+Di
Do-Di
Di-Do
2
CABLE POSITION & VELOCITY FEEDBACK
168
252
254
250
256
284
302
202
198
196
194
192
180
186
188
190
200
182
184
170
172
178
176
168
176
280
282
298

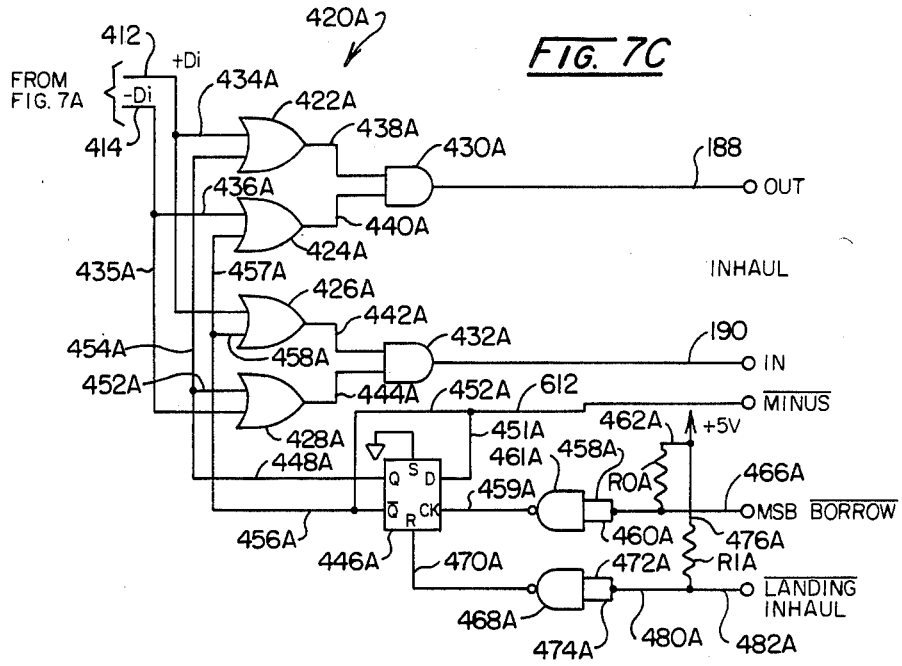
FIG. 7C
420A
412
+Di
FROM FIG. 7A
-Di
414
434A
422A
438A
430A
188
OUT
436A
440A
424A
435A
457A
INHAUL
426A
442A
432A
190
454A
458A
IN
452A
444A
452A
612
MINUS
428A
451A
462A
+5V
448A
461A
458A
ROA
466A
459A
MSB
BORROW
456A
446A
460A
476A
470A
472A
RIA
LANDING INHAUL
468A
474A
480A
482A
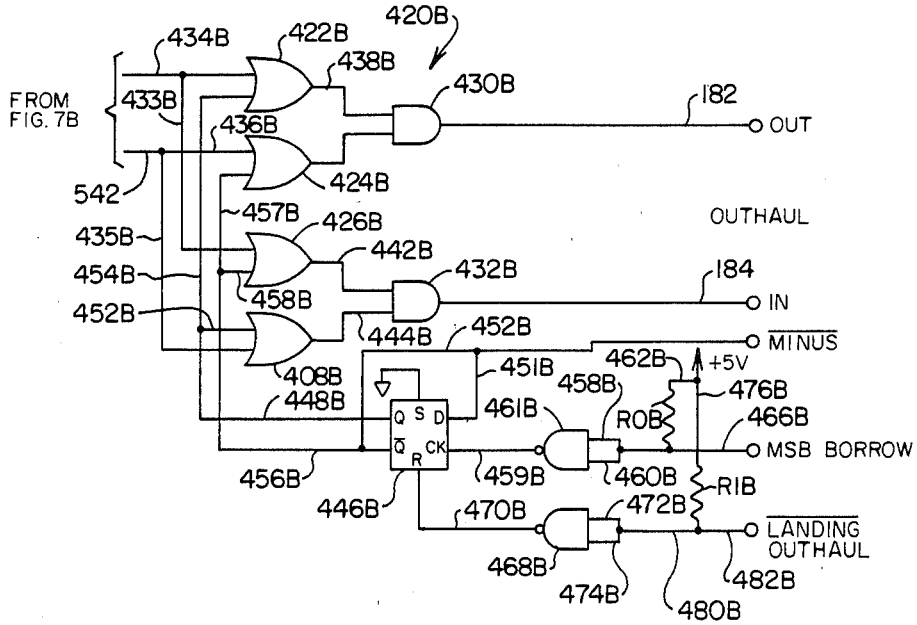
420B
434B
422B
438B
430B
182
FROM FIG. 7B
433B
OUT
436B
424B
542
457B
426B
OUTHAUL
435B
442B
432B
184
454B
458B
IN
452B
444B
452B
MINUS
408B
451B
462B
+5V
448B
458B
476B
461B
ROB
466B
MSB
BORROW
456B
459B
460B
RIB
446B
470B
472B
LANDING OUTHAUL
468B
474B
482B
480B

TO FIG. 12B

FROM FIG. 12A
1402
+15V
1220
R86
1222
KR3
1224
Q18
R85
280
308
1406
1400
1396
1394
1392
R128
C18
1384
R132
R127
1388
1398
1390
1391
R208
TP5
1386
1382
TP7
R131
1404
1338
1336
1362
1364
1334
R100
C16
1328
1340
R206
1344
1329
R99
1330
1332
1333
R126
1343
TP3
1380
R125
1314
1312
1324
1326
1310
R97
C15
1318
1302
1316
1308
1311
R205
1306
R96
1304
R98
266
214
306A
272
126
270

CONTROL FOR TRANSFER SYSTEM HAVING INHAUL AND OUTHAUL WINCHES

BACKGROUND OF THE INVENTION

Classically, the transfer of provisions and equipment between two moving ships at sea has been accomplished primarily through utilization of a high line transfer system. In this system the provisions and equipment are placed on a trolley which has been suspended from a high line rig and which is moved between the two ships by means of a transfer cable driven by an inhaul winch and an outhaul winch which are located on the supply ship. The high line transfer system has been automated to a high degree. An operator at a control console on the supply ship may set a desired transfer velocity for the trolley as it moves between the ships, a desired landing velocity for the trolley as it approaches a ship, and set the system in an automatic mode in which it will automatically accelerate the trolley to the set transfer velocity and drive the trolley at that velocity until it reaches a specified distance from a ship at which point it will reduce the trolley velocity to the set landing velocity which will be the speed of the trolley when it strikes the landing post of the ship it is approaching. See U.S. Pat. No. 3,361,080 entitled "Method and Apparatus for Replenishment at Sea" and assigned in common herewith.

When the trolley has a heavy load the transfer and landing velocities are set relatively low so that the abrupt speed change which occurs between these velocities does not induce excessive shock into the transfer system which may cause the transfer cable to break or another system component to fail, and so that the loaded trolley does not swing. Additionally, the landing velocity is set low so that the trolley does not strike the landing post with excessive force. The landing force becomes important, particularly when the trolley is loaded with munitions or with delicate electronic gear which may be damaged by being subjected to excessive shock forces. Also, the control system has a fixed high rate of acceleration for the trolley. This rate is designed to ensure that the trolley is not struck by the ship it is departing. Because the rate must accommodate the worst possible situation it is greater than necessary in many instances.

The control console for the high line transfer system utilizes circular analog dial-type gauges to indicate the velocity of the trolley with respect to the ship it is approaching and to indicate the distance of the trolley from the supply ship and from the receiver ship. These gauges enable an operator to monitor the travel of the trolley as it moves between the ships. The operator is dependent upon these gauges for determining the location and velocity of the trolley especially at night when the trolley may not be visible from the control console.

It has been found desirable to provide a control system for operating the inhaul winch and the outhaul winch of a high line transfer system in which the rate of change of velocity of the trolley between the set landing velocity and the set transfer velocity is set to ensure that a minimum shock load is imposed upon the system. This set rate is maintained regardless of the set landing and transfer velocities. Also, it has been found desirable to provide a control system which will make the rate of acceleration of the trolley relative to the ship the trolley is leaving so that the rate of acceleration is sufficient to prevent the trolley from being bumped by the ship but is not excessive. Furthermore, the control system also should automatically change the velocity of the trolley from the set landing velocity to a preset terminal velocity to reduce the force with which the trolley strikes the landing post.

Additionally, it has been found desirable to provide a more easily readable visual indication of the distance the trolley is from both the transfer and the receiver ships and of the speed of the trolley with respect to the ship it is approaching. Furthermore, it has been found advantageous to provide a graphic display of the relative distance of the trolley from both ships and to provide an enhanced graphic illustration of the velocity of the trolley when it is close to a ship.

SUMMARY OF THE INVENTION

The instant invention is directed to an automatic control system for operating inhaul and outhaul winches which serve as drives for hauling in and paying out inhaul and outhaul winch transfer cables employed in ship to ship transfer of a load. The automatic control system operates in a landing mode to drive the load at a landing velocity when the load is within a set distance of a ship and operates in a transfer mode to drive the load at a transfer velocity which normally is significantly greater than the landing velocity when the load is beyond the set distance. This control system operates the inhaul and outhaul winches to adjust the velocity of the inhaul and outhaul winch transfer cables such that the velocity of the load between the transfer velocity and the landing velocity changes at a constant rate with respect to distance when the system is in the transfer mode. Additionally, the control system operates the inhaul and outhaul winches to adjust the velocity of the inhaul and outhaul transfer cables such that the velocity of the load between the landing velocity and a set minimum landing velocity also changes at a constant rate with respect to distance when the system is in the landing mode.

Additionally, the present invention provides an automatic control system for operating inhaul and outhaul winches which are responsive to an automatic transfer control output and which serve as drives for hauling and paying out inhaul and outhaul winch transfer cables employed in ship to ship transfer of a load. Sensors are utilitized for deriving inhaul and outhaul winch cable position signal inputs and inhaul and outhaul winch cable velocity signal inputs. The automatic control system operates in a landing mode to drive the load at a select landing velocity when the load is within a set distance from a ship and operates in a transfer mode to drive the load at a select transfer velocity when the load is beyond the set distance. A first adjustment means is provided to derive select haul in and pay out transfer velocity signal inputs and a second adjustment means is provided to derive a select landing velocity signal input. A transfer velocity control means responsive to the cable position signal inputs and the landing velocity signal input derives a distance responsive transfer velocity signal input. A transfer control means is provided which is responsive to the cable velocity signal inputs, the select haul in and pay out transfer velocity signal inputs and the distance responsive transfer velocity signal inputs to derive a variable automatic transfer control output which causes the inhaul and outhaul winches to adjust the velocity of the inhaul and outhaul winch transfer cables such that the velocity of the load between the select transfer velocity and the select landing velocity changes at a constant rate with respect to distance.

The instant invention further provides a control system for operating inhaul and outhaul winches which serve as drives for inhaul and outhaul winch transfer cables employed in ship to ship transfer of a load between a supply ship and a receiver ship. One transfer cable is connected between the load and the inhaul winch and the other cable is connected between the load and the outhaul winch. A monitoring circuit provides a digital display of one of the distance between the load and a landing position on a ship or the load and the distance the load travels from that landing position towards the deck of the ship. A winch cable signal processor is provided to derive a first cable position up count and down count signal output. A steering circuit means is provided having first up count and down count signal inputs operatively connected to the first up count and down count signal outputs for selectively outputting second up count and down count signal outputs. A counter means is provided having second up count and down count signal inputs operatively connected to the second up count and down count signal outputs of said steering circuit and responsive thereto to output a count signal representing the distance between the load and a ship and a counter direction signal which indicates a positive direction when the load is away from the ship and a negative direction when the load is moving from the landing position towards the deck of the ship. A driver means which is responsive to the count signal, derives a driver signal and a digital display means which is responsive to the driver signal provides digital display of distance. A toggle means is provided which is operatively connected to the steering circuit means and to the count means and responsive to the counter direction signal for reversing the second up count and down count signal outputs of the steering circuit means when the counter direction signal indicates a negative direction wherein the second up count signal is applied to the second down count input of the counter means and the second down count signal is applied to the second up count input of the counter means to cause the counter means to count up from zero.

The present invention also provides a control circuit for controlling the tension and the velocity of a cable which transfers a load between a supply ship and a receiver ship and which has one end attached to an inhaul winch and the other end attached to an outhaul winch. A monitoring circuit is provided which provides a graphic display of the velocity of the load with respect to one of the supply ship or the receiver ship. An inhaul winch cable velocity pickup is provided having a haulin output signal and a payout output signal and an outhaul winch cable velocity pick up is provided having a haulin output signal and a payout output signal. A first signal conditioning means receives the inhaul winch haulin and payout output signals and derives a first analog velocity signal representing the velocity of the inhaul winch cable and the load with respect to the supply ship. A second signal conditioning means receives the outhaul winch haulin and payout output signals and derives a second analog velocity signal which represents the velocity of the outhaul winch cable. A third signal conditioning means receives the first and second analog velocity signals and derives a third analog velocity signal representing the velocity of the load with respect to the receiver ship. A driver means is provided which alternatively receives the first analog velocity signal for deriving a first driver signal which represents the velocity of the load relative to the supply ship or receives the third analog velocity signal for deriving a second driver signal which represents the velocity of the load relative to the receiver ship. A visual display means is provided which is responsive to one of the first or second driver signals and provides a graphic light display representing the velocity of the load and in which the percentage of the lights which are illuminated is directly proportional to the velocity of the load. Also provided is a scale adjust means responsive to one of the first or the second driver signals for controlling the amount of the graphic light display which is illuminated for an incremental change in the magnitude of the driver signal. The scale adjust means causes a greater percentage of the graphic light display to be illuminated for an incremental change in magnitude of the driver signal when the load is traveling below a set speed than when the load is traveling above the set speed.

BRIEF DESCRIPTION OF THE DRAWINGS

FIG. 2 is a perspective view of a console on the supply ship containing the operating controls for the high line transfer system;

FIG. 3 is an enlarged view of the upper portion of the top of the console shown in FIG. 2 illustrating digital readouts of the distance the trolley is from the supply ship and the receiver ship, a bar graph representing position of the trolley relative to the supply ship and the receiver ship, and a bar graph representing trolley velocity with respect to the ship it is approaching;

FIGS. 5A–5C constitute a block diagram which illustrates generally the circuit of the transfer system control of the present invention;

FIGS. 7A–7C are electrical schematic diagrams of the digital cable position network of the control of the present invention;

DETAILED DESCRIPTION OF THE INVENTION

Figure 1:
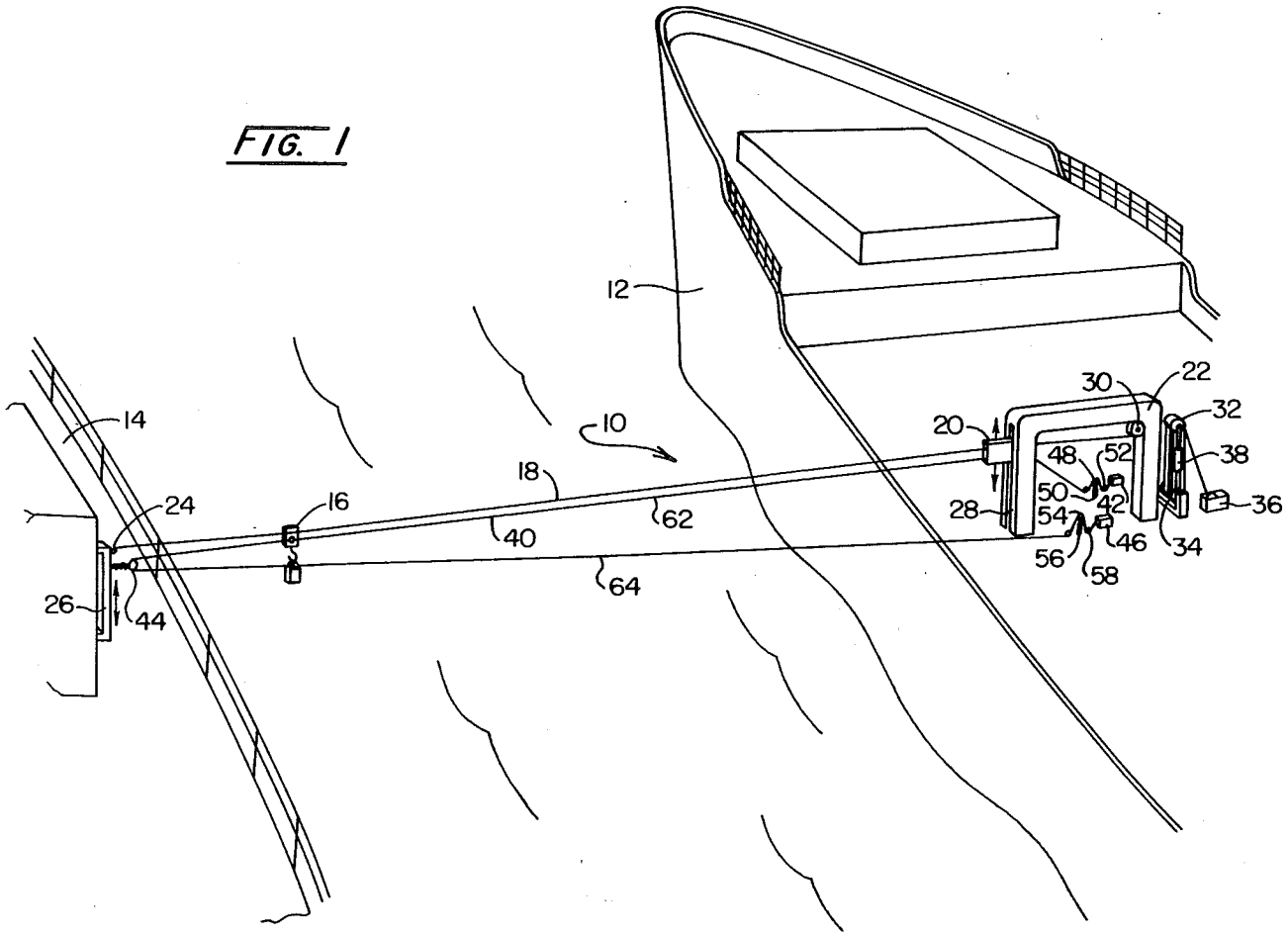
FIG. 1 is a perspective view of a high line transfer system extending between a supply ship and a receiver ship.

Looking to FIG. 1, there is depicted a high line rig 10 which is utilized to transfer materials between a supply ship 12 and a receiver ship 14. During the transfer operation the materials are suspended from a trolley 16 which is supported on a high line 18 that extends between a transfer head 20 which is mounted on a conventional M-frame 22 on the supply ship and a landing post or head 24 which is mounted on the receiver ship 14. The landing post 24 is carried by a carriage 26 the position of which may be adjusted vertically along a vertical guideway. When the trolley 16 is at the landing post 24 the carriage 26 is lowered to permit materials to be transferred between the trolley 16 and the deck of the ship. During the transfer operation the carriage 26 is raised to its uppermost position such that the trolley 16 and the material suspended therefrom are substantially above the deck of the ship. In order to permit materials to be transferred easily between the trolley 16 and the deck of the supply ship 12 the transfer head 20 also is moveable vertically along a guideway 28 in M-frame 22.

In order to control the tension of high line 18 one end of the line is attached to the landing post 24 and the line passes over an outboard pulley (not shown) in transfer head 20 and an inboard pulley 30. From pulley 30 the high line 18 is wound successively around spaced sets of upper pulleys 32 and lower pulleys 34 and thereafter attached to a high line winch 36. The upper set of pulleys 32 and the lower set of pulleys 34 are biased apart by a conventional hydraulic ram and fluid accumulation system to thereby maintain tension on line 18. If the high line 18 goes slack because the supply and receiver ships 12 and 14 are moving towards each other, the hydraulic ram and fluid accumulation system 38 will force the upper and lower sets of pulleys 32 and 34 apart so that the slack in the line will be removed. On the other hand, if the tension in the line 18 becomes excessive, the hydraulic ram and fluid accumulation 38 will permit the upper and lower sets of pulleys 32 and 34 to move towards each other to reduce the tension in the line and prevent the line from breaking. If tension in the high line is being controlled manually, a seaman operating the control for the high line winch 36 will cause the winch 36 to pay out line when the sets of pulleys 32 and 34 are less than a specified minimum distance apart and will cause the high line winch 36 to haul in line when the upper and lower sets of pulleys 32 and 34 are beyond a set maximum distance apart.

The high line winch 36 is driven by a conventional hydraulic transmission, not shown, comprising a reversible hydraulic motor and an across center, servo-controlled hydraulic pump which in turn is driven by an electric motor, not shown. The tension of the high line 18 also may be controlled automatically. When the high line tension control is set in an automatic mode, movement of the upper and lower sets of pulleys 32 and 34 is monitored by a potentiometer having voltage output which is a measure of the distance between the sets of pulleys 32 and 34. This voltage output is used as a feedback signal to a servo control for the pump to cause it to drive the hydraulic motor and hence the high line winch 36 in a direction which will pay out or haul in cable such that the position of high line ram 38 will be maintained within set limits.

The transfer of trolley 16 across high line 18 is controlled by a transfer cable 40 which extends from an inhaul winch 42 on supply ship 12 through transfer head 20 to trolley 16 where it is secured rigidly thereto. Cable 40 extends from trolley 16 around a pulley 44 on landing post 24 and back to an outhaul winch 46 which also is located on the supply ship 12. The transfer cable 40 passes around a pulley 48 which drives an inhaul linear variable differential transformer or tension transducer 50 and a pulley 52 which drives an inhaul cable position and velocity feedback sensor, not shown, adjacent inhaul winch 42. Similarly, cable 40 passes around a pulley 54 which operates an outhaul linear variable differential transformer or tension transducer 56 and a pulley 58 which drives an outhaul cable position and velocity feedback sensor, not shown, adjacent outhaul winch 46. The function of the tension trandsducers 50 and 56 and the funtion of the inhaul and outhaul cable position and velocity feedback sensors will be more fully explained hereinafter. As may be seen from FIG. 1, when one of the inhaul or outhaul winches 42 and 46 pays out cable and the other of the winches 42 and 46 hauls in cable, trolley 16 moves across high line 18 from one ship to the other. Trolley 16 moves toward receiver ship 14 when outhaul winch 46 is commanded to haul in cable and inhaul winch 42 is commanded simultaneously to pay out cable. Similarly, trolley 16 moves toward supply ship 12 when inhaul winch 42 is commanded to haul in cable and outhaul winch 46 is commanded simultaneously to pay out cable. It may be appreciated that when one of the winches 42 and 46 is commanded to take in cable and the other of the winches 42 and 46 is commanded to pay out cable, the tension in the transfer cable 40 between the trolley 16 and the inhaul winch 42 hereinafter referred to as inhaul cable 62 adjacent the inhaul winch 42, will be different from the tension in the cable 64 between the trolley 16 and the outhaul winch 46 hereinafter referred to as outhaul cable 64 adjacent the outhaul winch 46. This differential tension will cause trolley 16 to move along high line 18. The speed or velocity of the trolley 16 will be directly proportional to the difference in tension.

The high line transfer control system of the present invention is operated from a control console 70 which may be seen by referring to FIG. 2. Conventionally, control console 70 is mounted in an enclosed room in the supply ship 12 which will provide the operator with a view of the operation of the transfer system. A panel 72 on the right side of conosle 70 generally houses the controls for operating the high line winch 36 whereas a panel 74 on the left side of console 70 generally houses the controls for operating the inhaul and outhaul winches 42 and 46, respectively. A control handle 76 on panel 72 may be moved to provide a command signal to the control for the high line winch 36. Control handle 76 may be moved forward to command winch 76 to pay out high line cable 18 and may be moved backward to command high line winch 36 to haul in high line cable 18. A seaman will utilize control handle 76 to operate high line winch 36 to maintain the position of high line ram 38 when the high line winch control is in a manual mode as noted above. A window 78 in the top portion of console 70 above panel 72 provides a graphic display of the distance the ram is extended and the pressure of the fluid in the hydraulic ram and fluid accumulation system 38. Utilizing the information provided by this display an operator can move control handle 76 to maintain a desired position on high line ram 38.

A window 80 in the upper portion of console 70 above panel 74 protects graphic and digital displays of information regarding the location and the velocity of trolley 16, and the tension of the inhaul and outhaul cables 62 and 64. An enlarged view of window region 80 illustrating the digital and graphic displays therein may be seen by looking to FIG. 3. Turning to FIG. 3, a first digital display 82 illustrates the distance in meters between the trolley 16 and the supply ship 12 and a second digital display 84 illustrates the distance in meters between the trolley 16 and the receiver ship 14. These same distances are illustrated graphically on a bar graph display 86. The center of display 86 contains a symbol 88 representing the trolley 16. Segments on either side of the symbol 88 are illuminated to provide a graphic illustration of the relative distance of the trolley 16 from the supply and the receiver ship 12 and 14. A second bar graph display 90 is centered in the lower portion of window 80. This display illustrates graphically the velocity of the trolley in meters per minute with respect to the ship 12 or 14 as it is approaching. It should be noted that the scale for the velocities between 0 and 50 meters per minute is five times greater than the scale for the velocities between 50 and 400 meters per minute. This makes it easier for an operator to read the velocity of the load during the critical landing operation which occurs at low speeds. At each side of window 80 there is a vertically oriented bar graph display 92 and 94. Bar graph 92 provides a graphic illustration of the tension of the inhaul cable 62 whereas bar graph display 94 provides a graphical representation of the tension of the outhaul 64.

Figure 4:
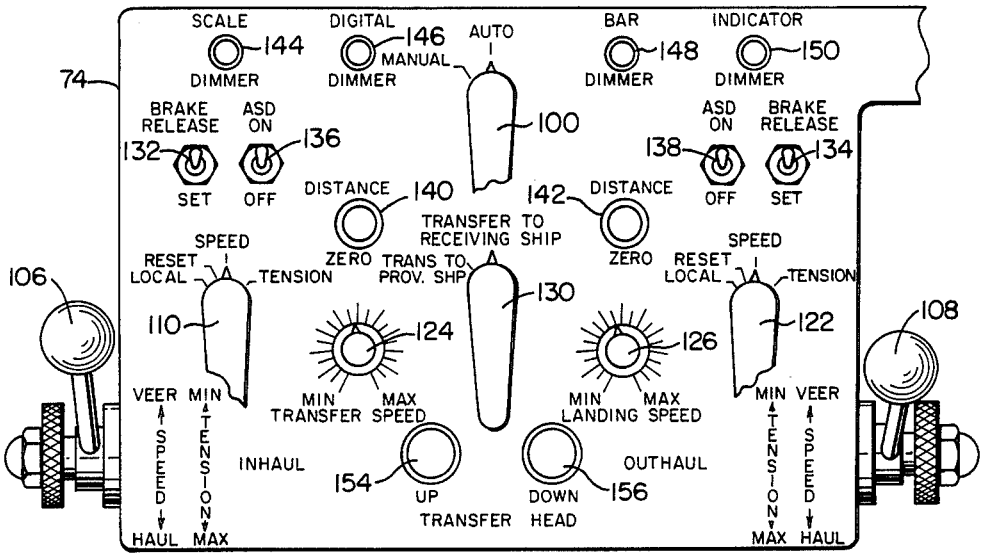
FIG. 4 is an enlarged view of the lower portion of the top of the console shown in FIG. 2 illustrating the operating controls thereof.

An enlarged view of panel 74 which houses the controls for the inhaul and outhaul winches 42 and 46 may be seen by referring to FIG. 4. Generally, the control devices on the left side of panel 74 control the inhaul winch 42 and the control devices on the right side of panel 74 control the outhaul winch 46. The operating mode of the transfer system is determined by the setting of a two position selector switch 100. Looking additionally to FIG. 5C, when switch 100 is set in the manual mode, the inhaul and outhaul winch controls 102 and 104, which control the inhaul and outhaul winches 42 and 46 respectively operate in response to command signals which are manually input by an operator at the panel 74. FIG. 4 shows a control handle or joy stick 106 mounted at the lower left side of panel 74 is movable fore and aft to provide a manually input command signal calling for inhaul winch control 102 to operate the inhaul winch 42 to pay out and haul in cable, respectively. Similarly, a control handle 108 mounted on the lower right side of panel 74 is movable fore and aft to provide a manually input command signal to the outhaul winch control 104 to cause outhaul winch 46 to pay out and haul in cable, respectively.

Figure 5A:
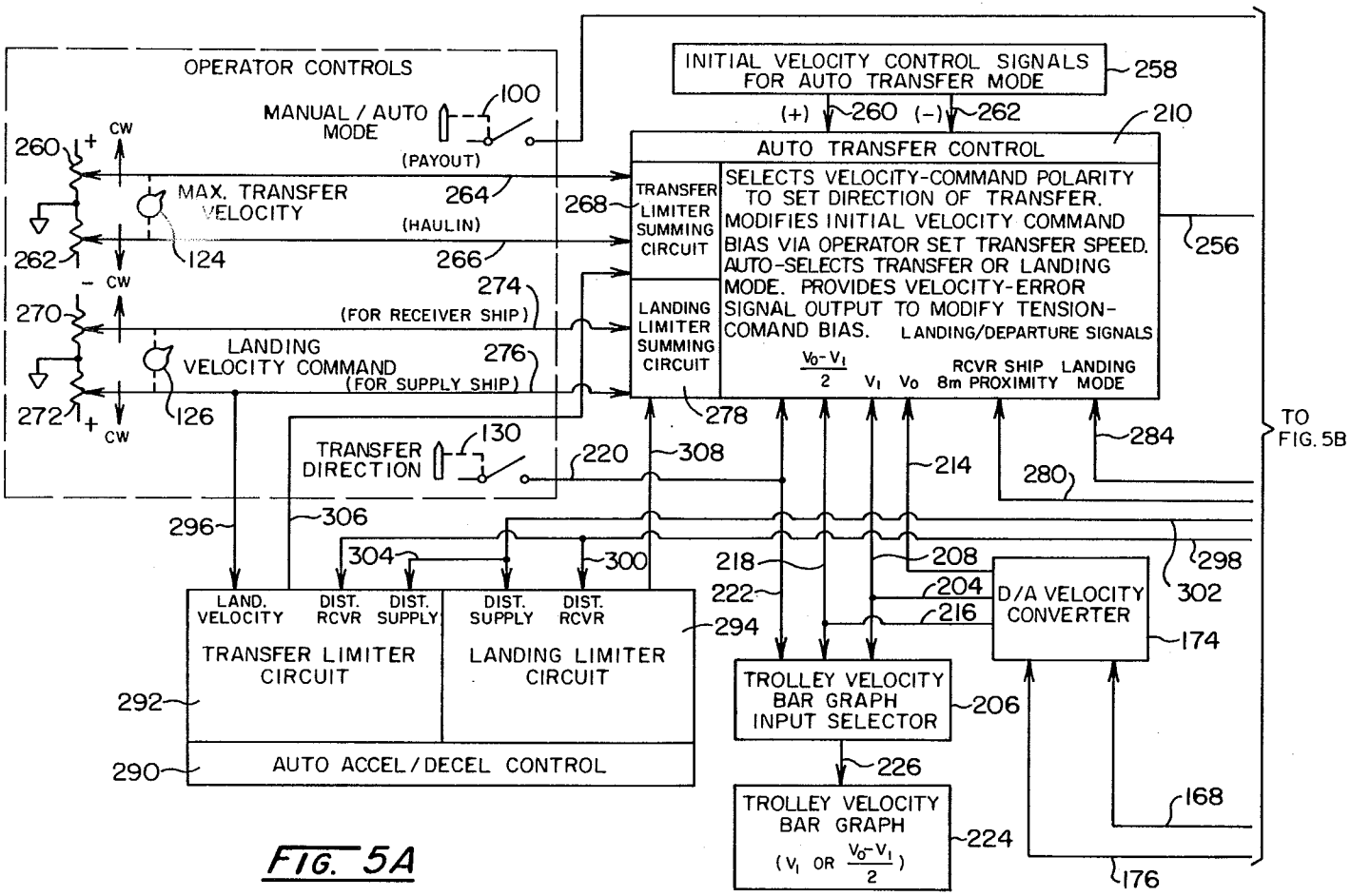
Figure 5C:
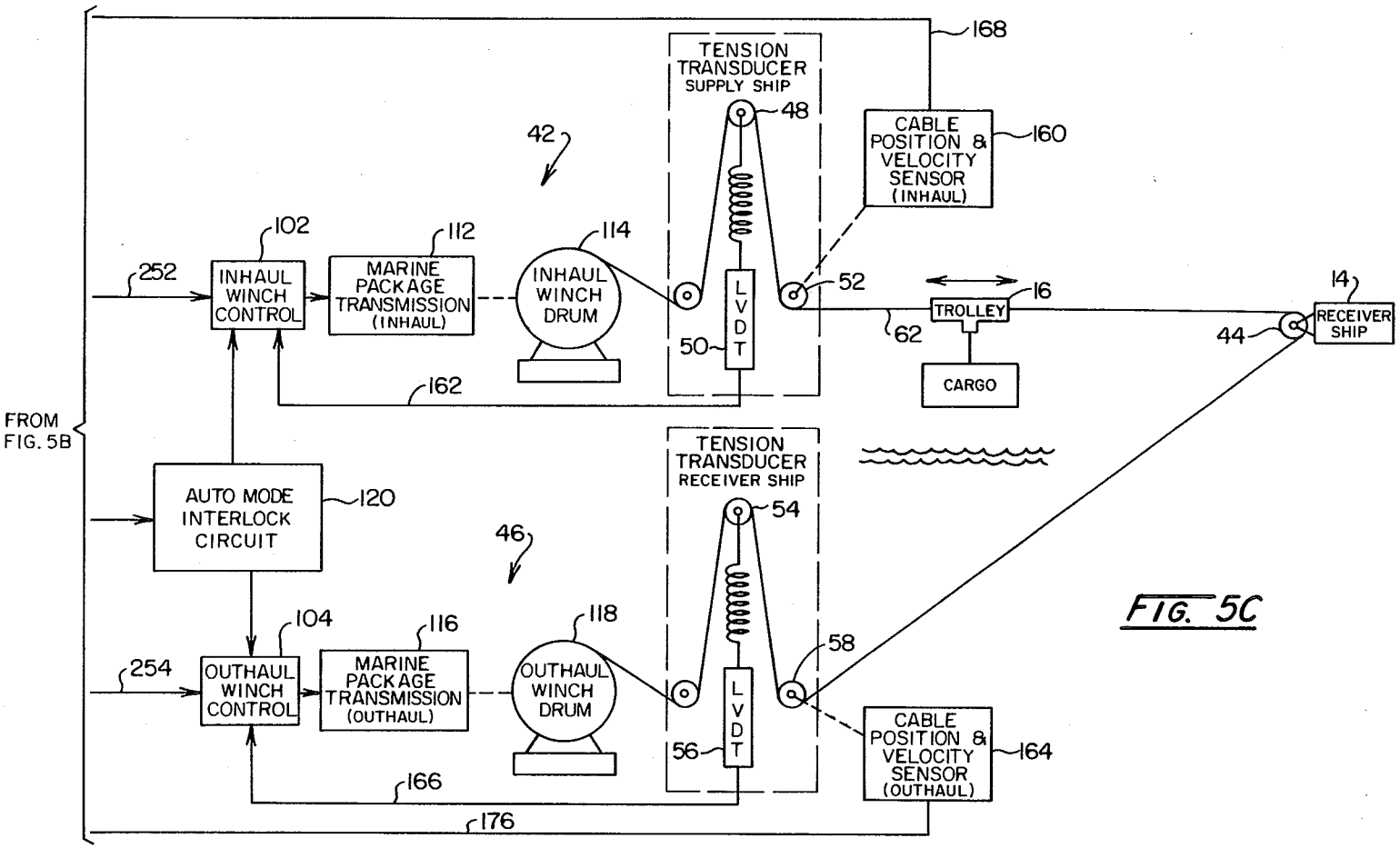

The setting of a four-position selector switch 110 determines the operating mode of inhaul winch 42. When switch 110 is at the "local" setting, all electrical input to the inhaul winch control 102 is interrupted. Consequently, inhaul winch 42 may be operated only by direct, manual actuation of a mechanical, rotary servo valve controlled, across center, variable displacement pump that drives a reversible hydraulic motor. The pump and motor together constitute the main elements of an inhaul marine package transmission 112 which drive an inhaul winch drum 114 (FIG. 5C). An identical marine package transmission 116 drives an outhaul winch drum 118 for the outhaul winch 46. When selector switch 110 is at the "reset" position, an electrical interlock 120 is actuated which outputs a signal to activate the inhaul and outhaul winch controls 102 and 104 for operation in the auto mode. It may be recalled that controls 102 and 104 were deactivated when switch 110 was set in the "local" mode. Marine transmission 112 and 116, inhaul and outhaul winch drums 114 and 118 and interlock 120 are illustrated generally in FIG. 5C. Looking to FIG. 4, when switch 110 is set at the "speed" position, inhaul and outhaul winch controls 102 and 104 respond to command signals which are input manually via control handles 106 and 108 to cause the inhaul and outhaul winches 42 and 46 to operate at a desired speed. At this setting, there is no preset tension command signal input to the inhaul and outhaul winch controls 102 and 104. Consequently, these controls merely are setting the speed of the inhaul and outhaul winches 42 and 46 without regard to the tension of the inhaul and outhaul cables 62 and 64. Inhaul and outhaul winches 42 and 46 normally are operated in the speed mode when the high line transfer system is being rigged or when one of the winches 42 and 46 is being used independently of the other winch to move cargo about the supply ship 12.

When selector switch 110 is at the "tension" setting, an electronic control provides a preset initial tension command input signal to inhaul winch control 102. With this command signal, control 102 (FIG. 5C) causes inhaul winch 42 to maintain a set tension on the inhaul cable 62. When inhaul winch 42 is in the tension operating mode, the inhaul winch control 102 may receive a command signal which is input manually or a command signal which is input automatically. If selector switch 100 is set to the manual position, the inhaul winch control 102 may only receive a command signal which is input manually via control handle 106. This signal will operate to vary the preset tension signal and will increase or reduce the tension in the inhaul cable 62 which will cause trolley 16 to move along high line cable 18. On the other hand, if selector switch 100 is set to the "automatic" position, an automatic command signal may be received by the inhaul winch control 102 which signal will vary the preset tension command input signal to cause inhaul winch 42 to operate and thereby cause trolley 16 to move along high line cable 18. In the automatic mode, the electronic control system automatically varies the pre-set tension commands signal which is input to the inhaul winch control 102 independently of the operation of manual control handle 106. The control system automatically provides a command signal to the inhaul winch control 102 which signal corresponds to a preset transfer speed and a preset landing speed for the trolley 16 as will be explained more fully hereinafter.

The operating mode of the outhaul winch 46 is set by a four-position selector switch 122 which functions in a manner indentical to that of the switch 110 which sets the operating mode of inhaul winch 42. It should be noted that the transfer system will operate in the automatic mode only when the selector switches 110 and 122 are both set in the "tension" position.

The command signal from the automatic transfer control for the transfer system which corresponds with a preset transfer speed is determined by the setting of a rotary dial 124 which operates a dual ganged potentiometer. Similarly, the command signal from the automatic transfer control for the transfer system which corresponds to a set landing speed is determined by the setting of a rotary dial 126 which also is connected to a dual ganged potentiometer.

The direction trolley 16 moves along high line 18 is determined by the setting of a two-positon selector switch 130. In one position of selector switch 130, trolley 16 will move from the supply ship 12 to the receiver ship 14 and in the alternate position of selector switch 130, trolley 16 will move from the receiver ship 14 towards the supply ship 12.

The drums 114 and 118 of the inhaul and outhaul winches 42 and 46, respectively may be locked in position by a hydraulic brake system. A two-position switch 132 is movable between a "set" position which causes a solenoid valve to be deactivated and a hydraulic brake applied and a "release" position which causes the solenoid valve to be energized and the brake released. An identical two position switch 134 is movable between "release" and "set" positions to de-energize and energize a brake for drum 118 of outhaul winch 46. It may be recalled that when the inhaul and outhaul winches 42 and 46 are operated in the "speed" mode or in the "local" mode there is no tension applied to the transfer cable 40. In order to prevent the inhaul and outhaul winch drums 114 and 118 from overspeeding and slack cable from accumulating on the deck of the ship, an anti-slack device is provided for each of the drums 114 and 118. When selector switches 136 and 138 for inhaul and outhaul winches 42 and 46, respectively are at the "on" position, the anti-slack devices will be energized and will operate to keep the cable tight on the drums 114 and 118 when the winches 42 and 46 are operating in the "speed" or "local" modes. These switches 136 and 138 must be set in the "off" position to de-energeize the anti-slack devices when the winches 42 and 46 are operating in the "tension" mode.

The digital and analog displays of the distance between the trolley 16 and the supply ship 12 may be reset or zeroed upon actuation of a switch 140. Similarly, the digital and analog displays of the distance between the trolley 16 and the receiver ship 14 may be zeroed by actuation of a switch 142 when trolley 16 is against landing post 124.

A series of four rotary dimmer control switches, 144, 146, 148 and 150 are located along the upper edge of panel 74. Switch 144 controls the intensity of the back lighting for the scales of the distance bar graph 86, the velocity bar graph 90 and the tension bar graphs 92 and 94 illustrated in FIG. 3. The intensity of the digital display of distance at 82 and 84 is determined by the setting of dimmer control switch 146. The setting of bar graph dimmer control switch 148 determines the intensity of the distance bar graph 86, the velocity bar graph 90 and the tension bar graphs 92 and 94. An indicator dimmer control switch 150 is adjustable to determine the intesity of a bank of function monitoring lamps 152 on control console 70 which may be seen by referring to FIG. 2. Looking again to FIG. 4, it may be observed that transfer head up and down switches 154 and 156 are located centrally at the bottom of panel 74. Actuation of switch 154 causes transfer head 20 to move up in guideway 28 in M-frame 22 whereas actuation of switch 156 causes transfer head 20 to move down in guideway 28.

In the discourse to follow, the circuits of the automatic transfer control network, the distance display network and the velocity display network for the transfer system are described initially in generalized block diagramatic fashion, following which the individual networks and the like making up this diagram are discussed in enhanced detail. FIGS. 5A–5C may be arranged as indicated on the diagrams to obtain the complete block diagram. Looking initially to FIG. 5C, it may be recalled that inhaul winch control 102 provides an electrical command signal input to an electrohydraulic servo valve in the marine package transmission represented at block 112. This command signal causes the inhaul winch 42 to haul in or pay out inhaul cable 62. Cable 62 passes around a pulley 52 which drives an inhaul cable position and velocity sensor represented at block 160. Inhaul cable 62 also passes around a sheave or pulley 48 which operates the linear variable differential transformer which measures inhaul winch cable tension represented at block 50. It may be observed that a feedback signal from the linear variable differential transformer 50 is applied to one input of the inhaul winch control 102 through line 162.

An outhaul winch control represented at block 104 provides an electrical command input signal to an electrohydraulic servo valve which operates the marine package transmission represented at block 116 that causes outhaul winch 46 to payout or haul in outhaul cable 64. Outhaul cable 64 passes around a pulley 58 that drives an outhaul cable position and velocity sensor represented at block 164 and a pulley 54 which operates the linear variable differential transformer which measures outhaul winch cable tension represented at block 56. A feedback signal from the linear variable differential transformer 56 is applied to one input of the outhaul winch control 104 through line 166. The output of the inhaul cable position and velocity sensor 160 at line 168 is applied to one input of a cable position input signal processor represented at block 170 through line 172 and to one input of a digital to analog velocity converter represented at block 174. Similarly, the output of outhaul cable position and velocity sensor 164 at line 176 is applied to one input of the cable position input signal processor represented at block 170 (FIG. 5B) through line 178 and to one input of a digital to analog velocity converter represented at block 174. (FIG. 5A) It should be noted the signal output from the cable position and velocity sensor at block 160 represents the position and velocity of the inhaul cable 62 which, it may be recalled, is that portion of the transfer cable 40 between the trolley 16 and the inhaul winch drum 114. Likewise, the output of the outhaul cable position and velocity sensor at 164 represents the position and velocity of the outhaul cable 64 which, it may be recalled, is that portion of the transfer cable 40 between the trolley 16 and the outhaul winch drum 118.

The cable position input signal procesor at 170 serves to process the digital cable position signals input from the sensors at 160 and 164 and to output a first digital up count signal or a first digital down count signal to a $3\frac{1}{2}$ digit up/down counter represented at block 180 through lines 182 and 184 and to output a second digital up count signal or a second digital down count signal to a second $3\frac{1}{2}$ digit up/down counter represented at block 186 through lines 188 and 190 respectively. The $3\frac{1}{2}$ digit counter at block 180 provides a digital display of the distance between the trolley 16 and the receiver ship 14 and the $3\frac{1}{2}$ digit up/down counter at 186 provides a digital display of the distance between the trolley 16 and the supply ship 12. The $3\frac{1}{2}$ digit up/down counters 180 and 186 provide the digital displays 84 and 82 respectively in the window 80 of control console 70 illustrated in FIG. 3. The $3\frac{1}{2}$ digit up/down counter at 180 outputs a binary signal representing the distance from the trolley 16 to the receiver ship 14 at line 192 to one input of a digital to analog converter represented at block 194. The digital to analog converter 194 outputs an analog signal to the right side of the trolley distance bar graph display represented at block 196 and illustrated at 86 in FIG. 3. Similarly, the 3½ digit up/down counter 186 outputs a binary signal representing the distance between the trolley 16 and the supply ship 12 to one input of a digital to analog converter 198 through line 200. Digital to analog converter 198 outputs an analog signal to the left side of the trolley distance bar graph display represented at block 202 and also shown at 86 in FIG. 3.

The digital to analog velocity converter represented at block 174 in FIG. 5A serves to convert the digital inputs from the inhaul and outhaul cable position and velocity sensors 160 and 164 to a plurality of analog signals representing cable velocity and trolley velocity. A signal V representing the velocity of the inhaul cable 62 which also represents the velocity of the trolley 16 as it moves towards the supply ship 12 is output from velocity converter 174 at line 204 to one input of a trolley velocity bar graph input selector represented at block 206 through line 208 and to one input of an auto transfer control network represented at block 210 through line 208. Velocity converter 174 outputs a second signal Vo representing the velocity of outhaul cable 64 at line 214 to one input of the auto transfer control network at 210. A third output from the digital to analog converter at 174 representing the velocity of the trolley 16 with respect to the receiver ship 14 and represented by the difference between the outhaul cable velocity Vo and the inhaul cable velocity Vi divided by two, i.e. $(Vo-Vi)/2$ at line 216 is applied to one input of the trolley velocity bar graph input selector at 206 through line 218 and to one input of the automatic transfer control at 210 through line 218. It may be recalled that the trolley velocity bar graph 90 in FIG. 3 displays the velocity of the trolley 16 with respect to the ship it is approaching. Accordingly, a signal representing transfer direction and represented as selected by a switch at 130 to correspond with that switch on panel 74 illustrated in FIG. 4 is applied to one input of the trolley velocity bar graph input selector at 206 through lines 220 and 222. Depending upon the direction of transfer signal received at its input, the trolley velocity bar graph input selector at 206 outputs an analog signal, representing the velocity of the trolley 16 with respect to the ship it is approaching, to a trolley velocity bar graph display represented at block 224 through a line 226. This bar graph display is depicted also at 90 in FIG. 3. A unique feature of the trolley velocity bar graph at block 224 is that the scale for 0 to 50 meters per minutes is expanded in that it occupies the first two and a half inches of the bar graph display, whereas the scale for 50 to 400 meters per minute occupies the remaining 3½ inches of the bar graph displayed. Thus, the resolution of the bar graph between 0 and 50 meters per minutes is 5 times the resolution of the bar graph between 50 and 400 meters per minute. The purpose of having a higher resolution at low speeds is to provide a more accurate readout of the trolley velocity during the critical landing operation which occurs at lower speeds. It should be noted that a signal representing the direction of transfer at 220 also is applied to one input of the automatic transfer control network at 210 through line 222.

The high line transfer system assumes an automatic operating mode when the selector switch shown at 100 in FIG. 4 and illustrated again in FIG. 5A at 100 is placed in the "automatic" position. In this mode, the movement of the trolley 16 between the supply ship 12 and the receiver ship 14 is controlled automatically by command signals output to the inhaul and outhaul winch controls 102 and 104 from the automatic transfer control network represented at block 210. A diagramatic illustration of the velocity of the trolley 16 under the control of the automatic transfer control network at 210 may be seen by referring to FIG. 6 which is a diagramatic representation of the velocity of the trolley with respect to the distance of the trolley from a ship. On the diagram of FIG. 6 numeral 230 represents a preset transfer speed selected by rotary dial 124 on control panel 74, numeral 232 represents a preset landing speed selected by rotary dial 126 on control panel 74 and numeral 234 represents a preset terminal landing speed. When the trolley 16 is to move from one ship to another, the automatic transfer control network 210 outputs command signals to increase the velocity of the trolley from the terminal velocity to the preset landing speed at 232. It should be observed that the velocity of the trolley is controlled by looking at the distance of the trolley with respect to the ship it is leaving. Consequently, the velocity of the trolley will automatically be adjusted to the existing conditions of ship movement. The transfer control command signals cause the trolley to be driven at the landing speed until it reaches a distance of approximately 8 meters from the ship at which time the control signals cause the trolley to undergo an increase in velocity up to the set transfer speed 230. The rate of change of velocity of the trolley from the terminal velocity up to the set landing speed 232 as represented by the slope of the line 240 and the rate of change of velocity of the trolley from the set landing speed at 232 to the set transfer speed at 230 as represented by the slope of the line 238 are constant with respect to distance and are adjusted to ensure that the load on the trolley does not swing and to insure that no large shock loads are imposed on the transfer system. Reference may be made to the same diagram to illustrate the movement of the trolley 16 under the control of the automatic transfer control network 210 when the trolley approaches a ship. At a distance dependent upon the preset transfer velocity 230 and the preset landing velocity the transfer control network outputs a commnd signal which causes the velocity of the trolley to decrease. This command signal ensures that the trolley will be at the preset landing speed when it is at a distance of approximately 8 meters from the ship and ensures that the rate of change of velocity will be constant with respect to distance as again represented by the slope of the line 238. The control network 210 will output command signals which will cause the trolley to be driven at the set landing speed and thereafter reduced in velocity to the preset terminal landing speed represented at 234. The distance at which the velocity of the trolley begins to decrease will be dependent upon the preset landng speed and the preset terminal landing speed. The rate of change of velocity of the trolley represented at line 240 from the preset landing speed at 232 to the preset terminal landing speed at 234 also is set to ensure that the trolley does not swing and that large shock loads are not imposed upon the transfer system when the trolley strikes the landing post or head of the ship. It may be observed that the automatic transfer control 210 of the subject invention changes the velocity of the trolley at the same rate with respect to distance regardless of the preset transfer speed and the preset landing speed. Likewise, the control changes the velocity of the trolley from a preset landing speed to the preset terminal speed at the same rate with respect to distance regardless of the landing speed which is set.

Looking again to FIG. 5B, when the high line transfer system is in the automatic mode, an initial tension control network represented at block 250 simultaneously outputs an initial tension command signal to one input of the inhaul winch control at 102 and to one input of the outhaul winch control at 104 through lines 252 and 254, respectively. These initial tension command signals are of equal magnitude. As a result the inhaul winch control at 102 and the outhaul winch control at 104 cause the inhaul winch 42 and the outhaul winch 46 respectively to exert equal, preset tensions on the inhaul cable 62 and the outhaul cable 64. Because the tensions on the inhaul and outhaul cables 62 and 64 are the same, there is no differential tension force across trolley 16 and it remains stationary. In operation, the automatic transfer control network at 210 operates the trolley 16 by outputting a velocity error signal or an automatic tension command signal to an input of the initial tension control network at 250 through a line 256. The automatic tension command signal causes one of the inhaul tension command signal or the outhaul tension command signal to increase and the other signal to decrease to cause the inhaul and outhaul winch controls 102 and 104 to operate the inhaul and outhaul winches 42 and 46 respectively such that the tensions in the inhaul and outhaul cables 62 and 64 adjacent the winches 42 and 46 are unequal. This differential tension force results in movement of the trolley 16.

An initial velocity control network represented at block 258 outputs an initial velocity command bias signals at lines 260 and 262 to inputs of the automatic transfer control network 210. This initial velocity command bias signal is modified by other command signal which are input to the automatic transfer control network 210 and the resultant automatic tension command signal is output at line 256.

The rotary dial shown at 124 in FIG. 4 and reproduced again in FIG. 5A drives a pair of dual ganged potentiometers 260 and 262 which output a maximum transfer velocity command signal at lines 264 and 266 to the input of a transfer limiter summing network representd at block 268. The network at 268 serves to modify the initial velocity command bias signals, and output the automatic tension command signal from control 210 at line 256 representing the velocity of the trolley when the automatic transfer control network 210, is in the transfer mode. A rotary dial shown at 126 in FIG. 4 and illustrated again in FIG. 5A drives a pair of dual ganged potentiometers 270 and 272 which output a maximum landing velocity command signal at lines 274 and 276 to the inputs of a landing limiter summing network represented at block 278. The network at 278 outputs an automatic tension command signal ouput at line 256 when the the automatic transfer control 210 is in the landing mode.

In the present transfer system, the automatic transfer control 210 operates in the landing mode when the trolley 16 is within 8 meters of either the supply ship 12 or the receiver ship 14 and operates in the transfer mode when the trolley 16 is at a distance greater than 8 meters from both ships. It may be observed that the digital-to-analog converter represented at block 194 outputs a signal to the input of the auto transfer control network 210 through line 280 when the trolley is within 8 meters of the receiver ship 14. Additionally, a landing logic detector 282 outputs a signal to an input of the automatic transfer control network 210 whenever the trolley 16 is within 8 meters of the supply ship 12 or the receiver ship 14 through line 284.

An automatic acceleration/deceleration control network represented at block 290 includes a transfer limiter circuit represented at block 292 and a landing limiter circuit represented at block 294. The automatic acceleration/deceleration control at 290 control the rate of acceleration and deceleration of the trolley 16 between the preset maximum transfer velocity and the preset landing velocity and between the preset landing velocity and the terminal velocity or the initial velocity. It may be observed that a landing velocity command signal is input to the transfer limiter circuit from the output of the potentiometer 272 through lines 276 and 296. Additionally, the digital-to-analog converter at 194 shown in FIG. 5B outputs an analog signal representing the distance between the trolley 16 and the receiver ship 14 to one input of the transfer limiter circuit network at 292 through line 298 and to one input of the landing limiter circuit 294 through lines 298 and 300. Also, the digital-to-analog converter at 198 outputs a signal representing the distance between the trolley 16 and the supply ship 12 to one input of the landing limiter circuit at 294 through line 302 and to one input of the transfer limiter circuit through lines 302 and 304. The transfer limiter circuit at 292 outputs a signal at line 306 to an input of the transfer limiter summing circuit 268 when the trolley 16 is accelerated or decelerated between the preset maximum transfer velocity and the preset landing velocity represented at 230 and 232 respectively, in FIG. 6. The signal output from the transfer limiter circuit clamps or limits the maximum transfer velocity command signals that are reflected at the output of the automatic transfer control network 210 in order to obtain the set rate of acceleration and deceleration for the trolley. Similarly, the landing limiter circuit at 294 outputs a signal at line 308 to an input of the landing limiter summing circuit at 278 when the trolley is decelerated between the preset landing velocity and the preset terminal velocity or when the trolley is accelerated to the preset landing velocity. The signal output from the landing limiter circuit at 294 serves to clamp or limit the landing velocity command signals that are output from the network 210 in order to obtain the set rates of acceleration and deceleration for the trolley 16.

In summarizing the operation of the transfer system in the "automatic" mode, it may be observed that the initial tension control network 250 provides simultaneous initial tension command signals to the inhaul and outhaul winch controls 102 and 104. The automatic transfer control network at 210 outputs an automatic tension commmand signal at 256 to the input of the initial tension control 250 to change the tension command signals to the inhaul and outhaul winches 102 and 104 when the trolley 16 must be moved. An initial velocity control network at 258 provides an initial velocity command bias signal to the automatic transfer control network 210. These bias signals are modified by inputs representing maximum transfer velocity command signals when the automatic transfer control is in the transfer mode and are interrupted by inputs representing a landing velocity command signal when the automatic transfer control is in the landing mode. A transfer limiter circuit at 292 limits the maximum transfer velocity command signals to obtain a desired rate of acceleration and deceleration between a preset maximum transfer velocity and a preset maximum landing velocity. Similarly, a landing limiter circuit modifies the landing velocity command signals to obtain a desired rate of deceleration between a preset landing velocity and a preset terminal velocity. It also modifies the landing velocity command signal to obtain a desired rate of acceleration to the preset landing velocity. FIGS. 7–14 describe the circuit of FIGS. 5A–5C in enchanced detail.

CABLE POSITION INPUT SIGNAL PROCESSOR

Figure 7A:
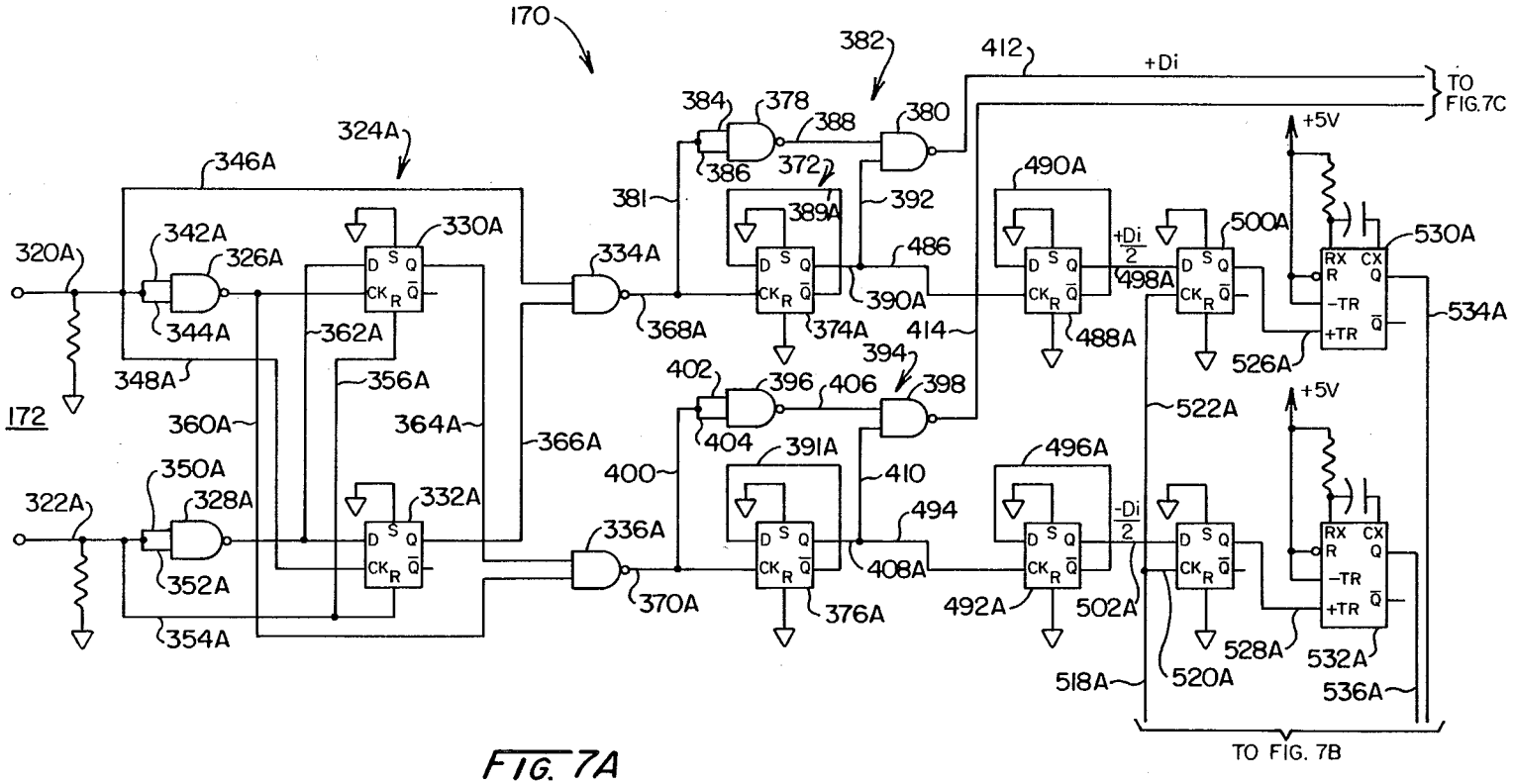
Figure 7B:
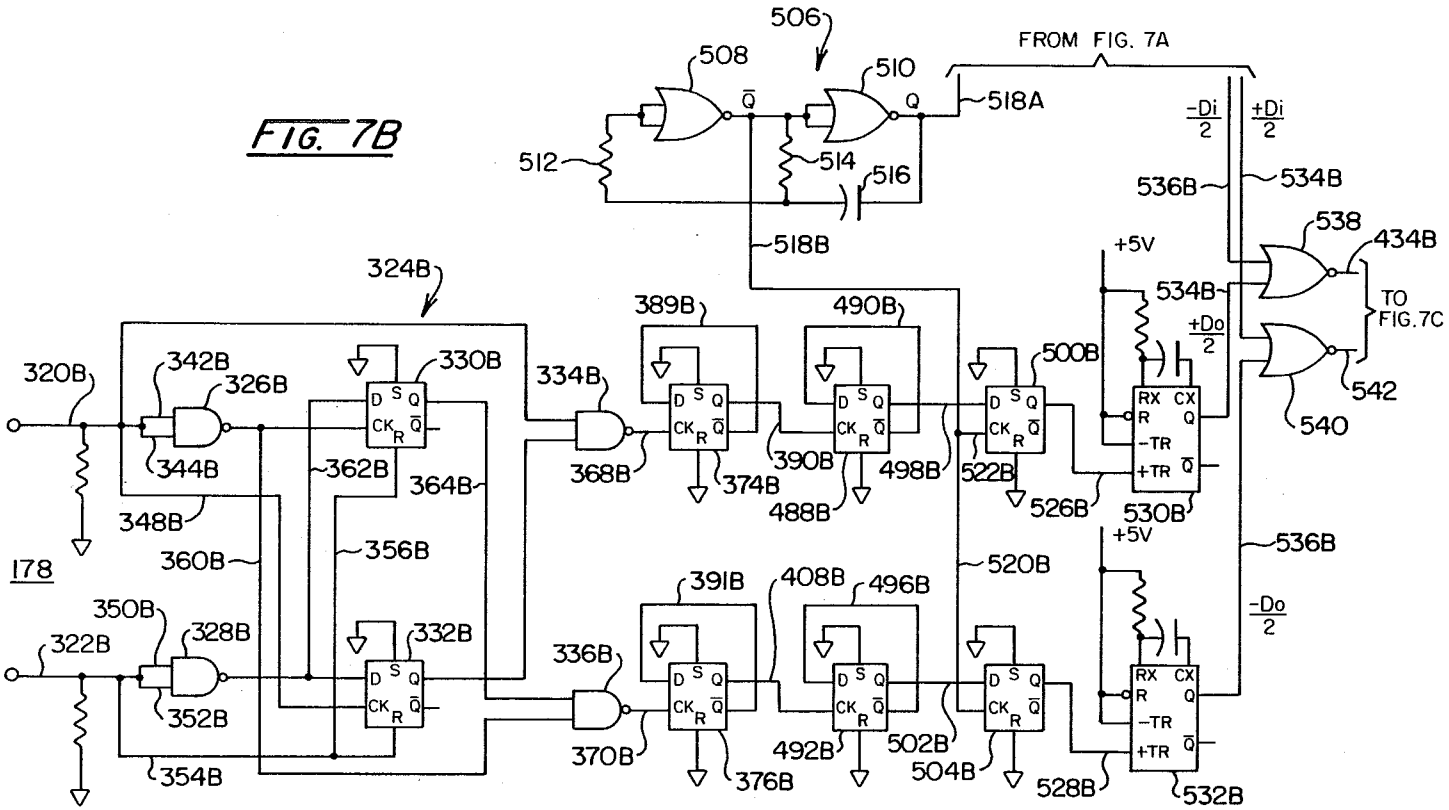

The cable position input signal processor network described in connection with block 170 is again represented in general at 170 in FIGS. 7A–7C. It may be recalled that signal processor network 170 receives input signals at lines 172 and 178 from inhaul and outhaul cable position and velocity sensors described earlier in connection with blocks 160 and 164, respectively. Network 170 outputs a first set of up count and down count signals at lines 188 and 190, respectively to the input of a 3½ digit up/down counter presented at block 186 which displays digitally the distance between the trolley 16 and the supply ship 12 and outputs a second set of up count and down count signals at lines 182 and 184 respectively to a 3½ digit up/down counter represented at block 180 which displays digitally the distance between the trolley 16 and the receiver ship 14. The lines 172 and 178 which represent the inputs to signal processor network 170 and the lines 182, 184, 188 and 190 representing the outputs of the signal processor network on the block diagrams are reproduced on FIGS. 7A–7C. Since the signal processing circuit for the signal output from the sensor 164 for the outhaul winch 46 shown in FIGS. 7B and 7C is substantially the same as that for the signal output from the sensor 160 for the inhaul winch 42 shown in FIGS. 7A and 7C., this description will cover the circuit for the signal from the inhaul winch sensor 160 with any differences therebetween noted. Components for the inhaul and outhaul signal processing circuits which are identical will be identified by the same numeral having an A suffix in the inhaul signal processing circuit and a B prefix in the outhaul signal processing circuit.

In order to provide a signal which may be processed to provide a digital readout of the distance between the trolley 16 and the supply ship 12 and the trolley 16 and the receiving ship 14, the inhaul and outhaul cable position and velocity sensors 160 and 164 include zero velocity pickups that are mounted in adjacency with 160 tooth spur gears which are mounted on pulleys 52 and 58 that are driven by the inhaul cable 62 and the outhaul cable 64 respectively. In this manner the gears are driven directly by the cable whose distance and velocity are being sensed by the adjacent pickups. The distance the trolley 16 moves with respect to the supply ship 12 is designated Di and is represented by the amount of cable which is paid out by the inhaul winch 42 whereas the distance the trolley 16 moves with respect to the receiver ship 14 is represented by the equation, the quantity Do minus Di divided by two (Do—Di)/2 where Do is the amount of cable which is paid out from the outhaul winch 46.

The pickup for the inhaul cable position and velocity sensor 160 produces two five volt square wave signals which are phase shifted 90 degrees and are input through 2 line 320A and 322A in cable 172. The direction of rotation of the gear 52 which is determined by whether cable is being paid out or hauled in by winch 42 will determine which square wave signal leads the other. One square wave signal is used as an up count signal and one square wave signal is used as a down count signal. The signal processor network 170 counts up when cable is paid out, and counts down when cable is hauled in. When the inhaul winch 42 is paying out cable, the square wave which is applied to line 320A leads the square wave which is applied to line 322A by 90 degrees.

The two signals are applied to a count direction circuit 324A which functions to output a signal representing an up count or down count for given amount of cable depending upon the direction winch 42 is being driven. The count direction circuit 324A includes a pair of type CD4011 two input logical NAND gates 326A and 328A, a pair of type CD4013 data latches 330A and 332A configured as a dual data latch, and a pair of two input NAND gates 334A and 336A. Line 320A is connected to the two inputs of NAND gate 326A through line 342A and 344A, to one input of NAND gate 334A through line 346A and to the clock input of data latch 332A through line 348A. Line 322A is connected to the inputs of NAND gate 328A through lines 350A and 352A, to the reset input of data latch 332A through line 354A and to the reset input of data latch 330A through lines 354A and 356A. The output of NAND gate 326A at line 358A is directed to the clock input of data latch 330A and to one input of NAND gate 336A through lines 358A and 360A. The output of NAND gate 328A is directed to the data input of latch 332A through line 361A and to the data input of latch 330A through lines 361A and 362A. Data latch 330A has its Q output at line 364A connected to one input of NAND gate 336A and data latch 332A has its Q output connected to one input of NAND gate 334A through line 366A.

Generally, an up count pulse is output from the count direction circuit 324A when the output of NAND gate 334A at line 368A undergoes a transition from a logic level low to a logic level high and a down count pulse is output from the circuit 324A when the output of NAND gate 336A at line 370A undergoes a transition from a logic level low to a logic level high. Consequently, the output of one of the NAND gates 334A and 336A must be initialized by undergoing a transition from a logic level high to a logic level low before a count pulse can occur.

When inhaul winch 42 is paying out cable, the five volt square wave signal applied to line 320A initially makes a transition from a logic level low to a logic level high. This signal leads an identical signal which is phase shifted 90 degrees and which is subsequently applied to line 322A. The signal transition at line 320A is received at the clock input of data latch 332A through line 348A and consequently, the output of NAND gate 328A which is at a logic level high is reflected at the Q output of latch 332A at line 366A which is connected to one input of NAND gate 334A. At the same time, the logic level high at line 320A is applied to the opposite input of NAND gate 334A through line 346A. The two logic level high inputs to NAND gate 334A cause the output at line 368A to undergo a transition from a logic level high to a logic level low. This initializes the count direction circuit 324A to output an up count pulse. Ninety degrees later, the square wave voltage signal which is applied to line 322A makes a transition from a logic level low to a logic level high. This logic level high is applied to the reset input of data latch 332A through line 354A and to the reset input of data latch 330A through lines 354A and 356A. The signal at the reset input of latch 332A causes the Q output at line 366A to assume a logic level low. This logic level low signal is reflected at one input of NAND gate 334A and causes the output at line 368A to assume a logic level high. Since the output at line 368A experienced a transition from a logic level low to logic level high, an up count pulse was output from the count direction circuit 324A.

The next signal change occurs 90 degrees after the low to high transition at line 322A and is a transition from a logic level high to a logic level low at line 320A. The logic level low at the inputs of NAND gate 326A cause the output at line 358A to assume a logic level high. This signal is reflected at the clock input of data latch 330A and causes the signal at the data input which is at a logic level low, to be reflected at the Q output which in turn is connected through line 364A to one input of NAND gate 336A. A logic level low signal also is applied to one input of gate 334A from line 346A. Since one input of gates 334A and 336A is low, their outputs remain high and no change occurs in the output of the count direction circuit 324A. The last transition which occurs for the two signals input from cable 172 during an up count signal sequence is a logical transition from a level high to a level low at line 322A. This transition at the input of NAND gate 328A has no effect on the inputs or the outputs of the NAND gates 334A and 336A.

When the inhaul winch 42 is hauling in cable the count direction circuit 324A will output down count pulses. The first of the two five volt square wave signals from the cable position and velocity sensor 160 will be input to cable 172 and applied to line 322A. The logic level low to a high transition at line 322A will be applied to the inputs of NAND gate 328A and to the reset input of data latch 332A through line 354A and to the reset input of data latch 330A through lines 354A and 356A. Resetting the latches results in a logic level low signal being output from latch 330A to one input of NAND gate 336A through line 364A and a logic level low signal being output from latch 332A to one input of NAND gate 334A through line 366A. The low inputs to the two NAND gates will cause their outputs to be held high such that no initialization of the count circuit will occur. Ninety degrees later, a second square wave signal is applied to line 320A and makes a transtition from a logic level low to a logic level high. This signal is applied to the clock input of data latch 332A through line 348A. Consequently, the logic level low output at NAND gate 328A and seen at the data input of latch 332A is transferred to the Q output at line 366A that is connected at one input of NAND gate 334A. Consequently, the output of gate 334A at line 368A remains high and no initialization of the count circuit occurs. A third transition occurs 90 degrees after the second transition when the first five volt square wave signal at line 322A changes from a logic level high to logic level low. A logic level low at the inputs of NAND gate 328A results in a logic level high being output at line 361A that is connected to the data inputs of the latches 330A and 332A. However, no changes occur at the input or the outputs of NAND gates 334A and 336A and, therefore, the count direction circuit 324A is not initialized to output a count pulse. The 4th transition occurs 90 degrees later when the second five volt square wave signal changes from a logic level high to a logic level low at line 320A. The logic level low signal is applied to both inputs of NAND gate 326A. Resultantly, the output of gate 326A at line 358A assumes a logic level high. This high signal is applied to one input of NAND gate 336A through line 360A and to the clock input of data latch 330A. The clock signal causes the signal at the data input which is at a logic level high, to be transferred to the Q output at line 364A which is connected to the second input of NAND gate 336A. Because both inputs to gate 336A are logic level high signals, the output at line 370A makes a transition from a logic level high to a logic level low. This initializes the down count portion of circuit 324A. The next signal which is applied to cable 172 during the haul in process is a five volt, square wave making a transition from a logic level low to a logic level high at line 322A. This signal is applied to the reset inputs of the latches 330A and 332A. Consequently, the Q outputs of these latches assume a logic level low. The logic level low output of latch 330A at line 364A is applied to one input of NAND gate 336A which causes the output of that gate at line 370A to make a transition from logic level low to logic level high. This causes a down count pulse to occur out of count direction circuit 324A at line 370A.

The output of count direction circuit 324A is connected to a divide by two circuit 372A. The output of NAND gate 334A at line 368A is connected to the clock input of a type CD4013 data latch 374A which is configured as a divide-by-two device by having the $\overline{Q}$ output at line 389A connected to the data input. With this configuration, the Q output will make a transition from logic level low to logic level high once for every two clock pulses. This device is necessary because each pulse which is output from count direction circuit 324A at line 368A represents 0.005 meters of cable, whereas the digital counter 186 will only accept inputs in units of 0.01 meters. The output of NAND gate 336A at line 370A likewise is connected to the clock input of a type CD4013 data latch 376A configures as a divide-by-two device by having $\overline{Q}$ output at line 391A connected to its data input.

Across the divide by two latch 374A is a pair of type CD4011 two input NAND gates 378 and 380 which comprise a pulse limiter circuit 382. The output of NAND gate 334A at line 368A is connected to the inputs of NAND gate 378 through lines 381, 384 and 386. The output of gate 378 at line 388 is connected to one input of NAND gate 380. Likewise, the Q output of data latch 374A at line 390A is connected to one input of NAND gate 380 through line 392. A similar pulse limiter circuit 394 having a pair of type CD4011, two-input NAND gates, 396 and 398, is connected across data latch 376A. The output of NAND gate 336A at line 370A is connected through line 400 and lines 402 and 404 to the inputs of NAND gate 396 having its output at line 406 connected to one input of gate 398. The Q output of latch 376A at line 408 is directed to an input of NAND gate 398 through line 410. It may be observed that pulse limiter circuits are not applied to the divide by two latches 374B and 376B in the up count and down count circuit for the outhaul winch 42. This is because the signals from that winch pass through one-shot multivibrators which act as pulse limiters before the signals are applied to the input of counter 180.

The pulse limiter circuits 382 and 394 operate to limit the length of time a negative signal is output from NAND gate 380 at line 412 and from NAND gate 398 at line 414 to the inputs of the digital counters. The length of the negative signal must be limited because the up count or down count portion of the inhaul winch circuit which is not counting (inactive) must have its output of a logic level high state during the time the active count portion, i.e. the one that is counting, receives a count signal. The length of time an output line 368A or 370A of count direction circuit 324A is initialized sets the maximum time that the up count output at line 412 or the down count output at line 414 may be at a logic level low.

Because the divide-by-two data latches 374A and 376A may output a negative signal for a substantial period of time, the pulse width limiter circuits 382 and 394 operate to limit this time. If the Q output of data latch 374A is at a logic level high, the signal input to NAND gate 380 through line 392 likewise is at a logic level high. When NAND gate 334A in the count direction circuit 324A is initialized and line 368A makes a transition from a logic level high to a logic level low, the same logic level is seen at the inputs of NAND gate 378. As a result, the output at line 388 is at a logic level high. Because both inputs of NAND gate 380 are high, the output at line 412 assumes a logic level low. The line remains in this state until line 368A makes a transition from the logic level low to a logic level high. Thus, it may be seen that the length of time the signal ouput to line 412 may be at a logic level low is determined by the length of time the output of NAND gate 334A is initialized. The pulse limiter circuit 394 operates in the same manner. The maximum length of time a negative signal may be output at line 414 is equal to the length of time the count direction circuit 324A is initialized by having the output of NAND gate 336A at line 370 at a logic level low. Thus, the pulse limiting time period is dependent upon the speed of the pulleys. 52 and 58 which drive the cable position and velocity sensors 160 and 164.

From the above, it may be seen that voltage signal that makes a transition from a logic level low to a logic level high is output from the pulse width limiter circuit 382 and applied to line 412 as an up count pulse each time inhaul winch 42 pays out a length of 0.01 meters of cable and that a like signal is output from the pulse width limiter circuit 394 and applied to line 414 as a down count signal each time the inhaul winch 42 hauls in a 0.01 meter length of cable. The up count or positive and the down count or negative cable distance signals at lines 412 and 414 are applied to a steering circuit represented at 420A. So long as the trolley 16 is some distance from the supply ship 12, the 3½ digit up/down counter represented at block 186 will display a positive distance. When the trolley 16 is pulled against the ship 12, the distance from the trolley 16 to the ship 12 is zero. However, as the trolley 16 is lowered to the deck of the ship 12, cable is pulled in by the inhaul winch 42 and normally the counter display would make a transition from 0.0 to 99.9 and count down from that point. In the present control circuit the digital counter 186 counts up from zero with a negative sign in front of the number when the counter 186 passes through zero and the trolley 16 is lowered to the deck of the ship 12. In this manner an operator has an indication of the exact position of the trolley 16 both when it is away from a ship and when it is against a ship and being lowered to the deck. Consequently, the steering circuit 420 functions to direct the up count signals at line 412 into the down count input at line 190 of the counter 186 and to direct the down count signals present at line 414 into the up count input at line 188 of the counter 186 when the trolley 16 is between the transfer head 20 and the deck of the ship 12.

The steering circuit 420A includes 4 type CD4071 logical two-input OR gates 422A, 424A, 426A and 428A and two types CD4081 logical two input AND gates 430A and 432A. Line 412 which carries up count signals is connected to one input of OR gate 426A through line 433A and to one input of OR gate 422A through line 434A. Similarly, line 414, which carries down count signals is connected to one input of OR gate 424A through line 436A and to one input of OR gate 428A through line 435A. The outputs of OR gates 422A and 424A at lines 438A and 440A, respectively, are connected to the inputs of AND gate 430A having an output connected to the up count input of counter 186 at line 188. Similarly, the outputs of OR gates 426A and 428A at lines 442 and 444A respectively are connected at the inputs of AND gate 432A having an output connected to the down count input at line 190 of counter 186.

The steering circuit 420A is controlled by a type CD4013 data latch or flip flop 446A. The Q output of flip flop 446A at line 448A is connected to one input of OR gate 428A through line 452A and to one input of OR gate 422A through line 454A. The $\overline{Q}$ output of data latch 446A at line 456A is connected to one input of OR gate 424A through line 457A and to one input of OR gate 426A through line 458A. It may be seen that the $\overline{Q}$ output of latch 446A is tied to the data input through lines 452A and 451A. Also, it may be seen that the clock input at line 459A of data latch 446A is connected to the output of a type CD4011 two input logical NAND gate 461A. This gate has its inputs at lines 458A and 460A held at a logical high value by a positive five volts applied to them through line 462A which carries pull-up resistor ROA and line 466A.

Under normal counting conditions, i.e. the inhaul cable length 62 (Di) is greater than zero, the Q output at line 448A is at a logic level low and the $\overline{Q}$ output at line 456A is at a logic level high. The logical high signal at line 456A is applied to one input of OR gate 426A and to one input of OR gate 424A. With a high on one input, the output of the OR gates 424A and 426A is always high and any secondary input has no effect. The high output of OR gate 424A at line 440A is applied to one input of AND gate 430A and the high outout of OR gate 426A at line 442A is applied to one input of AND gate 432A. Since those inputs of the OR gates 422A and 428A that are connected to the Q output of data latch 446A are at a logic level low, the outputs of these devices will be set by the signal at the secondary input thereof. Consequently, the logical state of line 412 which carries up county signals and is connected to the input of OR gate 422A through line 434A will be reflected at the output thereof at line 438A which is connected to a secondary input of AND gate 430A. Thus, when a voltage signal at line 412 makes a transition from a logic level low to a logic level high, this signal is seen at the input of AND gate 430A through line 438A. Since the input to AN gate 430A at line 440A already is at a logic level high, the low to high transition from the up count pulse will be reflected at the output of AND gate 430A which is connected to the up count input at line 188 of counter 186. Similarly, a voltage transition from logic level low to logic level high at line 414 representing a down count pulse will be reflected at the output of OR gate 428A which is connected to the input of AND gate 432A through 444A. Because the opposite input at line 442A to AND gate 432A is at a logic level high, the down count signal transition will be reflected at the output of AND gate 432A which is connected through line 190 to the down count input of counter 186.

When 3½ digit up/down counter 186 down counts through zero, the borrow signal from the most significant bit of the counter produces a low output to line 466 which cause the inputs of NAND gate 461A at lines 458A and 460A to assume a logic level low. As result, the output of gate 461A will assume a logic level high state which will be applied to the clock input of flip flop 446A. The clock input will cause the Q and $\overline{Q}$ outputs at lines 448A and 456A to exchange states wherein the $\overline{Q}$ output at line 448A is at a logic level high and the Q output at line 456A is at a logic level low. Therefore, the high logic level at line 448A will be applied to one input of OR gates 428A and 422A to cause their outputs to go high and thereby incapacitate them during the time the counter is counting in a negative direction. Also, the logical level low at line 456A will be applied to one input of OR gates 424A and 426A such that the signal applied to the second input thereof determines the logic level of the signals output at lines 440A and 442A, respectively. As a result, up count signals at line 412 which are applied to the input of OR gate 426A will be reflected at the output thereof at line 442A which is connected to an input of AND gate 432A. Consequently, the up count signal will be reflected at the output of AND gate 432A at line 190 which is connected to the down count input of counter 186. Similary, the down count signals at line 414 which are applied to the input of OR gate 424A through line 436A will be reflected at the output thereof at line 440A which is connected to the input of AND gate 430A. Therefore, the down count signals will be reflected at the output of AND gate 430A at line 188 which is connected to the up count input of counter 186.

It should be noted that the reset input of flip flop 446A is connected to the output of a type CD4011 two-input logical NAND gate 468A through line 470A. The inputs to this gate at lines 472A and 474A are held high by a five volt input at line 476A which carries resistor pull-up R1A and is connected to line 480A that is connected in common with input lines 472A and 474A. When the trolley 16 is in a transfer mode, i.e. more than 8 meters distance from supply ship 12, a signal having a logic level low is applied to line 482A. This signal is applied to the inputs of NAND gate 468A and the output thereof at 470A assume logic level high value. Consequently, flip flop 446A is reset such that the Q and Q outputs at line 448A and 456A assume logic level low and logic level high states, respectively. This reset is precautionary since those outputs should be at this state to permit the counter to count positively whenever the trolley 16 is away from the ship 12.

Returning again to the pulse width limiter circuit 382 of the input signal processor network 170, it may be observed that the Q output of the divide by two data latch 374A at line 390A is connected to the clock input of a type CD4013 data latch 488A through line 486. Latch 488A is configured as a divide-by-two device by having the Q output at line 490A connected to the data input. Similarly, the output of the data latch 376A for the down count circuit at line 408A is connected to the clock input of a type CD4013 data latch 492A through line 494. Latch 492A is configured as a divide-by-two device by having its $\overline{Q}$ output connected to its data input through line 496A. Consequently, the Q output of the data latch 488A is an up count or positive signal representing one-half the distance moved by the trolley 16 (plus Di divided by 2). This signal is applied to the data input of type CD4013 data latch 500A through line 498A. Similarly, the Q output of data latch 492A is a down count or negative signal representing one-half the distance moved by the trolley 16 (minus Di divided by 2). This signal is supplied to the data input of a type CD4013 data latch 504A through line 502A.

A clock circuit 506 including a pair of serially connected type CD4001 two-input logical NOR gates 508 and 510, resistors 512 and 514 and capacitor 516, all of which are configured in a well-known manner has a Q output at line 518A which is applied to the clock input of latch 504A through line 520A and to the clock input of latch 500A through line 522A. The clock has a $\overline{Q}$ output at line 518B which is connected to the clock input of latch 500B through line 522B and to the clock input of data latch 504B through line 520B in the outhaul winch circuit. The clock and the $\overline{\text{clock}}$ signals are generated 180 degrees apart. The clock speed is set so that the sample rate of the data latches 500A and 504A is approximately 10,000 cycle per second. Any transition at the data inputs of the latches 500A and 504A will be reflected at the Q outputs at lines 526A and 528A. Output line 526A is connected to the trigger input of a type CD4098 monostable, multivibrator (one-shot) 530A. The output of latch 504A at line 528A, likewise, is connected to the trigger input of an identical monostable, multivibrator 532A. The multivibrators 530A and 532A act as pulse width limiting devices. When an up count or a down count signal at lines 526A and 528A is applied to the trigger input of multivibrator 530A and 532A, the outputs of the devices, lines 534A and 536A, respectively, will have a transition from a logic low level to a logic high level, with a duration of approximately 25 microseconds.

The signal representing the distance plus Di divided by 2 which is output from multivibrator 530A at line 534A is reapplied to one input of a type CD4001, two-input NOR gate 540. Similarly, the signal representing the distance minus Di divided by 2 which is output at line 536A from multivibrator 532A is applied to one input of an identical NOR gate 538. Looking to the circuit for the outhaul winch, it may be seen that the signal representing one-half the distance moved by the outhaul cable 64, i.e. plus Do/2, output from monostable, multivibrator 530B at line 534B, is applied to one input of NOR gate 538 and that the signals representing the distance minus Do/2, output from monostable multivibrator 532B at line 536B, is applied to one input of NOR gate 540.

It may be recalled that counter 180 displays the distance of the trolley 16 from the receiver ship 14 and that this distance is represented, generally, by the equation (Do/2−Di/2) or (Do−Di)/2. Thus, when trolley 16 moves away from the receiver ship 14, the distance represented by plus Di divided by 2 must be subtracted from the distance represented by plus Do divided by 2 to give the trolley distance from the receiver ship 14. To do this, the signal Do divided by 2 must be applied to the up count input at line 182 of counter 180 and the signal representing minus Di divided by 2 also must be applied to the up count input at line 182 of counter 180. It should be noted that whereas the data latches 500A and 504A in the circuit for the inhaul winch are clocked by the Q output of clock 506, the data latches 500B and 504B in the circuit for the outhaul winch are clocked by the $\overline{Q}$ output of clock 506. Therefore, the signals from the inhaul winch sensor 160 and the outhaul winch sensor 164 will be input to the NOR gates 538 and 540 sequentially.

Referring to steering circuit 420B for the outhaul winch 46, it may be recalled that when the trolley 16 is away from the receiver ship 14, the digital display is positive and the Q output of data latch 446B at line 448B is at a logic level low and the $\overline{Q}$ output is at a logic level high. Consequently, OR gates 424B and 426B are deactivated and signals are directed to the up count input at line 182 through OR gate 422B and to the down count input at line 184 through OR gate 428B.

When the trolley 16 is moving away from the receiver ship 14, the outhaul winch 46 is paying out cable (counting up) and the inhaul winch 42 is hauling in cable (counting down). As the outhaul winch 46 counts up, signals representing plus Do divided by 2 are output from multivibrator 530B at line 534B and applied to the input of NOR gate 538. It may be recalled that count signals are brief voltage transitions from a logic level low to a logic level high. The count signal at the input of gate 538 causes the output thereof at line 434B to momentarily attain a logic level low which is applied to the input of active OR gate 422B and reflected at the output thereof of line 438B that is in turn connected to the input of AND gate 430B. The logical low to high signal transition at the input of AND gate 430B is reflected at the output thereof that is connected to the up count input 182 of counter 180. This transition will be seen as an up count by counter 180. Subsequently, the monostable multivibrator 532A in the inhaul circuit will output a down count signal representing the distance minus Di divided by 2 to the input of NOR gate 538. This input will cause the output at line 438B to make a transition from a logic value high to a logic value low which will be input to OR gate 422B and reflected at its output at line 438B which is connected to one input of AND gate 430B. A high to low transition at the input will be reflected at the output of gate 430B at line 182 and will be seen as an up count by counter 180. From this, it may be observed that the sum of the distance Do divided by 2 and negative Di divided by 2 is applied to the up count input of counter 180 to determine the distance of trolley 16 from receiver ship 14 as the trolley 16 is moving away from the receiver ship 14. In this instance, the amount of cable which is hauled in (Di) by the inhaul winch 42 is the same as the amount of cable (Do) which is paid out by the outhaul winch 46. Consequently, the signals representing one half of each of these amounts, i.e., Do divided by 2 and minus Di divided by 2 must be added together to obtain the distance trolley 16 moves away from the receiver ship 14. When the trolley 16 is moving toward the receiver ship 14, the outhaul winch 46 is hauling in cable (counting down) and the inhaul winch 42 is paying out cable (counting up). As the inhaul winch 42 counts up, signals representing plus Di divided by 2 are output from multivibrator 530A at line 534A and applied to an input of NOR gate 540. Similarly, signals representing minus Do divided by 2 are output from multivibrator 532B at line 536B and applied to an input of NOR gate 540. The count signals applied to the inputs of gate 540 are passed through OR gate 428B and AND gate 432 to the down count input 184 of counter 180 as described above. Thus, it may be seen that the sum of distance plus Di divided by 2 and negative Do divided by 2 are applied to the down count input of counter 180 as the trolley 16 is moving towards the receiver ship 14. In this instance the amount of cable which is hauled in (−Do) by the outhaul winch 46 is the same as the amount of cable (Di) which is payed out by inhaul cable winch 42. Thus, the signals representing one-half of each of the amounts must be added together to obtain the distance trolley 16 moves towards the receiver ship 14.

Steering circuit 420B operates in the same manner as steering circut 420A. When the trolley 16 is at the receiver ship 14 and is lowered to the deck of the ship, latch 446B is clocked by the borrow input at line 466B. This causes the Q output at line 448B to assume a logic level high which incapacitates OR gates 422B and 428B and the $\overline{Q}$ output at line 456B to assume a logic level low which activates OR gates 424B and 426B. Consequently, the up count and down count signals are input to the down count and up count inputs at lines 184 and 182, respectively.

Thus, it may be seen that the cable position input signal processor circuit at 170 provides up count and down count signal to the inputs 188 and 190 of the 3½ digit up/down counter 186 which displays the distance between the trolley 16 and the supply ship 12; and up count and down count signals to the inputs 182 and 184, respectively, of the 3½ digit up/down counter 180 which displays the distance between the trolley 16 and the receiver ship 14.

THREE AND ONE HALF DIGIT UP/DOWN COUNTER

Figure 8:
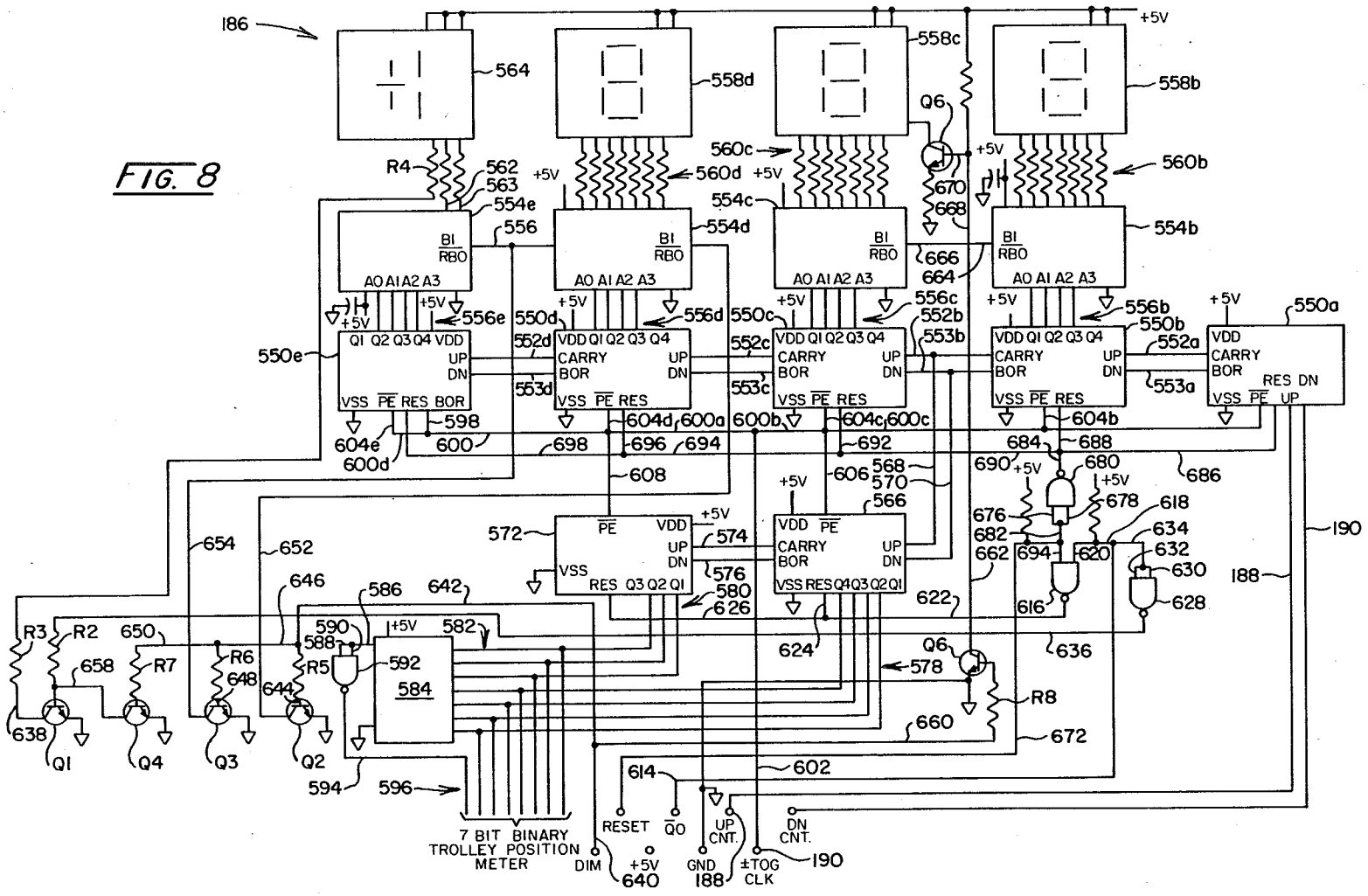
FIG. 8 is an electrical schematic diagram of the signal treatment for the digital display of trolley distance.

The 3½ digit up/down counters 180 and 186 are identical. Hence, this description will be in connection with counter 186. Turning to FIG. 8, it may be seen that the up count and down count inputs 188 and 190 are again reproduced. These inputs enter the first of a series of five cascaded type CD40192 binary coded decimal (BCD) decade counters 550A through 550E. These binary bit counters 550A–550E are programmed to reset to zero after the ninth count and to output a carry signal to the up count input of the adjacent counter through lines 552A through 552D after each tenth up count signal input. The counters 550A through 550E also output a borrow signal to the down count input of the adjacent counter through lines 553A through 553D after each tenth down count input signal. A count pulse is input at lines 188 and 190 for each 0.01 meter distance. However, the least siginificant digit of counter 186 is 0.1 meters. Consequently, the tenths units display is driven by counter 550B, the ones units display is driven by counter 550C, the tens unit display is driven by counter 550D and the hundreds unit display is driven by counter 550E. The outputs of each BDC counter 550B through 550E are connected to the inputs of a type 7447 BCD to 7 segment decoder (TTL) 554B through 554E, respectively, through 4 line arrays 556B through 556E, respectively. Each of the 7 segment decoders 554B through 554D has its outputs connected to the inputs of a type MAN 4610, 7 segment, light emitting diode (LED) readout 558B through 558D, respectively, through 7 line arrays 560B through 560D. The outputs of decoder 554E at lines 562 and 563 are connected to the inputs of a type MAN 4605 half-digit display 564. This display incorporates two segments to indicate the numeral 1, and two segments to indicate either a plus or a minus sign.

It may be seen that the carry and borrow outputs of counter 550B at lines 552B and 553B are connected to the up count and down count inputs, respectively, of a type CD40193 binary counter 566 through lines 568 and 570, respectively. Consequently, signals representing a change of distance of plus 1 meter are input to counter 566 through line 568 and signals representing a change of distance of minus 1 meter are input to counter 566 through line 570. The carry and borrow outputs of counter 566 are connected to the up count and down count of an identical counter 572 through lines 574 and 576. Hence the counters 566 and 572 are cascaded in such a manner that the output of counter 566 at the 4 line array 578 and the output of counter 572 at the 3 line array 580 may be combined to provide a 7-bit binary output at 7-line array 582 that can count up to 128. Seven-line array 582 is connected to the inputs of a type CD4532 8-bit priority encoder 584. The output of encoder 584 at line 586 is held at a logic level low state when the count input is less than 8, meaning the trolley is at a distance of less than 8 meters from the supply ship 12. Line 586 is connected to the inputs at lines 588 and 590 of a two-input NAND gate 590 which functions as an inverter, thereby causing the output at line 594 to assume a logic level high when the input count is less than 8. The 7-line array 582 is connected to a 7-line array 596 which provides a 7 bit binary coded output to a digital-to-analog converter described in conjunction with FIG. 9 hereinbelow.

It may be recalled in connection with the discussion of the cable position input signal processor circuit 170, illustrated in FIGS. 7A–7C, that the count pulses applied to the up count and down count inputs of the counters 180 and 186 are reversed when the counter passes from a positive number through zero to a negative number. In other words, the 3½ digit display 186 counts down from a positive number to zero and then counts up with a minus sign in front of the number. In order to direct the up count and down count signals to the down count and up count inputs of counter 186 and 180, a signal undergoing a transition to a logic level low must be received at the lines 466A and 466B which will cause the Q outputs of data latches 446A and 446B to change logic level and thereby reverse the up count and down count signal inputs. Such a logic level low signal is applied to the lines 466A and 466B from the borrow output at line 598 of the most signficant bit counter 550E which output assumes a logic level low when the counter passes through zero in the negative or positive direction. The signal at line 598 is output from the 3½ digit up/down counter 186 to line 466A through line 602 which is connected to output line 598 through line 600.

It is essential to ensure that all count signals which are applied to the inputs at lines 188 and 190 are accounted for during the time data latch 446A operates to reverse the up count and down count signals. During this transition, the outputs of the counters 550A through 550E, 566 and 572 are forced to assume a logic level low. This is accomplished by connecting the borrow output of counter 550E at line 598 to each of the program-enable-not, $\overline{PE}$, inputs at lines 604A through 604E, respectively, for counters 550A through 550E, respectively, at line 606 for counter 566 and at line 608 for counter 572. When the $\overline{PE}$ inputs are at a logic level low, the outputs of the counters will assume the logical state imposed upon 4 jam inputs to each counter, not shown. The jam inputs for each counter are tied to ground. Consequently, the outputs of each counter are at a logic level low when its $\overline{PE}$ input is at logic level low. The $\overline{PE}$ inputs at lines 604A–604E for the counters 550A–550E are connected to the borrow input of counter 550E at line 598 through lines 600 through 600D.

Referring again to the down count input at line 190 of counter 186 at FIG. 7C, a potential problem arises because this input is at logic level low when the borrow output of counter 550E outputs a logic level low to cause latch 446A to change state. When latch 446A changes state, the down count output at line 190 will assume a logic level high. Thus, the transition at line 190, which appears as a down count pulse, resulted only because of a change of state of latch 446A. If this down count pulse were accepted by the counters 550A through 550E, the LED displays 558B through 558D would indicate 99.99. Consequently, counter 186 must be prevented from accepting the marverick down count signal input at line 190. Counter 186 does not accept that down count signal because all of the $\overline{PE}$ inputs are forced to assume a logic level low during the time the down count makes a transition from a logic level low to a logic level high in each of the counters 550A through 550E as described above. Thus, counter 186 counts up from zero when the trolley 16 is lowered to the deck of the ship 12.

Turning again to FIG. 7C, it may be observed that when data latch 446A changes state because the counter is counting below zero, its $\overline{Q}$ output at line 456A assumes a logic level low which is reflected at lines 452A and line 612 which is output from the cable position input signal processor 170. Looking again to FIG. 8, output line 612 is connected to input line 614 that in turn is directed to one input of a type CD4011 two-input logical NAND gate 616 through line 618 and 620. The output of gate 616 at line 622 is connected to the reset input of counter 566 through line 624 and to the reset input of a counter 572 through line 626. Consequently, the logic level low which is output from signal processor network 170 at line 612 when the trolley is at zero distance from the ship 12 will be applied to line 614 and will cause the output of gate 616 to assume a logic level high and thereby reset counters 566 and 572 to zero.

Line 614 also is directed to the inputs of a type CD4011 two-input logical NAND gate 628 at line 630 and 632 through line 634. The output of NAND gate 628 at line 636 which carries resistor R2 is connected to the base of a common emitter transistor Q1 which is a driver for the minus sign of LED display 564. The collector of transistor Q1 is connected to the minus sign input of LED 564 through line 638 and resistors R3 and R4. When the logic level low signal is applied to input line 614 and to the inputs of NAND gate 628, its output at line 636 assumes a logic level high which is applied to the base of transistor Q1. This activates transistor Q1 and enables current to flow through line 638 such that the minus sign in LED 564 is illuminated.

Turning briefly to FIG. 4, it may be recalled that panel 74 contains a rotary, digital dimmer control switch 146 and a zero distanace reset switch 140. The functions of these controls may be seen by referring again to the circuit illustrated in FIG. 8. The output of the rotary dimmer control switch 146 is connected to input line 640 that is connected to the base of a common emitter transistor Q2 through line 642 and line 644 which contains resistor R5. Input line 640 also is connected to the base of a common emitter transistor Q3 through lines 642 and 646 and line 648 which carries resistor R6 and to the base of a common emitter transistor Q4 through lines 642 and 646 and line 650 which contains resistor R7. The collector of transistor Q2 is connected to the blanking input of 7-segment decoder 554D through line 652, the collector of transistor Q3 is connected to the blanking input of decoder 554E through lines 654 and 656, and the collector of transistor Q4 is connected to the base of transistor Q1 through line 658. Input line 640 also is connected to the base of a common emitter transistor Q5 through line 660 and resistor R8. The collector of transistor Q5 is connected to the blanking input of decoder 554B through lines 662 and 664, to the blanking input of decoder 554C through lines 662 and 666, and to the base of a common emitter transistor Q6 through lines 662, 668 and 670. The collector of transistor Q6 is connected to the decimal point input of LED 558C. Hence, the dimmer control signal input at line 640 controls the light intensity of the digits in the LED displays 558B through 558D and 564, including the decimal point in LED 558C and the minus sign in LED 564. The dimmer control input is a pulse width modulated signal, wherein the width of a square wave is altered to change the amount of time the transistors which control the LED displays are turned on.

The manual zero distance switch 140 on control panel 74 allows a system operator to reset the counters to zero when the trolley 16 is against a ship. The reset input is a control signal which makes a transition from a logic level high to a logic level low. The rest input signal is applied to input line 672 which is connected to one input a type CD4011 two-input NAND gate 616 through line 674 and to both inputs at lines 676 and 678 of an idential two-input NAND gate 680 through line 682. A logic level low signal at 672 will cause the output of NAND gate 616 at line 622 to assume a logic level high. This logic level high will be applied to the reset input of counter 566 through line 624 and to the reset input of counter 572 through line 626. Similarly, a logic level low applied to the inputs of NAND gate 680 will cause the output at line 684 to assume a logic level high. The logic level high signal at line 684 will be applied to the reset input of counter 550A through line 686, to the reset input of counter 550B through line 688, to the reset input of counter 550C through lines 690 and 692, to the reset input of counter 550D through lines 690, 694, and 696, and to the reset input of counter 550E through lines 690, 694 and 698.

As mentioned previously, the 7-bit binary output from counter 186 at 7-line array 596 will be utilized to provide a digital input to one side 202 of a dual tandem bar meter which displays, graphically, the distance between the trolley and the supply ship 12. Similarly, the 7-bit binary output from 3½ digit up/down counter 180 not shown on FIG. 8, is applied to the opposite side 196 of the dual bar meter which displays, graphically, the distance between the trolley 16 and the receiver ship 14.

Tandem Bar Meter Graphic Distance Display

Figure 9:
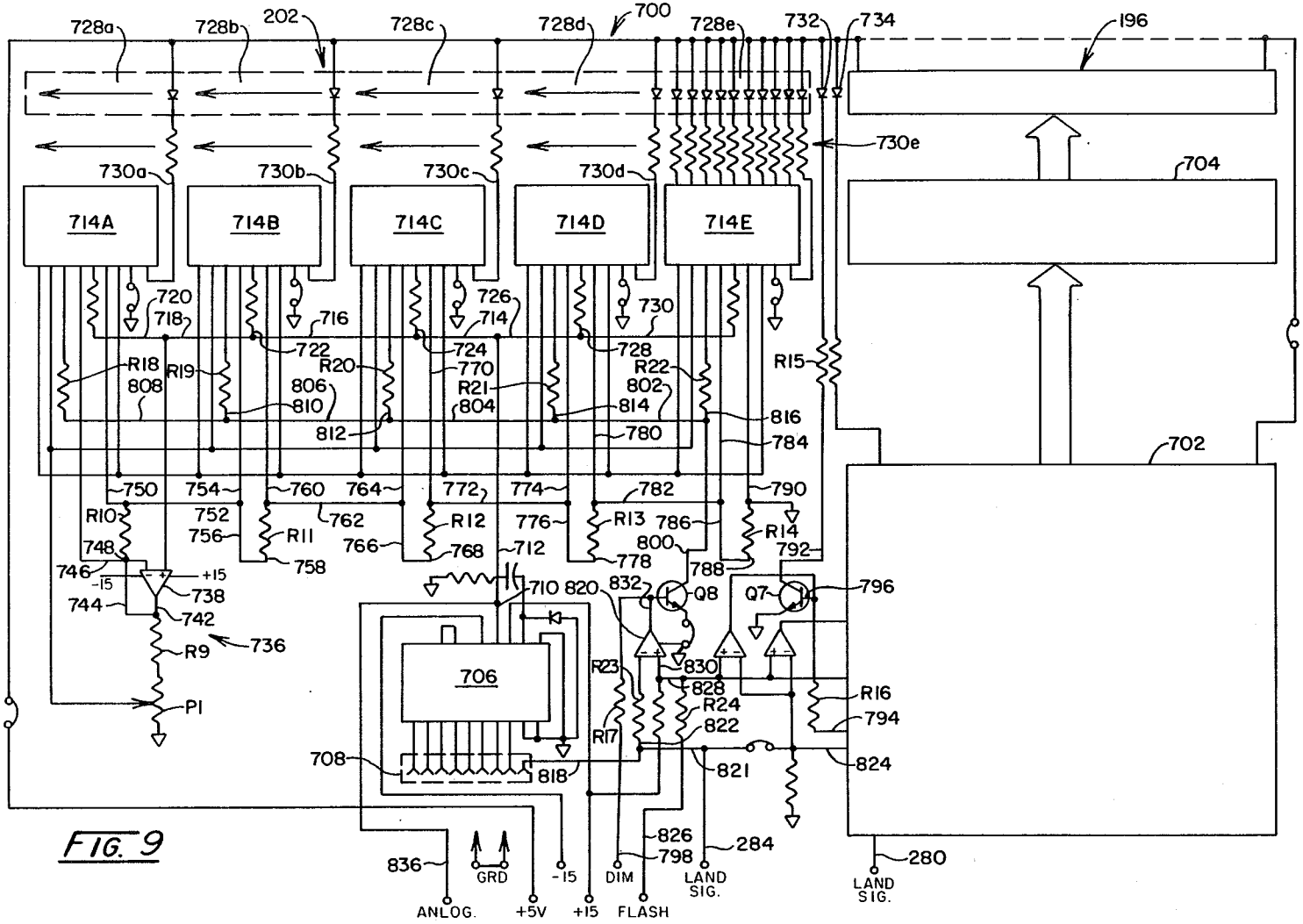
FIG. 9 is an electrical schematic diagram of the analog signal treatment for the bar graph display of trolley distance.

FIG. 9 depicts a circuit for a tandem bar meter 700 having a first, graphical, display indicating the distance between the trolley 16 and the supply ship 12, represented at block 202 in FIG. 5A and reproduced in FIG. 9, and a second, graphical, display indicating the distance between the trolley 16 and the receiver ship 14, represented at block 196 in FIG. 5A and also reproduced on FIG. 9. The portion of the circuit of bar meter 700 which refers to the receiver ship distance represented at 196 is identical to the portion of the circuit that refers to the supply ship distance represented at block 202. Consequently, the receiver ship portion 196 is illustrated generally by blocks 702 and 704 and the detailed description will be directed only to that portion 202 of the circuit which relates to the supply ship distance. The 7-bit binary output at 7-line array 596 from the 3½ digit up/down counter circuit shown in FIG. 8 is input to an 8-bit digital-to-analog converter 706 which may be a Signetics type NE5018 device at connector 708. One bit of the converter is connected to ground to reduce the device to a 7-bit converter. The analog output from converter 706 at line 710 is connected to the inputs of 5 linear bar graph drivers 714A through 714E which may be National Semiconductor type LM3914 devices. Output line 710 is connected to driver 714A through lines 712, 714, 716, 718 and 720, to driver 714B through lines 712, 714, 716 and line 722, to driver 714C through lines 712, 714, and 724, to driver 714D through lines 712, 726 and 728 and to driver 714E through lines 712, 726 and 730. Each bar graph driver 714A through 714E has 10 outputs that are connected to the inputs of 10 segments LED displays 728A through 728E, respectively, through 10 line arrays 730A through 730E, respectively. The 110 line arrays are represented by a single line for arrays 730A through 730D.

From the above, it may be seen that the 5 bar graph drivers 714A through 714E are cascaded to drive 50 bar graph segments. Each segment represents a distance of 2 meters. The center of the bar meter 700 contains 2 LEDs 732 and 734 which represent the trolley 16. The distance between the trolley 16 and the supply ship 12 is repesented, graphically, by the number of LED's which are illuminated to the left of LED 732. The bar graph drivers 714A through 714E are adjusted to output voltages proportionally to the 10 segment LED displays 728A through 728E such that one LED to the left of LED 732 will be illuminated sequentially for each 2 meters the trolley 16 moves away from the supply ship 12. A scale adjust circuit 736 including an operational amplifier 738, resistor R9 and potentiometer P1 sets a full-scale voltage from 0 to approximately 7.8125 volts across the 5 bar graph drivers 714A through 714E. This full-scale voltage is applied across a series resistor network which is compromised of resistors R10 through R14 to provide an equal voltage difference between 2 inputs of each driver 714A through 714E. The 7.8125 volts output from operational amplifier 738 at line 742 is applied to one input of driver 714A through lines 744 and 746. This voltage is applied to a second input of driver 714A through line 748 which contains resistor R10 and line 750. This input is at 6.250 volts and is applied to one input of driver 714B through lines 752 and 754. This voltage is applied to line 756 and line 758 which contains resistor R11. Consequently, the voltage which is applied to a second input of driver 714B through line 760 and a first input of driver 714C through lines 762 and 764 is 4.6875 volts. This voltage is applied to line 766 and line 768 which carries resistor R12 which drops the voltage to 3.125 volts. The 3.125 volts is applied to a second input of driver 714C through line 770 and to a first input of driver 714D through lines 772 and 774. That voltage also is applied to line 776 and line 778 which includes resistor R3 which reduces the voltgage to 1.5625 volts. The output voltage of 1.5625 volts is applied to a second input of driver 714D through line 780 and to a first input of driver 714E through lines 782 and 784. Additionally, the voltage is applied to line 786 and line 788 which contains resistor R14. This resistor reduces the voltage applied to a second input of driver 714E at line 790 to zero volts. From this it may be seen that equal voltage differentials of 1.5625 volts are applied across each of the bar graph drivers 714A through 714E. Thus a voltage differential of 0.15625 volts represents a trolley distance of 2 meters and one LED is illuminated for every 0.15625 volts output from digital-to-analog converter 706. Because there are 50 LEDs in the display 728A through 728E, the total distance which may be represented by one side of the bar graph is 100 meters.

The LEDs 732 and 734 which represent the trolley are lighted whenever the control system is energized. One light 732 is shown connected to the collector of a transistor Q7 through line 792 which contains resistor R15. A voltage is applied to the base of transistor Q7 through line 794 which contains resistor R16 and line 796 to energize the device.

The intensity of the bar graph LEDS is controlled by a rotary dimmer control 148 mounted on the control panel 74, illustrated in FIG. 4. This control outputs a variable pulse-width signal to a dimmer input line 798 shown in the tandem bar meter circuit of FIG. 9. This signal is applied to the base of a transistor Q8 through resistor R17. The collector of transistor Q8 at line 800 is connected to the light input control of each bar graph driver 714A through 714E. Line 800 is connected to the light input of driver 714A through lines 802 through 806 and line 808 which contains resistor R18, to the light input of driver 714B through lines 802 through 806 and line 810 which contains resistor R19, to the light input of driver 714C through lines 802 and 804 and line 812 which contains resistor R20, to the light input of driver 714D through line 802 and line 814 which contains resistor R21 and to the light input of driver 714E through line 816 which contains resistor R22. Consequently, the variable pulse-width signal that is input to the base of transistor Q8 determines the ratio of time-on to time-off for the transistor and hence, modulates the light intensity of the 10 segment LEDs 728A through 728D.

It may be recalled that a signal is output from the 3½ digit up/down counter 186 at line 594 shown in FIG. 8 when the trolley is within 8 meters of a ship. Turning again to FIG. 9, this signal is input to the connector 708 of tandem bar meter 700 and output at line 818 to the negative input of an open collector voltage comparator 830 through line 822 and resistor R23. Comparator 820 may be a National Semiconductor type LM339 device. A 2 Hz on/off flash signal is applied to the bar meter circuit at line 826 which is connected to the positive input of voltage comparator 820 through resistor R24 and lines 828 and 830. The voltage applied to the positive input of comparator 820 ranges between 1.5 and 15 volts, whereas the voltage from the landing signal input at the negative input of comparator 820 is at 5 volts. The characteristic of comparator 820 is such that when the voltage at the positive input is greater than the voltage at the negative input, the device is off and the signal output at line 832 is a high inpendance. Conversely, when the voltage at the positive input is less than the voltage at the negative input, the device is on and the signal at the output is a low impedance. From this it may be seen that an alternating low impedance and high impedance signal is applied to the base of transistor Q8. When the signal is at a high impedance, transistor Q8 is activated and current flows through line 800, whereas when the output is in the low impedance state, the base of the transistor is shorted to ground and the device is not conducting. Consequently, the 2 Hz signal input to comparator 820, alternately, turns transistor Q8 on and off to cause the LED displays to flash during the time the trolley 16 is within 8 meters of either ship.

The landing signal or signal which indicates the trolley is within 8 meters of the supply ship 12 at line 818 is conenected through line 821 to line 824 which carries an identical signal when the trolley is within 8 meters of the receiver ship 14. Lines 818 and 824 are connected to an output line 284, also illustrated in FIGS. 5A and 5B. Similarly, a signal representing the trolley 16 as being within 8 meters of the receiver ship 14 is output from tandem bar meter 700 as shown at line 280 in FIGS. 5A and 5B which number also is used in FIG. 9.

The analog signal representing the distance of the trolley 16 from the supply ship 12 at output line 710 of digital-to-analog converter 706 also is applied to output line 836. This line is illustrated in FIGS. 5A and 5B as line 302 for the supply ship distance and as line 298 for the receiver ship distance. As may be seen by referring to FIG. 5A, the digital signals at lines 280 and 284 are applied to the inputs of the auto transfer control function network represented at block 210 and the analog signals which are output at lines 298 and 302 are inputs to the transfer limiter circuit network and the landing limiter circuit network represented at blocks 292 and 294 respectively.

DIGITAL-TO-ANALOG VELOCITY CONVERTER NETWORK

Referring, momentarily, to FIGS. 5A and 5C, it may be seen that the outputs of the cable position-and-velocity sensors 160 and 164 at lines 168 and 176 are inputs to a digital-to-analog velocity converter, represented at block 194. This device outputs a voltage signal Vi at line 204 which represents the velocity of the inhaul winch cable 62 which also is the velocity of the trolley 16 with respect to the supply ship 12, a voltage signal Vo at line 214 which represents the velocity of the outhaul winch cable 64, and a voltage signal (Vo minus Vi divided by 2) at line 216 which represents the velocity of the trolley with respect to the receiver ship 14. The signals, Vi, at line 204, and the quantity Vo minus Vi, divided by 2 at line 216 are inputs to a trolley velocity bar graph input selector, represented at block 206. Depending upon whether the trolley 16 is approaching the supply ship 12 or the receiver ship 14, the appropriate signal will be selected to provide an input to the trolley velocity bar graph network, represented at block 224, to, graphically, depict the speed of the trolley with respect to the ship it is approaching.

Figure 10A:
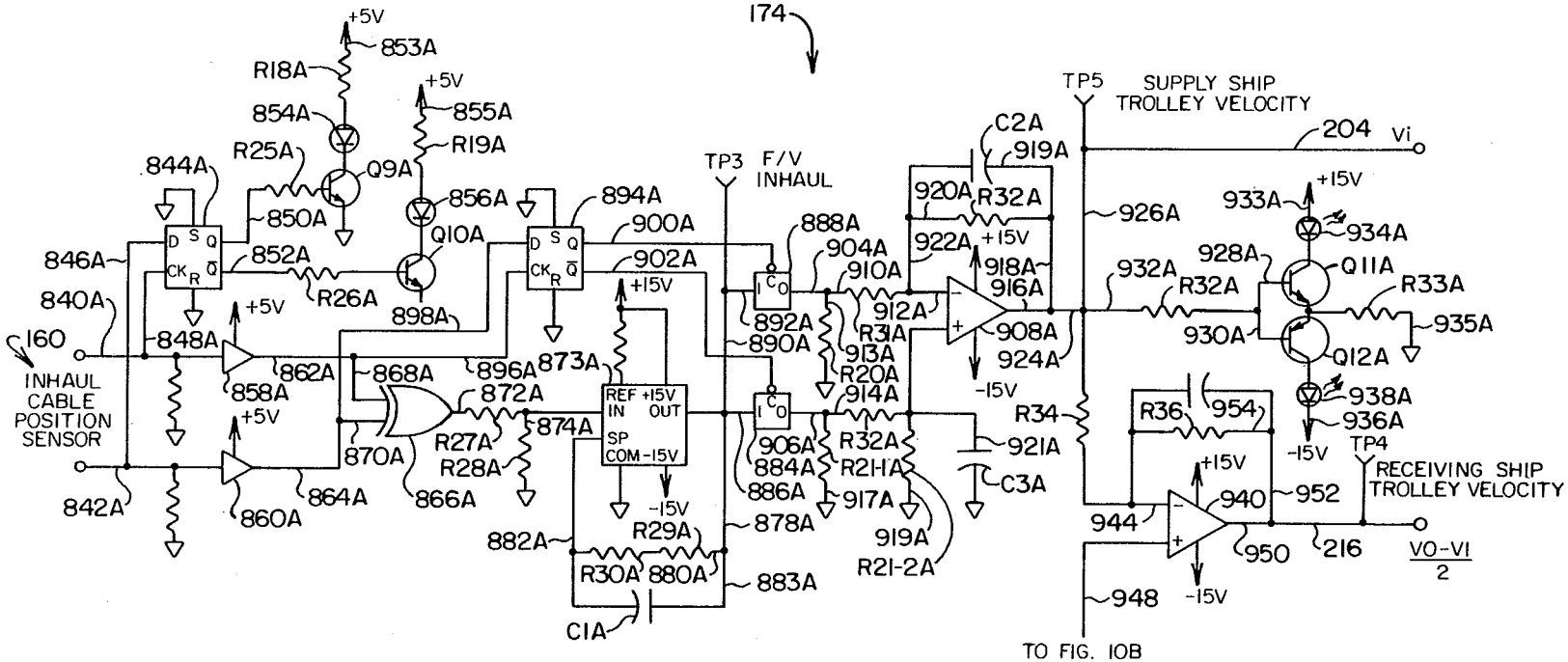
FIGS. 10A and 10B are electrical schematic diagrams of the digital to analog velocity signal conversion network of the present invention.
Figure 10B:
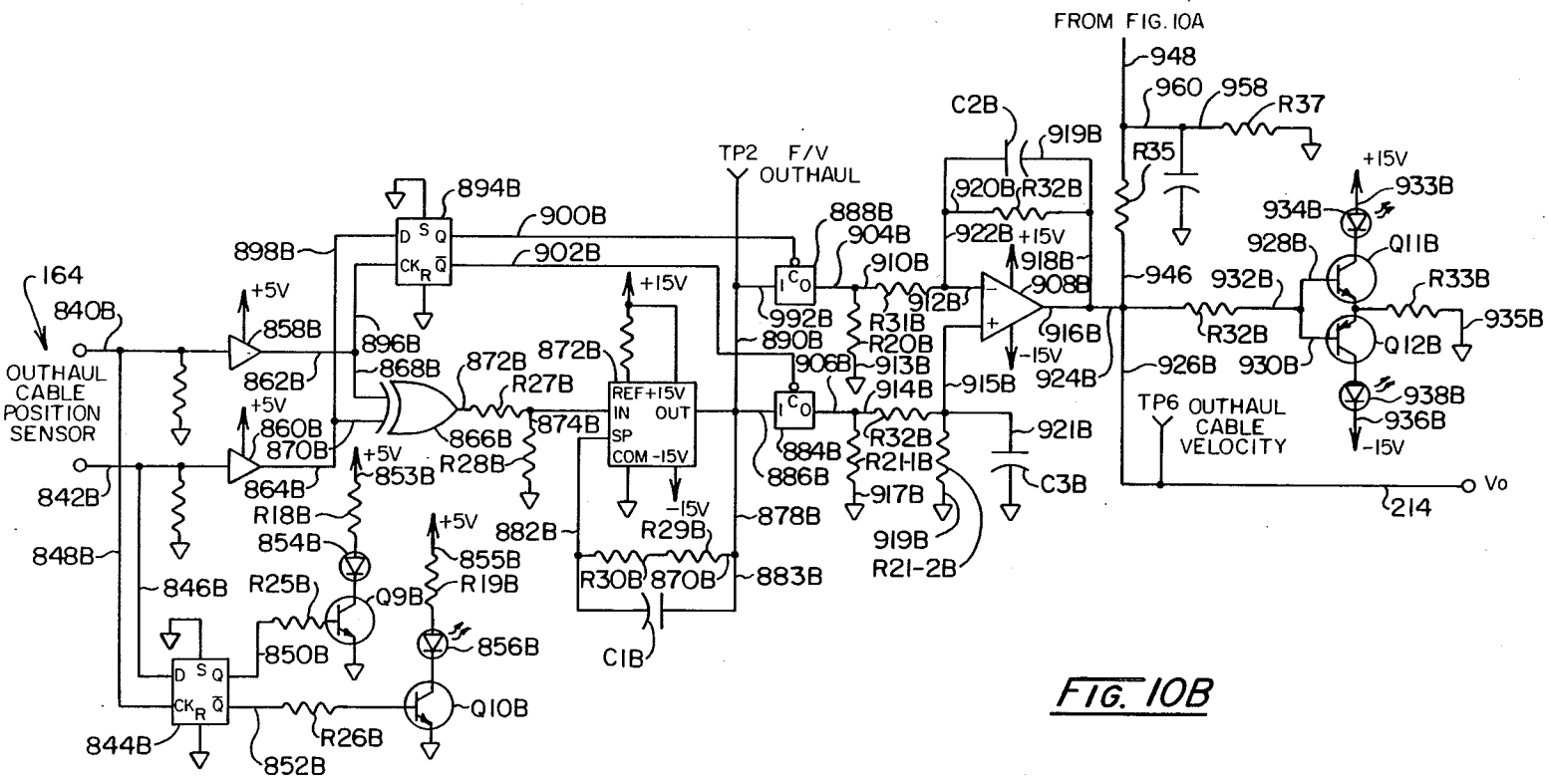

A schematic diagram of the digital-to-analog velocity converter network at block 174 in FIG. 5A is illustrated in FIGS. 10A and 10B and identified by the same numeral. The outputs of the convertor network 174 at lines 204 (Vi), 214 (vo), 216 (Vo−Vi)/2, and the inhaul and outhaul cable position sensors 160 and 164 all are identified by the same numerals as shown on the block diagram in FIGS. 5A and 5C for ease of understanding. Since the circuit processing the outhaul cable velocity signal is identical to the circuit processing the inhaul cable velocity signal, this description will refer to the portion of the circuit that processes the inhaul cable velocity signal. Identical elements in the two circuits will be identified by the same numeral. Those elements in the circuit processing the inhaul cable velocity signal will have the suffix A, whereas those elements in the circuit processing out haul cable velocity signal will carry the suffix B. The inhaul cable position and velocity sensor 160 outputs two five volt square wave signals which are phase shifted 90 degrees at lines 840A and 842A. The direction of rotation of the sensor 160 which is determined by whether cable is paid out or hauled in will determine whether the square wave signal applied to line 840A leads or lags by 90 degrees the signal applied to line 842A.

The signal at line 842A is applied to the data input of a type CD4013D data latch flip flop 844A, through line 846A and the signal at line 840A is applied to the clock input of latch 844A through line 848A. The Q output of latch 844A is connected to the base of a Darlington transistor Q9A which may be a type 2N5308 through line 850A which contains resistor R25A and the $\overline{Q}$ output at line 852A which contains resistor R26A is connected to the base of an identical transistor Q10A. A 5 volt source at line 853A which contains resistor R18A and the light emitting diode (LED) 854A is connected to the collector of transistor Q9A and a 5 volt source at line 855A which contains resistor R19A and LEd 856A is connected to the collector of transistor Q10A. Depending on whether the signal applied to the data input through line 846A leads or lags the signal applied to the clock input through line 848A, one of the transistors Q9A and Q10A will be activated and its associated LED 854A and 856A will be lit. If the signal of the clock input leads the signal at the data input, the $\overline{Q}$ output at line 852A will be at a logic level high, transistor Q10A will be activated and LED 856A will be lit. On the other hand, if the singal at the data input leads the signal at the clock input, that input will be high when the clock is activated, the Q output at line 850A will chnge to a logic level high, transistor Q9A will be activated and turned on LED 854A will be lit.

The signals at lines 840A and 842A are applied to the inputs of voltage level changers 858A and 860A, respectively, which take the 5 volt signals at their inputs and output 15 volt signals at line 862A and 864A, respectively. The signals at lines 862A and 864A are connected to the inputs of a type CD4070 logical XOR gate 866A through lines 868A and 870A, respectively. This device functions to double the frequency of the signal pulses output from the cable position and velocity sensor 160 to provide a smoother output from the frequency-to-voltage converter. The signal output from gate 866A at line 872A which contains resistor R27A is connected to the input of a teledyne philbrick 4702 frequency-to-voltage converter 873A. A voltage divider network consisting of resistor R27A and resistor R28A in line 874A reduce the 15 volt output of exclusive OR gate 866A to a 10 volt input to converter 872A.

The frequency input to converter 873A is converted to a proportional analog DC voltage output. A pair of gain resistors R29A and R300 are connected in feedback fashion from the output of the device at line 876A to a summing point (sp) input through lines 878A, 880A and 882A. These resistors adjust the full scale output of the device to where an input of 2600 cycles which represents a trolley velocity of 400 meters per minute will cause a DC voltage of 10 volts to be output at line 866A. A capacitor C1A is connected in parallel with resistors R29A and R30A through line 883A. Capacitor C1A acts as a filter to reduce output ripple at low frequency input. The output of the frequency to voltage converter 872A at line 876A is directed to a first, type CD4066, bilateral analog gate 884A through line 886A and to a second, identical, bilateral analog gate 888A through linea 890A and 892A.

The outputs of the voltage level changer at lines 862A and 864A are connected to the clock and data inputs of type CD4013 data latch 894A through lines 896A and 898A, respectively. The Q output of latch 894A at line 900A is connected to the control input of analog gate 888A and the Q output at line 902A is connected to the control input of analog gate 884A. It may be observed that the $\overline{Q}$ output will assume a logic level high state, which will activate the control of analog gate 884A, if the voltage signal output from level changer 858A makes a transition from a logic level low to a logic level high before the signal applied to the data input from voltage level changer 860A makes the same transition. On the other hand, the Q output at line 900A of latch 894A will assume a logic level high state, which will activate the control of bilateral gate 888A if the voltage signal output from level changer 860A makes a transition from a logic level low to a logic level high before the voltage level changer 858A makes the same transition. Thus, it may be seen that the analog voltage output from frequency-to-voltage converter 872A will be transferred to the output line 904A of bilateral gate 888A if the cable position and velocity sensor 160 is rotating in one direction and will be transferred to the output line 906A of bilateral gate 884A if the sensor 160 is rotating in the opposite direction.

The output of gate 888A at line 904A is connected to the negative or inverting input of a type 747 operational amplifier 908A through line 910A which contains resistor R31A and line 912A. Line 913A contains resistor R20A and is connected between ground and line 904A such that resistors R31A and R20A form a voltage divider network which adjusts the level of the signal input at line 912A. Similarly, the output of bilaterial gate 884A at line 906A is connected to the negative or inverting input of amplifier 908A through line 914A which contains resistor R32A and line 915A. Line 917A, which contains resistor R21-1A is connected between ground and line 914A and line 919A which contains resistor R21-2A is connected between ground and line 915A. Resistors R32A, R21-1A and R21-2A form a voltage divider network which adjusts the level of the signal applied to the positive input of amplifier 908A. A filter capacitor C3A is connected between the positive input at line 915A and ground through line 921A. The output of operational amplifier 908A at line 916A is connected in feedback fashion through line 918A, line 920A which contains resistor R32A-1 and line 922A to the negative input at line 912A. A high frequency filter capacitor C2A in line 919A is connected in parallel with resistor R32A-1. Amplifier 908A is configured as a unity gain amplifier so that the analog output at line 916A will be the same for equivalent voltage signals applied to non-inverting and inverting inputs. The signals which are applied to the inputs of amplifier 908A will be positive. Consequently, if a positive voltage signal is applied to the negative input at line 912A, a negative voltage will be output at line 916A. If a positive voltage signal is applied to the positive input of amplifier 908A, a positive voltage will be output at line 916A. Hence, it may be seen that the operational amplifier 908A outputs a positive or negative voltage signal depending upon the direction of rotation of the inhaul cable position and velocity sensor 160.

The voltage signal output at line 916A represents the velocity Vi of the inhaul winch cable 62 or the velocity of the trolley 16 with respect to the supply ship 12. The signal at line 916A is connected to output line 204 through lines 924A and 926A. Likewise, the voltage signal output from operational amplifier 908B at line 916B in the circuit which processes the outhaul cable velocity signal represents the velocity Vo of the outhaul cable 64. This signal is connected to the Vo output line 214 through lines 924B and 926B.

The analog voltage signal at line 924A is connected to the base of transistor Q11A at line 928A and to the base of transistor Q12A at line 930A through line 932A which contains resistor R32A-2. Transistor Q11A may be a type 2N3904NPN device, whereas transistor Q12A may be a type 2N3906PNP type device. The emitters of the transistors Q11A and Q12A are tied to ground through line 935A which contains resistor R33A. A 15 volt supply is connected to the collector of resistor Q11A through line 933A which contains LED 934A and a negative 15 volts is applied to the collector of transistor Q12A through line 936A which contains LED 938A. It will be appreciated that transistors Q11A will be activated and its associated LED lit when the analog voltage output at line 924A has a positive polarity and that the opposite transistor Q12A will be activated and its associated LED lit when the voltage output at line 924A has a negative polarity.

In order to obtain an analog voltage representing the velocity of the trolley 16 with respect to the receiver ship 14, which velocity is represented by the the quantity Vo minus Vi divided by 2, the inhaul analog velocity signal at line 924A is applied to the negative input of a type 741 differential amplifier 940 through line 942, resistor R34, and line 944 and the outhaul analog velocity signal at line 924B is connected to the positive input of amplifier 940 through line 946, resistor R35 and line 948. The output of differential amplifier 940 at line 950 is connected in feedback fashion to the inverting input at line 944 through line 952, line 954 which contains resistor R36 and line 956. The analog velocity signal at line 924A is applied to negative input of differential amplifier 940 with a gain of minus one-half because resistor R34 has twice the value of resistor R36. Likewise, a voltage divider network which includes resistor R35 and line 946, a resistor R37 in line 958 which is connected to line 946 through line 960 causes the analog voltage output at line 924B to be input to the positive input of differential amplifier 940 with a gain of one-half. Therefore, amplifier 940 outputs a signal at line 950 which represents one-half the difference between the velocity of the outhaul winch cable and the velocity of the inhaul winch cable which signal is applied to output line 216 and which signal represents the velocity of trolley 16 with respect to receiver ship 14.

TROLLEY VELOCITY BAR GRAPH

Figure 11A:
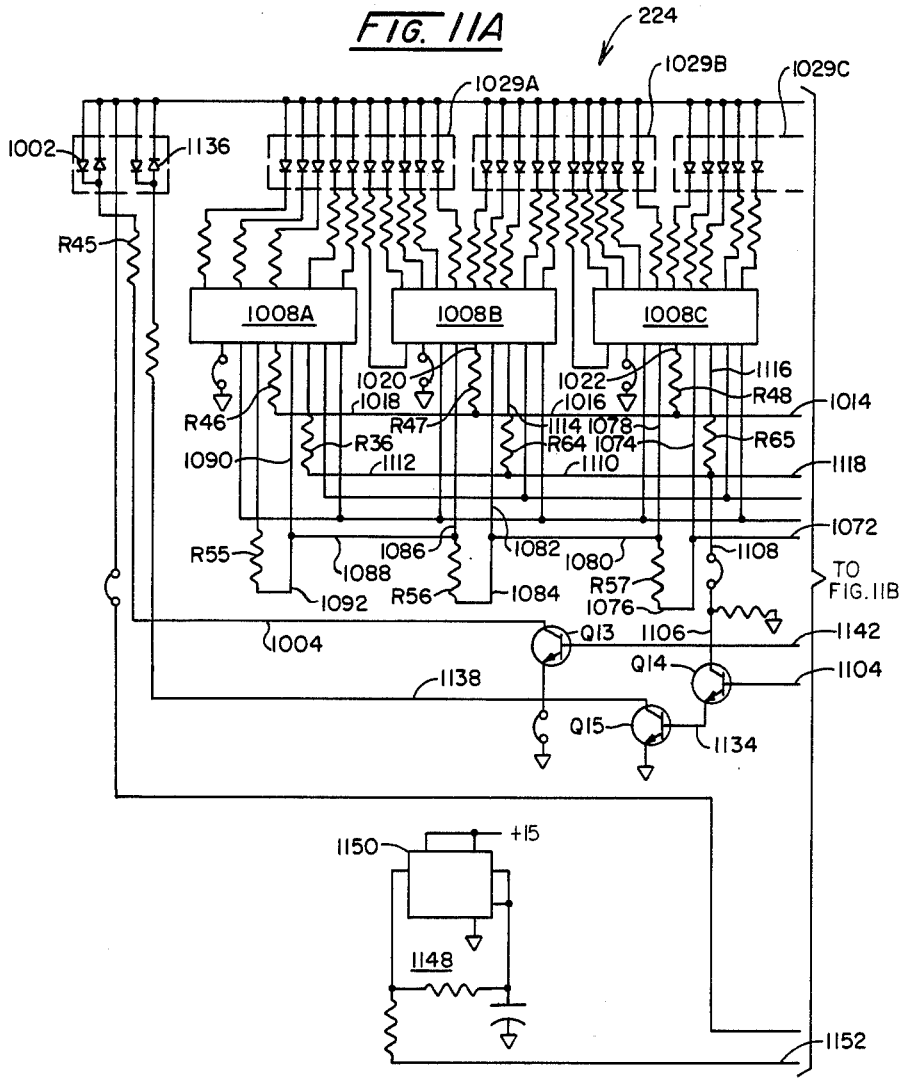
FIGS. 11A and 11B are electrical schematic diagrams of the analog signal treatment for the bar graph display of trolley velocity.
Figure 11B:
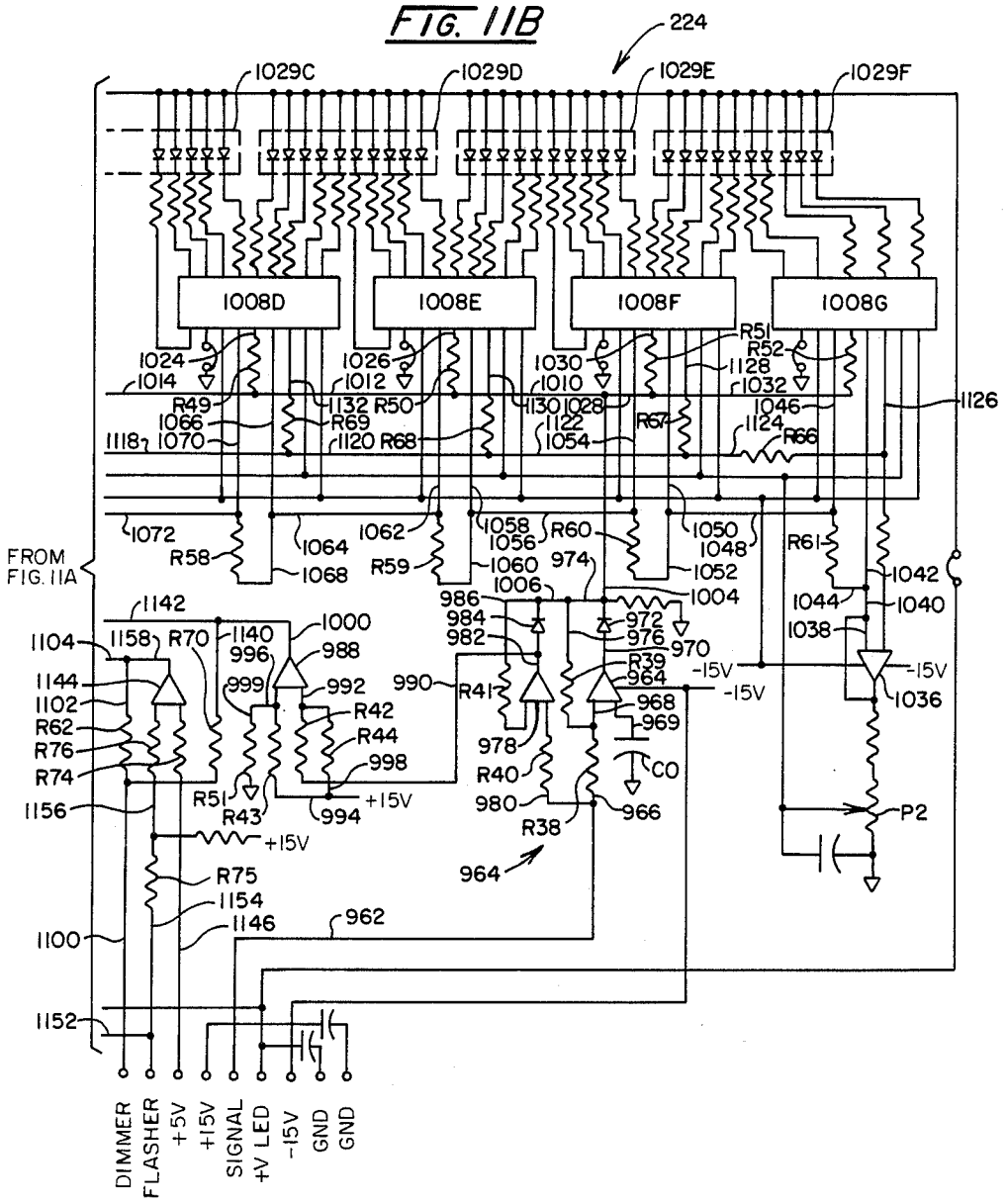

A schematic diagram of the trolley velocity bar graph network represented at block 224 in FIG. 5A may be seen by referring to FIGS. 11A and 11B wherein it is identified, generally, by the same numeral. It maybe recalled that the signal outputs from the digital-to-analog velocity converter 174 at lines 204 and 216 have a maximum value of plus or minus 10 volts which represents the trolley velocity of 400 meters per minute. Accordingly, velocity bar meter network 224 is configured to provide a display of trolley velocity having a range of 0 to 400 meters per minute. It may be recalled that the network 224 is a 6 inch bar meter that displays velocities between 0 and 50 meters per minute over a distance of 2½ inches and displays velocities between 50 and 400 meters per minute over a distance of 3½ inches. The velocity display between 0 and 50 meters per minute is in 2 meter per minute increments whereas the display between 50 and 400 meters per minute is in increments of 10 meters per minute. Consequently, the resolution of the bar graph between 0 and 50 meters per minute is 5 times the resolution of the bar graph between 50 and 400 meters per minute. The purpose of having a high resolution at low speeds is to provide a more accurate readout of trolley velocity during the critical landing operation which occurs at low speeds.

One of the analog voltage signal outputs from the digital-to-analog velocity converter network 174 at lines 204 and 216 representing the velocity of the trolley with respect to the supply ship 12, (Vi), or representing the velocity of the trolley with respect to the receiver ship 14, (Vo−Vi)/2 is an input to the velocity bar meter network 224 at line 962, FIG. 11B. The signal is applied to the negative input of a type 747 unity gain operational amplifier through line 966 which contains resistor R38 and line 968. The positive input is connected to ground through line 969. If the voltage signal input to amplifier 964 has a negative value, a positive voltage signal will be output at lines 970 through diode 972. The output of amplifier 964 at line 970 is connected in feedback fashion to the negative input at line 968 through line 974 and line 976 which contains resistor R39. The negative signal at line 962 also is applied to the positive input of an identical operational amplifier 978 through line 980 which contains resistor R40. This negative input signal will be reflected at the output of amplifier 978 at line 982 but will be blocked by diode 984. Output line 982 is fed back to the negative input of amplifier 978 through line 986 which contains resistor R41. The negative signal output at line 982 will be applied to the negative input of type LM339 open collector voltgage comparator 988 through line 990 which contains resistor R42 and line 992. A positive voltage is applied to the positive input of comparator 988 through line 994 which contains resistor R43 and line 996. This same positive voltage is applied to the negative input of comparator 988 through line 998 which contains resistor R44. Line 999 connects the positive input at line 996 to ground through resistor R51. The negative voltage applied to the negative input of comparator 988 through line 990 will cause that input to be at a lower voltage than the positive input. This will cause the device to be turned off. Consequently, the ouput at line 1000 that is connected to the base of a transistor Q13 through line 1142 will be in a high impedance state. The collector of transistor Q13 is connected to a negative direction indicator light 1002 through line 1004 which contains resistor R45. When the output of comparator 988 is at the high impedance state, transistor Q13 is activated and the negative direction light 1002 is lit. It should be noted that when the negative direction indicator light 1002 is lit, it is an indication that the ship the trolley is approaching is moving away from the trolley at a greater speed than the trolley is approaching it This condition may occur in rough seas when the ship is rolling heavily.

A positive voltage signal at line 962 will be applied to the negative input of amplifier 964 which will be output as a negative signal at line 970 and will be blocked by diode 972. Application of the positive voltage signal to the positive input of amplifier 978 will cause a positive signal to be ouput at line 982 which will pass through diode 984. The positive voltage signal also will be applied to the negative input of comparator 988 which will turn the device on, cause the output at line 1000 to enter a low impedance state and cause transistor Q13 to be de-energized. Accordingly, the negative direction indicator light 1002 will not be lit when a positive signal is applied to line 962. From the above, it may be observed that the output of either amplifier 964 at line 970 or amplifier 978 at line 982 will be positive regardless of the polarity of the signal at line 962.

A positive signal output at line 982 from amplifier 978 will be applied to line 1004 through lines 1006 and 974 and a positive signal output at line 970 from amplifier 964 will be applied directly to line 1004. This positive voltage signal at line 1004 will be applied to one input of each 7 type LM3914 linear analog to bar graph driver 1008A through 1008G. These devices may be manufactured by National Semiconductor Company. It maybe recognized that these drivers are identical to those which drive the LED's for the distance bar graph, represented at blocks 202 and 196 in FIG. 5A. Line 1004 is connected to one input of driver 1008A through lines 1010 through 1016 and line 1018 which contains resistor R46, to one input of driver 1008B through lines 1010 through 1016 and line 1020 which contains resistor R47, to one input of driver 1008C through lines 1010 through 1014 and line 1022 which contains resistor R48, to one input of driver 1008D through lines 1010 and 1012 and line 1024 which carries resistor R49, to one input of driver 1008E through line 1010 and line 1026 which contains resistor R50, to one input of driver 1008F through line 1028 and line 1030 which contains resistor R51, and to one input of driver 1008G through lines 1028 and line 1032 which contains resistor R52. The voltage output by driver 1008A through 1008G is proportional to the voltage input to them and the drivers are cascaded to drive a 6-inch bar graph display of trolley velocity. Each of the drivers 1008A through 1008G has 10 outputs, and therefore is capable of illuminating 10 LED's in the bar graph. The 6-inch bar graph utilizes 60 LED's. However, 7 bar graph drivers are required because the first driver 1008A and the last driver 1008G are used to control only 5 LED's in a 10 LED segment. The reason for this is that velocities between 0 and 50 meters per minute are indicated in increments of 2 meters per minute which requires 25 LED's and velocities between 50 and 400 meters per minute are indicated in increments of 10 meters per minute which requires 35 LED's Because each bar graph driver can be calibrated either in terms of 2 meters per minute or 10 meters per minute but not both, 3 bar graph driver 1008A through 1008C are required to drive the 25 LED's which indicate velocities between 0 and 50 meters per mintue and 4 bar graph drivers, 1008D through 1008G are required to drive the 35 LED's which indicate velocities between 50 and 400 meters per minute. The first bar graph driver 1008A drives 5 segments of a 10 segment LED display 1029A. Likewise, bar graph driver 1008B drives 5 segments of display 1029A and 5 segments of display 1029B. Five segments of display 1029B and 5 segments of display 1029C are driven by drive 1008C. Thus, it may be seen that drivers 1008A–1008C control the first 25 LED segments which indicate velocity between 0 and 50 meters per minute. Bar graph driver 1008D drives 5 segments of display 1029C and 5 segments of display 1029D. Driver 1008E drives 5 segments of display 1029D and 5 segments of display 1029E. Similarly, bar graph driver 1008F drives 5 segments of display 1029E and 5 segments of dipslay 1029F. The remaining 5 segments of display 1029F are driven by driver 1008G. From the above it may be observed that drivers 1008D–1008G control the 35 segments which indicate velocities between 50 and 400 meters per minute.

A full-scale adjust circuit 1034 and a potentiometer P2 adjust the full scale output for drivers 1008A through 1008G. This adjust circuit functions in the same manner as the full-scale adjust circuit 736 for the distance bar graph indicated at 202 in FIG. 9. The full-scale reference voltage preferably is between 0 and 7.8125 volts. This reference voltage is applied across a series resistor network which is compromised of resistors R55 through R61. The voltgage set by the adjust circuit 1034 is applied to one input of driver 1008G through lines 1038 through 1042 and to a second input of driver 1008G through lines 1038 and 1040, line 1044 which contains resistor R61 and line 1046. Resistor R61 reduces the voltage at line 1046 which also is applied to one input of driver 1008F through lines 1048 and 1050. This voltage at line 1048 is applied to a second input of driver 1008F through line 1052 which contains resistor R60 and line 1054. Resistor R60 further reduces the voltage at line 1054. The voltage at line 1054 is applied to one input of driver 1008E through lines 1056 and 1058. This voltage is applied to a second input of driver 1008E through line 1060 which contains resistor R59 and line 1062 and to one input of driver 1008D through lines 1064 and 1066. Line 1064 is connected to the second input of driver 1008D through line 1068 which carries resistor R58 and line 1070. Line 1070 is connected to one input of driver 1008C through lines 1072 and 1074. The voltage at line 1072 is applied to a second input of driver 1008C through line 1076 which contains resistor R57 and line 1078. Resistor R57 reduces the voltage at line 1078 which also is applied to one input of driver 1008B through lines 1080 and 1082. Line 1080 is conected to the second input of driver 1008B through line 1084 having resistor R56 to thereby lower the voltage that is applied to the second input of driver 1008B through line 1086 and to one input of driver 1008A through lines 1088 and 1090. Lastly, the voltage at line 1088 is applied to line 1092 which contains resistor R55 and which is connected to a second input of driver 1008A. Resistor R55 provides a voltage difference between the two inputs of driver 1008A. It should be noted that resistors R55, R56 and R57 are sized to provide appropriate voltages across the scale inputs of drivers 1008A through 1008C to cause the devices to output voltages which will cause the first 25 LED's to change state for trolley velocity changes in increments of 2 meters per minute and that resistors R58 through R61 are selected to provide the appropriate voltages across the scale inputs of drivers 1008D through 1008G which will cause the devices to output voltages which will cause the 35 LED's to change state for trolley velocity changes in increments of 10 meters per minute.

The intensity of the 10 segment LED displays 1029A–1029F is set by a pulse width dimmer control input signal which is set by the dimmer control 148 for bar graphs on panel 74. This is the same control which adjusts the intensity of the LED displays in the distance bar graph. The dimmer control input signal is applied to line 1100 which is connected to the base of transistor Q14 through line 1102 which contains resistor R62 and line 1104. The collector of transistor Q14 at line 1106 is connected to the light input control of each bar graph driver 1008A through 1008G. Line 1106 is connected to the light input control of driver 1008A through lines 1108 and 1110 and line 1112 which contains resistor R63, to the light input of driver 1008B through line 1110 and line 1114 which contains resistor R64, to the light input control of driver 1008C through line 1116 which carries resistor R65, to the light input control of driver 1008G through lines 1118 through 1122, line 1124 which carries resistor R66 and line 1126, to the light input control of driver 1008F through lines 1118 through 1122 and line 1128 which carries resistor R67, to the light input control of driver 1008E through lines 1118 and 1120 and line 1130 which carries resistor R68 and to the light input of driver 1008D through line 1118 and line 1132 which contains resistor R69. The emitter of transistor Q14 is connected to the base of transistor Q15 through line 1134. The collector of transistor Q15 is connected to a 0 distance light through line 1138. This light remains on at all times as a reference signal. Consequently, the pulse width modulation dimmer control signal at line 1100 which controls the length of time transistor Q14 is energized, sets the intensity of the velocity display LED's 1029A-1029F and the intensity of the 0 distance light 1136. The dimmer control signal also is applied to the base of transistor Q13 which activates the negative direction indicator light 1002 through line 1140, resistor R70 and line 1142. The collector of transistor Q13 is connected to light 1002 through line 1004 and resistor R45. Consequently, the intensity of the negative direction indictor light 102 also is set by the dimmer control input signal.

When the trolley 16 is within 8 meters of either the supply ship 12 or the receiver ship 14, the velocity bar graph display is made to flash on and off in the same manner as the distance bar graph display 196 and 202 is made to flash on and off under the same conditions. When the trolley is within 8 meters of a ship a signal having a magnitude of approximately 5 volts is applied to the negative input of a National Semiconductor type LM339 open collector output voltage comparator 1144 through line 1146 containing resistor R74. An oscillator circuit 1148 containing a type NE555 multivibrator provides a two Hz square wave output having a magnitude of between 1.5 and 15 volts to the non-inverting or positive input of comparator 1144 through line 1152, line 1154 containing resistor R75 and line 1156 having resistor R76. As discussed previously, when the voltage applied to the positive input of comparator 1144 is below the 5 volt level of the voltage applied to the negative input, the output of the device at 1158 will have a low impedance which will short the dimmer input signal at line 1102 to ground and cause transistors Q13 through Q15 to turn off. When the magnitude of the voltage at the positive input of comparator 1144 exceeds the voltage at the negative input, the output of the device at line 1158 will assume a high impedance state which will enable the dimmer input signal at line 1100 to activate transistors Q13 through Q15 and cause the displays to be illuminated. The oscillator circuit 1148 also provides the two Hz flash signal which is input at line 826 to the tandem bar meter 700 described in FIG. 9.

AUTOMATIC TRANSFER CONTROL NETWORK

In conjunction with the description of the block diagram illustration of the present control system in FIGS. 5A-5C, it may be recalled that an automatic transfer control network represented at block 210 may be invoked which will automatically control the movement of the trolley 16 from one ship to another. This network will increase the velocity of the trolley 16 at a constant rate with respect to distance to an initial set speed until the trolley 16 reaches a distance of 8 meters from the ship, thereafter further increase the velocity of the trolley at a constant rate with respect to distance to a set transfer speed, thereafter decrease the velocity of the trolley at a constant rate with respect to distance from the set transfer speed to a set landing speed and finally, descrease the velocity of the trolley at a constant rate with respect to distance from the landing speed to a terminal speed. The rate of change of velocity is controlled to ensure that neither ship 12 and 14 will bump the trolley 16, that the trolley load will not impose large shocks on the transfer system, and that the trolly load will not begin to swing. Turning briefly to FIG. 4, the automatic transfer control network 210 may be activated at control panel 74 by moving the operation mode switch 100 to the "automatic" setting and by moving the direction switch 130 to the setting indication the desired direction of trolley movement. Additionally, the maximum speed of the trolley 16 in the transfer mode may be set by adjusting rotary dial 124 and the maximum speed of the trolley 16 in the landing mode may be set by adjusting the rotary dial 126.

Figure 12A:
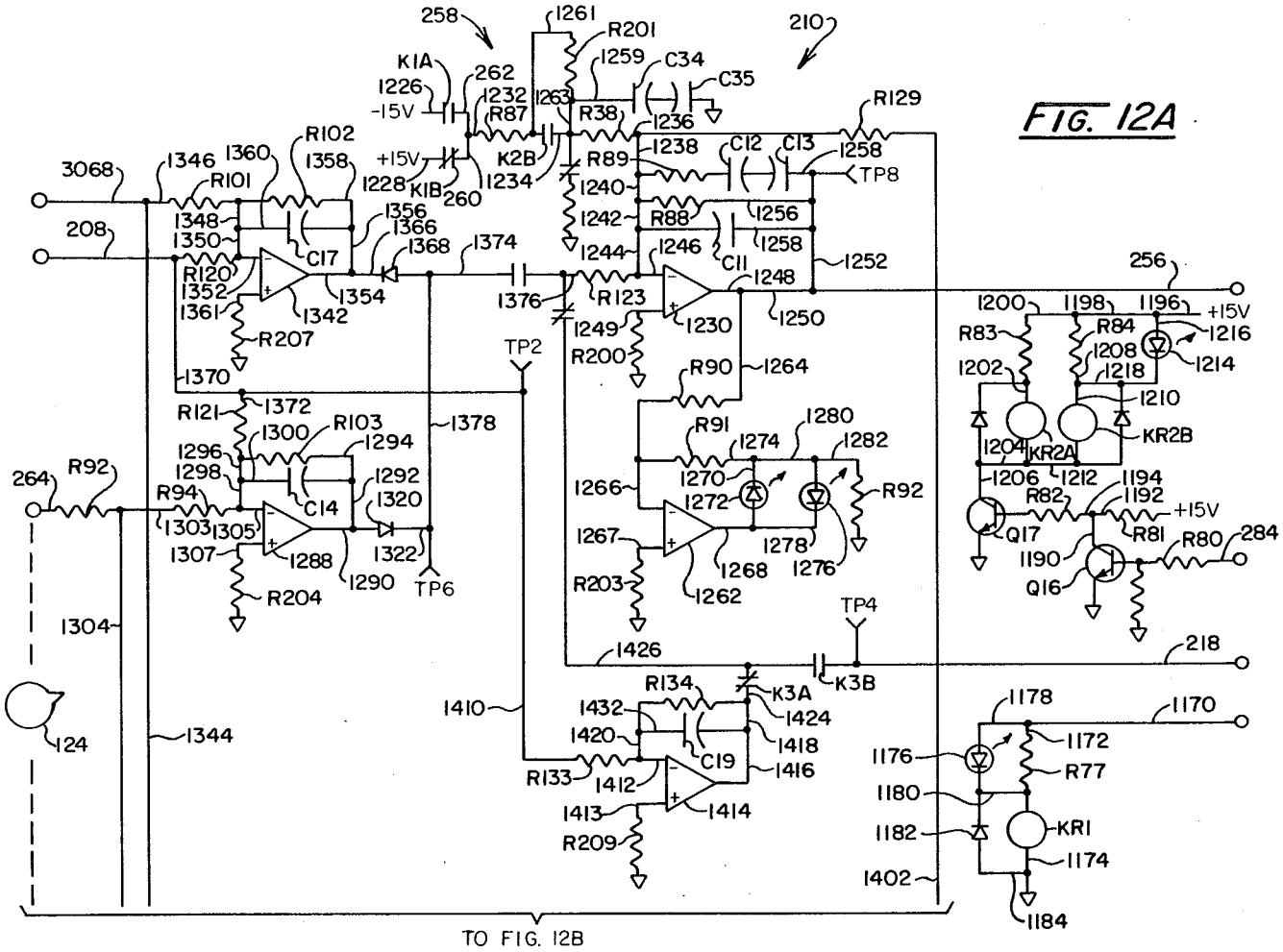
FIGS. 12A and 12B are electrical schematic diagrams of the analog signal treatment for the automatic transfer system control of the present invention.
Figure 12B:
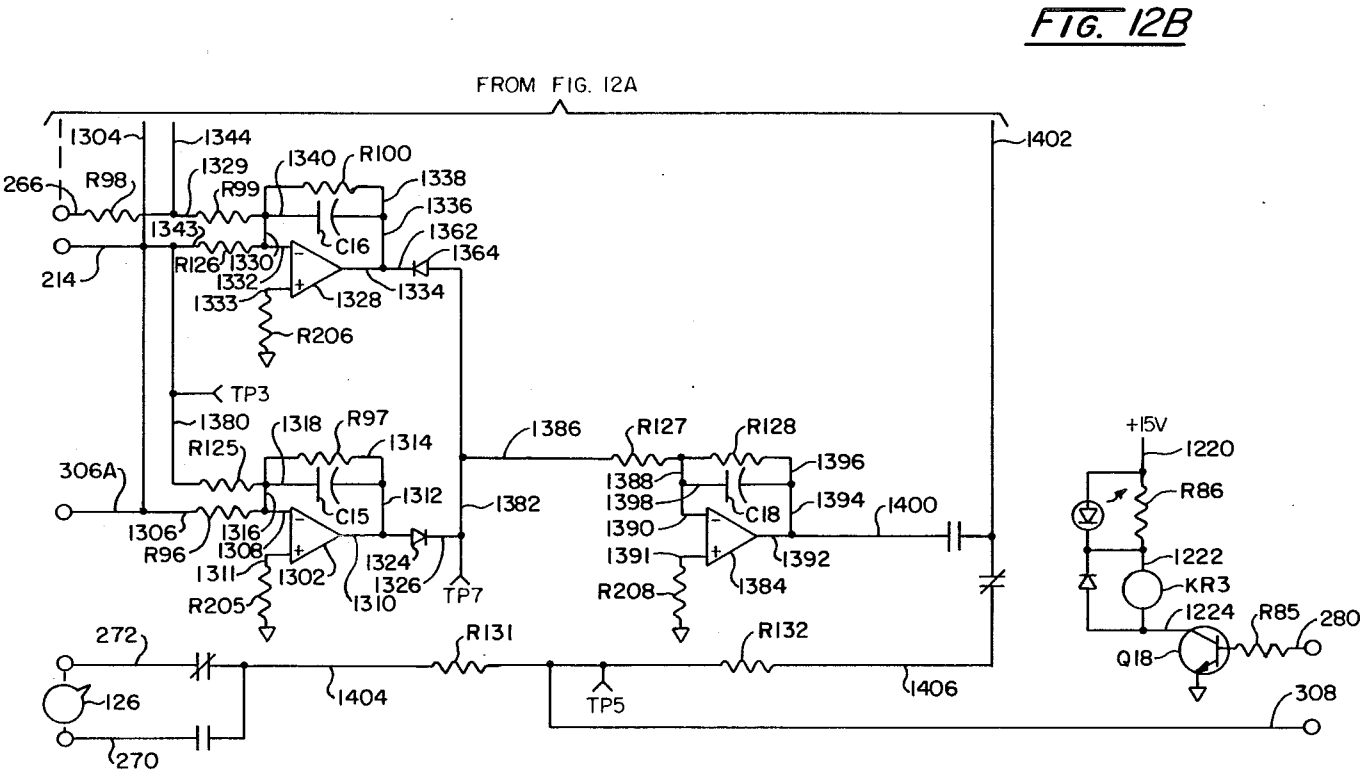

Referring to FIGS. 12A and 12B, a schematic diagram of the automatic transfer control network represented at block 210 in FIG. 5A is identified by that same num eral. This diagram contains a number of relays or solenoid driven contacts. These contacts are shown in a de-energized condition. In other words, when the solenoid controlling these contact is energized, the contacts change state. The contacts identified by the number 1 following the letter K are direction contacts and the direction relay KR1 for these contacts is energized when the selected direction of transfer is toward the receiver ship 14. When the switch 130 is set at the "transfer to receiving ship" position, a 15 volt signal is input at line 1170. This signal is applied to contact relay KR1 through line 1172 which contains resistor R77 and line 1174. This signal also is applied to a light emitting diode 1176 through lines 1178 and 1180. LED 1176 is illuminated when relay KR1 is energized. A diode 1182 is connected across relay KR1 througnh lines 1184 and 1180 and functions to limit the inductive pulses generated when relay KR1 is de-energized.

Contacts K2A and K2B are mode contacts. These contacts are energized when the trolley is in the "transfer" mode and are de-energized when the trolley 16 is in the "landing" mode, that is, within 8 meters of either ship 12 and 14. when the trolley 16 is within 8 meters of either ship 12 and 14, a 15 volt signal is applied to line 284 from a landing logic selector network represented at block 282 shown in FIGS. 5A and 5B. Line 284 is shown again in FIG. 12A. This signal is input to the base of a transistor Q16 thorugh resistor R80. The collector of transistor Q16 is connected at line 1190 to a line 1192 which carries a 15 volt input through resistor R81 and line 1194 which contains resistor R82 to the base of transistor Q17. Consequently, when transistor Q16 is energized, the 15 volt input the base of transistor Q17 is shorted to ground and that transistor is de-energized. A 15 volt supply is connected to the collector of transistor Q17 through lines 1196 and 1198, line 1200 which contains resistor R83, line 1202 which contains contact relay KR2A, and lines 1204 and 1206. Additionally, the 15 volt supply is applied to a contact relay KR2B through lines 1196 and 1198, line 1208 containing resistor R84 and line 1210. When transistor Q17 has been de-energized, contact relays KR2A and KR2B likewise are de-energized. An LED 1214 in line 1216 connected between line 1196 and line 1218 is illuminated when the contact relays KR2A and KR2B are energized.

Contacts identified by the numeral 3 following the letter K are receiver ship landing and departure contacts. The relay KR3 for these contacts is enegized when the trolley is within 8 meters of the receiver ship 14. When the trolley is at this location, a 15 volt signal is ouput from the digital to analog converter network represented at block 194 and applied to line 280 illustrated in FIGS. 5A and 5B and again reproduced on the circuit shown in FIG. 12B. This signal is applied to the base of transistor Q18 through resistor R85 to thereby activate the device. A 15 volt supply is connected to the collector of transistor Q18 through resistor R86 and line 1220, contact relay KR3 in line 1222 and line 1224. Consequently, relay KR3 becomes energized when transistor Q18 has been activated.

Referring momentarily to FIGS. 5A–5C, it may be recalled that the automaitc transfer control network 210 operates to output a tension commmand signal at line 256 which sets a desired trolley speed and direction. This signal alters an initial preset cable tension control signal which has been output to the inhaul and outhaul winch controls 102 and 104 by an initial tension control network at 250. An initial velocity control signal network illustrated at block 258 and indicated in FIG. 12A by the same numeral provides an input signal to the automatic transfer control network 210 which presents the maximum velocity of the inhaul and outhaul winch cables 62 and 64 in the transfer mode. The initial velocity control signal is activated by the system operator when he actuates the transfer direction switch 130 on panel 74 illustrated in FIG. 4. This switch sets the condition of direction contacts K1. Depending upon whether contact relay KR1 is energized or de-energized, a negative 15 volt signal at line 1226 which contains a normally open contact K1A or a plus 15 volt signal at line 1228 which contains a normally closed contact K1B will be applied to the negative input of a type CD747 operational amplifier 1230 through line 1232 which contains resistor R87, line 1234 which contains normally open contact K2B, resistor R88 in line 1236 and lines 1238 through 1246. A negative 15 volts is applied to the input of operational amplifier 1230 if the direction of trolley movement is towards the receiver ship 14 and a plus 15 volts is applied to the negative input if the direction of trolley movement is towards the supply ship. The 15 volt signals are preset and are not adjustable by an operator.

Operational amplifier 1230 is a tension error or summing amplifier and its output at lines 1248, 1250 and 256 provides an intitial tension bias command to a push/pull tension amplifier network in the initial tension control network 250 to be described hereinbelow. Hence, when the control system is set to "automatic" and the trolley 16 is in the transfer mode it will move at the speed set by the inital velocity control network 258 until the signal applied to the negative input of summing amplifier 1230 is modified.

It may be observed that the output of amplifier 1230 at line 1250 is connected in feedbsck fashion to the negative input thereof through line 1252 and line 1254 which contains capacitor C11, line 1256 having resistor R88 and line 1258 having serially arranged capacitors C12 and C13 and resistor R89. This arrangement of capacitors and resistors provides a level adjustment for amplifier 1230. The positive input of amplifier 1230 is referenced to ground through line 1249 containing resistor R200. A resistor R201 that is connected in parallel with normally open contact K2B through lines 1261 and 1263 and a pair of serially connected capacitors C34 and C35 in line 1259 connected between ground and line 1263 cooperate to set the rate of response of the initial velocity control signal that is applied to the negative inputs of amplifier 1230.

The output of the summing amplifier 1230 at line 1248 is connected to the negative input of a type CD747 operational amplifier 1262 through resistor R90 in line 1264 and line 1266. Line 1267 containing resistor R203 references the positive input to ground. The ouput of amplifier 1262 at line 1268 is connected in feedback fashion to the negative input thereof through line 1270 which contains LED 1272 and line 1274 which carries resistor R91 and is connected to line 1266. An LED 1276 in line 1278 is connected in a reverse direction in parallel with LED 1272 through lines 1278 and 1280. Line 1280 is tied to ground through line 1282 which contains resistor R92. Depending upon whether the signal output from summing amplifier 1230 at 1248 has a positive or negative polarity, one of the diodes 1272 and 1276 will be lit to indicate the magnitude and direction of the tension command signal output at line 256.

The initial velocity command signal applied to the negative input of summing amplifier 1230 may be modified by the operator by rotating rotary dial 124 which provides a maximum transfer velocity command signal that sets the maximum limits for the pay out and haul in cable velocities for the inhaul and outhaul winches 42 and 46. The maximum transfer velocity command signals are input at lines 264 and 266 which numbers also are utilized in conjuction with the block diagram in FIG. 5A. The positive input command signal at line 264 sets the maximum pay out cable velocity for winches 42 and 46 and the negative command signal input at line 266 sets the maximum haul in cable velocities for winches 42 and 46. The positive maximum velocity command signal at line 264 is applied to the negative input of a type CD747 operational amplifier 1288 through resistor R93, line 1303 containing resistor R94, and line 1305 as an inital bias to that amplifier. Line 1307 containing resistor R204 references the positive input to ground. The output of operational amplifier 1288 at line 1290 is connected in feedback fashion to the negative input thereof through line 1292, resistor R103 in line 1294, and lines 1296, 1298 and 1305. A filter capacitor C14 in line 1300 is connected between lines 1292 and 1298 in parallel with resistor R103. The positive input command signal also is applied to the negative input of an identical operational amplifier 1302 through resistor R93 line 1304, resistor R96 in line 1306 and line 1308 as an initial bias to that amplifier. The output of amplifier 1302 at line 1310 is fed back to the negative input thereof through line 1312, line 1314 which contains resistor R97, and lines 1316 and 1308. A filter capacitor C15 is connected in parallel with resistor R97 through line 1318 which is connected between lines 1312 and 1316. The positive input of amplifier 1302 is tied to ground through resistor R205 and line 1311. The positive signal that is input to amplifier 1288 at line 1305 is reflected as a negative output at lines 1290 and 1322 which reverse biases a diode 1320 in line 1322. Similarly, the positive signal input to operational amplifier 1302 becomes a negative signal at the output at lines 1310 and 1326 which reverse biases diode 1324 therein. Thus no correction signal is output through diodes 1320 and 1324 to alter the intial or represent velocity control signal.

The negative maximum haul in velocity signal at line 266 is applied to the negative input of a type CD747 operational amplifier 1328 through resistor R98 and R99 and lines 1329, 1330 and 1332. The ouput of amplifier 1328 at line 1334 is connected in feedback fashion to the negative input thereof through line 1336, resistor R100 in line 1338, and lines 1330 and 1332. A filler capacitor C16 in line 1340 is connected in parallel with resistor R100 across lines 1336 and 1330. Line 1333 containing resistor R206 references the positive input to ground. The negative maximum haul in velocity command signal at line 268 also is connected to the negative input of operational amplifier 1342 through resistor R98, line 1344, line 1346 which contains resistor R101 and lines 1348, 1350 and 1352. The output of amplifier 1342 at line 1354 is fed back to the negative input thereof through line 1356, resistor R102 in line 1358, and lines 1348, 1350 and 1352. A filler capacitor C7 line 1360 is connected in parallel across resistor R102 by connection with lines 1356 and 1350. The positive input of amplifier 1342 is tied to ground by line 1361 containing resistor R207. The negative signal applied to the input of operational amplifier 1328 is output to lines 1334 and 1362 which contain diode 1364 as a positive signal which reverse biases the diode. Likewise the negative signal applied to the negative input of amplifier 1342 is output at line 1354 and line 1366 which contains diode 1368 as a positive signal which reverse biases that diode. Consequently, no correction signal is output through diodes 1364 and 1368 to the tension error amplifier 1230.

A cable velocity feedback signal Vi from the inhaul winch 42 is input at line 208 and is applied to the negative input of operational amplifier 1342 through resistor R120 and line 1352 and is applied to the negative input of operational amplifier 1288 through line 1370, resistor R121 in line 1372, and lines 1296, 1298 and 1305. Velocity feedback signal Vi is positive when the inhaul winch 42 is hauling in cable and is minus when the inhaul winch 42 is paying out cable. If the inhaul velocity feedback signal Vi is positive and the positive input is applied through resistor R120 to the negative input of amplifier 1342, when the value of the positive input exceeds the value of the negative input from the haul in transfer velocity command, the output of amplifier 1342 at lines 1354 and 1366 will go negative which will forward bias diode 1368 and thereby enable it to conduct and to modify the initial tension bias command signal output at line 258. This occurs because the cathode of diode 1368 which is connected to the output of amplifier 1342 becomes more negative than the anode which is connected to the negative input of summing amplifier 1230 through line 1374 which contains normally open contact K2A, line 1376 containing resistor R123 and line 1246. Consequently, the diode becomes forward biased and starts to conduct. This will modify the initial velocity command input from network 358 by reducing the plus 15 volts input to amlifier 1230 therefrom. The positive input signal Vi to pay out amplifier 1288 merely is added to the positive input from the transfer velocity command signal to make the output of amplifier 1288 more negative. This further reverse biases diode 1320 and prevent it from conducting.

If the inhaul velocity feedback signal Vi at line 208 is negative and the negative signal is applied through resistor R121 to the negative input of amplifier 1288, the output of amplifier 1288 at lines 1290 and 1322 will become positive after the negative input exceeds the positive input form the transfer velocity command. As a result, diode 1320 will be forward biased and the positive signal will be input to the summing amplifier 1230 through line 1376, line 1374 which contains normally open contact K2A, resistor R123 in line 1376 and line 1246. This will modify the initial velocity command signal input from network 258 by nullifying the minus 15 volt input through contact K1A. In other woods, it reduces the initial transfer bias command signal to thereby reduce the velocity of the inhaul winch cable. This prevents overspeed of the cable. Again, the negative value of the input of Vi to amplifier 1342 is added to the negative input signal from the transfer velocity command signal to make the output of amplifier 1342 more positive which will further reverse bias diode 1368 and thereby prevent it from conducting.

The cable velocity feedback signal Vo from the outhaul winch 46 at line 214 is connected to the negative input of operational amplifier 1302 which controls the payout velocity of the outhaul winch through line 1380 containing resistor R125, line 1316 and line 1308 and to the negative input of operational amplifier 1328 which controls the haul in cable velocity for the outhaul winch 46 through resistor R126 in line 1343 and line 1332. If the outhaul velocity feedback signal Vo is positive (winch hauling in) and the positive input signal is applied to the negative input of operational amplifier 1328, when the magnitude of the positive input signal exceeds the magnitude of the negative input signal from the transfer velocity haul in command, the output of amplifier 1328 at lines 1334 and 1362 will go negative which will cause diode 1364 to become forward biased. It should be noted that the outputs of the amplifiers 1328 and 1302 which control the inhaul and payout velocities of the outhaul winch 46 are connected to the negative input of the tension error amplifier 1230 in the same manner that the amplifiers 1342 and 1288 which control the haul in and pay out cable velocities for the inhaul winch are connected to that input. The output of amplifier 1328 at line 1334 is connected to the negative input of an inverting operational amplifier 1384 through line 1362, diode 1364, line 1386 containing resistor R127 and lines 1388 and 1390. Likewise, the output of amplifier 1302 at line 1310 is connected to the negative input of amplifier 1384 through lines 1326 and 1382, line 1386 containing resistor R127 and lines 1388 and 1390. Likewise, the output of amplifier 1302 at line 1310 is connected to the negative input of amplifier 1384 through lines 1326 and 1382, line 1386 containing resistor R127 and lines 1388 and 1390. Line 1391 containing resistor R208 references the positive input to ground. The output of amplifier 1384 at line 1392 is connected in feedback fashion to the negative input thereof through line 1394, line 1396 which contains resistor R128, and lines 1388 and 1390. Line 1398 containing filter capacitor C18 is connected between lines 1394 and 1390 is parallel with resistor R128. The output of amplifier 1384 at line 1392 is connected to the negative input of summing amplifier 1230 through line 1400 containing normally open contact K2B, line 1402 having resistor R129 and lines 1238, 1240, 1242, 1244 and 1246. Consequently, when diode 1364 is forward biased, it will act to modify the input to the tension error amplifier 1230 from the initial velocity control signal by reducing the magnitude of the minus 15 volts input to summing amplifier 1230. The positive input signal of Vo to the negative input of amplifier 1302 will be added to the positive input from the pay out transfer velocity command signal to make the output at line 1310 more negative and thereby further prevent diode 1324 from conducting.

If the outhaul velocity feedback signal Vo is negative (winch paying out) and the negative input is applied through resistor R125 to the negative input of amplifier 1302 when the magnitude of the negative signal input exceeds the magnitude of the positive signal input from the transfer payout velocity command signal, the output of amplifier 1302 will become positive. This positive signal will forward bias diode 1324 will be inverted by amplifier 1384 and will output a negative signal to the negative input of tension amplifier 1230 to modify the initial positive 15 volt velocity command bias signals. The same negative outhaul velocity feedback signal applied to amplifier 1328 will be summed with the negative haul in transfer velocity command signal and thereby cause a larger output signal at line 1334 which will further reverse bias diode 1364.

As seen above, the outputs for the amplifiers 1328 and 1302 which control the haul in and pay out cable velocities for the outhaul winch 46 are passed through an inverting amplifier 1384 before they are summed with the initial velocity command bias signal at the negative input of summing amplifier 1230, whereas the outputs of amplifiers 1342 and 1288 which set the haul in and pay out cable velocities for the inhaul winch 42 are summed directly with the initial tension command bias signal at the negative input of tension error amplifier 1230. This is necessary because the initial tension command bias input signal is polarity dependent, that is plus 15 volts is output to move the trolley towards the supply ship 12 and negative 15 volts is output to move the trolley towards the receiver ship 14. However, feedback signals Vi for the inhaul winch 42 and Vo for the outhaul winch 46 are positive for both winches when they are hauling in cable and are negative for both winches when they are paying out cable. In other words, the feedback signal polarity is not consistent with the initial tension command bias signal polarity. Therefore, inverter 1384 is necessary to make the feedback polarity for the outhaul winch consistent with the polarity of the tension command bias signals.

From the above, it may be seen that in the transfer mode if the haul in or pay out cable velocity of either winch exceeds the maximum transfer cable velocity commanded by the operator the initial velocity control signal input by the initial velocity control network at 258 will be modified to reduce the magnitude of the tension command output signal at line 256 to thereby reduce the speed of the inhaul and outhaul winches 42 and 46 respectively.

When the trolley 16 is within 8 meters of either ship 12 and 14 the automatic control system enters the landing mode. When this occurs, contact relay KR2 becomes de-energized, contacts K2A and K2B are opened and the haul in and pay out transfer mode velocity cable commands for the inhaul and outhaul winches 42 and 46 including those output from the initial velocity control signal network 258 are decoupled from the negative input of summing tension error amplifier 1230. The landing velocity command signal is set by the operator at the console by movement of rotary switch 126 which produces a landing velocity command signal input at lines 270 and 272 as illustrated in FIG. 5A and again in FIG. 12B. The landing velocity command input signal at one of lines 272 and 270 is directed to the negative input of the tension error amplifier 1230 through resistor R131 in line 1404, resistor R132 and normally close contact K2B both in line 1406, resistor R129 in line 1402, and lines 1238 through 1246. The negative landing velocity command signal at line 270 is input to amplifier 1230 if the selected transfer direction is towards the receiver ship, whereas the positive landing velocity command signal at 272 is input to the tension error amplifier 1230 if the selected transfer direction is towards the supply ship 12. The velocity feedback signal Vi from the inhaul winch 42 is summed with the commanded landing velocity signal at the negative input of tension error amplifier 1230 as follows. The inhaul velocity feedback signal Vi is applied to the negative input of inverting operational amplifier 1414 through line 1370, line 1410 containing resistor R133 and line 1412. Line 1413 containing resistor R209 ties the positive input to ground. The output of amplifier 1414 at line 1416 is fed back to the negative input thereof through line 1416, line 1418 having resistor R134, and lines 1420 and 1412. A filter capacitor C19 in line 1422 is connected between lines 1416 and 1420 in parallel with resistor R134. The output of amplifier 1414 at line 1416 is connected through line 1418 to line 1424 having normally closed contacts K3A. Line 1424 is connected to line 1426 containing normally closed contacts K2A, which line is connected through line 1376 containing resistor R123 and line 1246 to the negative input of summing amplifier 1230. Similarly, the velocity feedback signal (trolley velocity relative to receiver ship 14) represented by the quantity (Vo−Vi)/2 is input at line 218. This signal is directed to the negative input of tension error amplifier 1230 where it is summed with the commanded landing signal input thereat through line 218 containing normally open contact K3B, line 1426 containing normally closed contact K2A, line 1376 containing resistor R123 and line 1246. Thus, it may be seen that one of the feedback velocity signals Vi or (Vo−Vi)/2 will be applied to the summing input of tension error amplifier 1230 depending upon whether the trolley is moving towards the supply ship 12 or the receiver ship 14. Consequently, the feedback signal will be summed with the landing velocity command input signals to thereby modify the latter signals.

AUTOMATIC ACCELERATION/DECELERATION CONTROL NETWORK

The automatic acceleration and deceleration control network is represented at block 290 in FIG. 5A. This network operates in conjunction with the automatic transfer control network represented at block 210 and contains a transfer limiter circuit represented at 292 and a landing limiter circuit represented at 294. The transfer limiter circuit functions to cause the trolley 16 to decelerate from the set commanded transfer velocity to the set commanded landing velocity or to accelerate from the set commanded landing velocity to the set commanded transfer velocity. The landing limiter circuit functions to decelerate the trolley from the set commanded landing velocity to a terminal velocity and to accelerate the trolley from the terminal velocity to a set commanded landing velocity. Each of the velocity changes occurs at a constant rate with respect to distance. The outputs of the transfer limiter circuit modify the commanded maximum transfer velocity signals input at lines 264 and 266 and the outputs of the landing limiter circuit modify the set commanded landing velocity signals input at lines 274 and 276.

Figure 13:
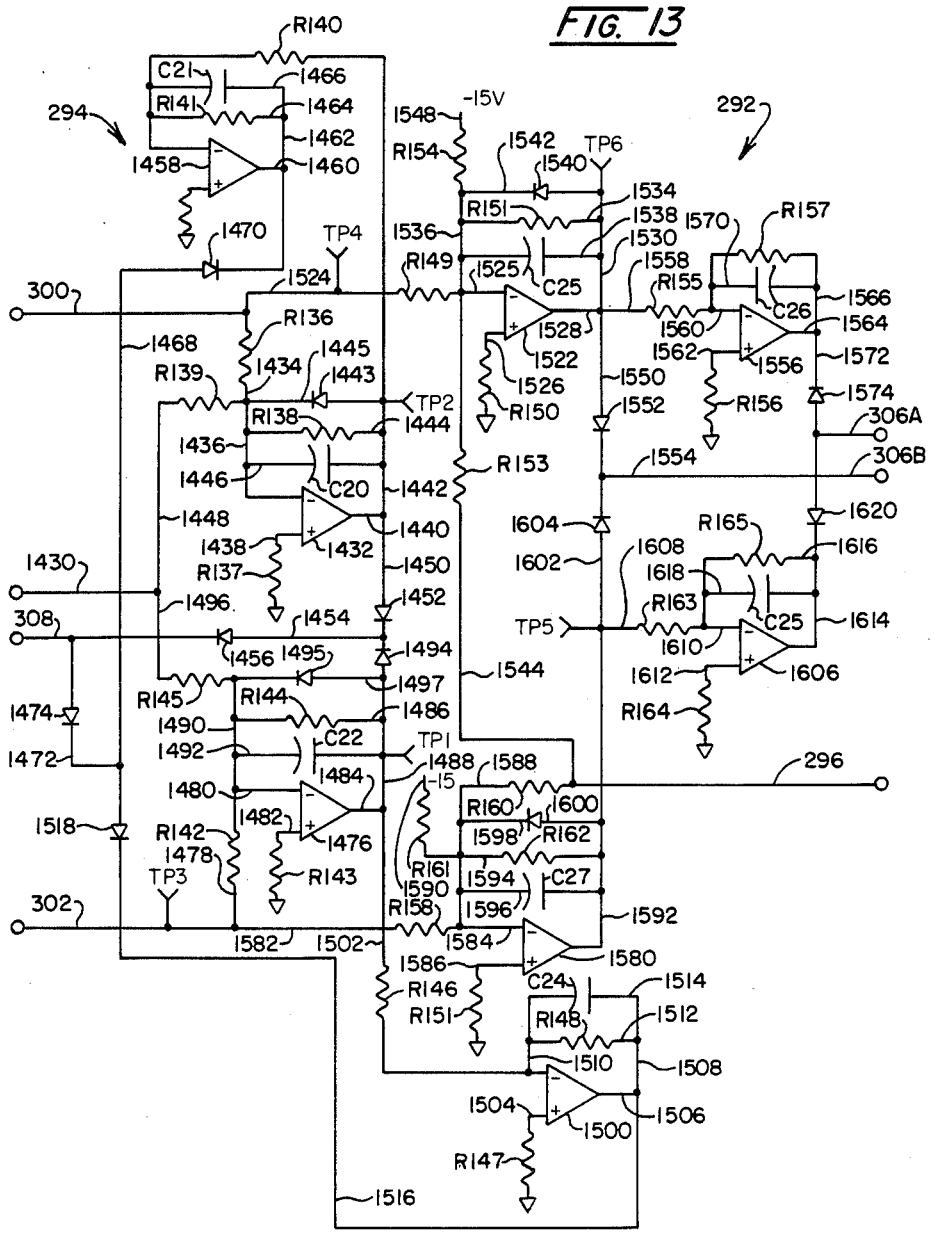
FIG. 13 is an electrical schematic diagram of the analog signal treatment for the portion of the automatic transfer system control which sets the rate of change of trolley velocity.

A schematic diagram of the landing limiter circuit network represented at block 294 and of the transfer limiter circuit network represented at block 292 may be seen by referring to FIG. 13 where the diagrams for those circuits are indicated generally by the same numbers as are used on the block diagrams. An analog signal representing the distance of the trolley 16 with respect to receiver ship 14 is input to landing limiter circuit network 294 at line 300 on a similar signal representing the distance of the trolley 16 with respect to the supply ship 12 is input at line 302 which lines carry the numbers utilized in FIG. 5A. It may be recalled that these signals are output at line 836 from the digital to analog converter 706 utilized in conjunction with the tandem bar meter 700 illustrated in FIG. 9.

The analog distance signals input at lines 300 and 302 are always positive and go from a maximum value to zero when the trolley 16 is zero distance from the ship. A signal having a magnitude of plus 15 volts also is input to landing limiter cirucit network 294 at line 1430. The positive voltage signal at line 300 which decreases as the trolley approaches the receiver ship 14 is applied to the negative input of a type CD747 operational amplifier 1432 through resistor R136 in line 1434 and line 1436. The positive input of inverter 1432 is tied to ground through line 1438 containing resistor R137. The output of amplifier 1432 at line 1440 is connected in feedback fashion to the negative input thereof through line 1442, line 1444 containing resistor R138 and line 1436. Line 1446 containing filter capacitor C20 is connected between lines 1442 and 1436 to put capacitor C20 in parallel with resistor R138. Line 1445 containing diode 1443 is connected in parallel with resistor R138. The plus 15 volt input at line 1430 also is connected to the negative input of amplifier 1432 where it is summed with the distance signal input at line 300 through line 1448 containing resistor R139 and line 1436. Resistor R139 has a large value and the 15 volt input at line 1430 is supplied to provide a minimum terminal velocity command signal input for trolley 16. As the trolley approaches the receiver ship, 14 the signal input to amplifier 1432 from line 300 will go to zero. Consequently, it is desireable to provide a terminal trolley velocity signal output from amplifier 1432 which will set the terminal speed of the trolley 16 as it strikes the ship 14 and which will maintain the trolley 16 in contact with the ship 14. This terminal speed also sets the initial velocity of the trolley as it leaves a ship.

The positive voltage signals applied to the negative input of amplifier 1432 will cause the output signal at line 1440 to have a negative value. The signal at line 1440 is connected through line 1450 containing diode 1452 and line 1454 containing diode 1456 to line 308 which is output from the landing limiter circuit network 294 and is shown as being summed with the landing velocity command signal at line 1404 in FIG. 12B. In other words, the signal at line 308 output from the landing limiter circuit network 294 modifies the landing velocity command signal input at lines 272 and 270. The negative signal output from amplifier 1440 reverse biases diodes 1452 and 1456. However, the landing velocity command signal at line 270 also is negative when the trolley is approaching the receiver ship 14. Consequently, when the signal output from amplifier 1432 becomes less negative than the commanded landing signal at lines 270 and 1404, diodes 1452 and 1456 will be forward biased and the landing velocity command signal will be clamped to the value of the signal output from amplifier 1432. It may be seen that as the trolley approaches the receiver ship 14, the magnitude of the signal input to amplifier 1432 diminishes, which causes the magnitude of the signal output at line 1440 to diminsh or become less negative than the commanded landing velocity signal to thereby cause the trolley to decelerate. Thus, the velocity of the trolley is dependent upon the distance of the trolley from the ship it is approaching.

Figure 6:
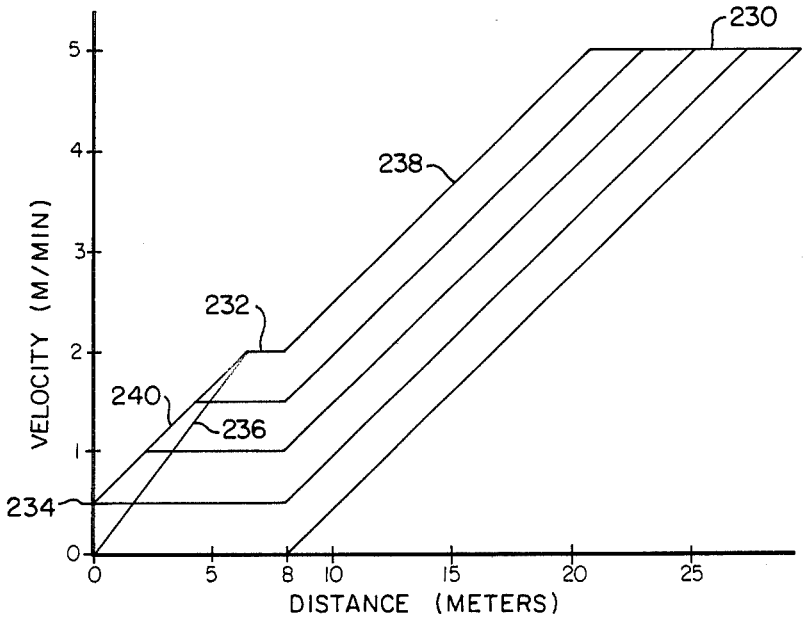
FIG. 6 is a diagram of trolley velocity versus distance from a ship.

The output of amplifier 1432 at line 1440 is connected to the negative input of operational amplifier 1458 which functions as an inverter through line 1442 containing resistor R140. The output of inverter 1458 at line 1460 is fed back to the negative input through line 1462 and line 1464 containing resistor R141. A filter capacitor C21 in line 1466 also is in the feedback network. The output of inverter 1458 at line 1460 is connected to output line 308 through line 1468 containing diode 1470 and line 1472 containing diode 1474. The negative input at amplifier 1458 is output as a positive signal at line 1460 which is applied to reverse bias diodes 1470 and 1474. This signal is equal magnitude but opposite in value to the signal output from amplifier 1432. The function of this signal is to provide a clamping signal which adjusts the velocity of the trolley 16 as it moves away from the receiver ship 14. Within 8 meters of the ship, the trolley will be in the landing mode and the positive trolley velocity command signal at line 272 will set the maximum speed of the trolley within the landing zone. The magnitude of the signal output from inverting amplifier 1458 will be less than that of the trolley velocity command signal as the trolley 16 begins to depart from the ship 14 because the signal representing trolley distance initially will have a value of zero. This value will increase as the trolley 16 moves away from the ship 14. Therefore, this signal will clamp or limit velocity of the trolley from the terminal landing speed to the commanded landing speed. This change in velocity occurs at a constant rate with respect to distance as illustrated in FIG. 6. Furthermore, the same rate is maintained regardless of the set landing velocity. Since this velocity is with respect to the ship the trolley 16 is departing from there is no danger the ship will strike the trolley during the departure. Of course, when the trolley is beyond a distance of 8 meters from the ship the landing limiter circuit network 294 has no effect on trolley velocity as the trolley is in the transfer mode.

Turning again to FIG. 13, a positive analog voltage signal is input at line 302 to network 294 as the trolley approaches the supply ship 12 and is connected to the inverting input of operational amplifier 1476 through line 1478 containing resistor R142 and line 1480. The positive input of inverter 1476 is referenced to ground through resistor R143 and line 1482. A feedback network including resistor R144 and line 1486 connects the output of amplifier 1476 at lines 1484 and 1488 with the input thereof through lines 1490 and 1480. The feedback network includes a filter capacitor C22 in line 1492. Line 1497 containing diode 1495 is connected in parallel with resistor R144. The plus 15 volt input at line 1430 also is connected to the negative input of amplifier 1476 through line 1496 containing resistor R145 and line 1490. Like resistor R139, resistor R145 has a large value such that the 15 volt signal at line 1430 functions to provide a terminal landing velocity signal at the input of inverter 1476 where it is summed with the trolley distance to supply ship signal input at line 302. The positive signals applied to the negative input of amplifier 1476 are output as negative signals at line 1484. These negative signals reverse bias diodes 1494 and 1456. Operational amplifier 1476 will not have a limiting function as the trolley approaches the supply ship 12 because the commanded landing velocity signal in this instance is positive. Instead, amplifier 1476 functions to adjust the velocity of the trolley as it moves away from the receiver ship 12 by limiting the negative landing velocity command signal input at line 270. Thus, amplifier 1476 duplicates the function of amplifier 1458 for movement of the trolley 16 from the supply ship 12 by adjusting the velocity of the trolley with respect to the supply ship 12. Again the rate of change of trolley velocity is made constant with respect to distance.

The output of amplifier 1476 is applied to the negative input of an operational amplifier 1500 which functions as an inverter through line 1502 containing resistor R146. The positive input of inverter 1500 is connected to ground through line 1504 containing resistor R147. The output of amplifier 1500 at line 1506 is connected in feedback fashion with the input through line 1508, line 1512 containing resistor R148 and line 110. A filter capacitor C24 in line 1514 is fed back in parallel with resistor R148. The output of amplifier 1500 at line 1506 iS connected to output line 308 through line 1516 containing diode 1518 and line 1472 containing diode 1474. The negative output of inverter 1476 applied to the negative input of inverter 1500 results in a positive output signal therefrom which reverse biases diodes 1518 and 1474. However, as the trolley approaches the supply ship 12, this positive signal diminishes in value until it falls below the level of the commanded landing velocity signal at line 272. Consequently, the landing velocity signal input at line 272 and line 1404 shown in FIG. 12B will be diminished or clamped to the value of the signal output from amplifier 1500. In other words, the signal at amplifier 500 will set the velocity of the trolley from the commanded landing speed to the terminal landing speed. Again, this change in velocity occurs at a constant rate with respect to distance.

From the above it may be seen that the landing limiter circuit network 294 functions to output a signal at line 308 which is summed with the landing velocity command signal at lines 270 and 272 and reduces the magnitude of these signals to adjust the velocity of the trolley 16 between the commanded landing speed and a terminal landing speed and to control the velocity of the trolley 16 away from a ship up to a set commanded landing velocity when the trolley is within 8 meters of the ship.

The transfer limiter circuit network represented at 292 provides a similar clamping function for controlling the velocity increase of the trolley between the set commanded landing velocity and the set commanded transfer velocity and for controlling the velocity decrease of the trolley from the commanded transfer velocity to the commanded landing velocity. These velocity changes are made to occur at a constant rate with respect to distance as illustrated in FIG. 6. This is accomplished by outputting a maximum payout velocity clamping signal at line 306A which is summed directly with the maximum transfer velocity command for payout set by the operator at line 264 through line 1304 as shown in FIGS. 12A and 12B. Similarly, the circuit outputs a maximum haul in velocity clamping signal 306B which is summed directly with the maximum set transfer velocity for inhaul at line 266 through line 1344. In other words, the transfer limiter circuit network 292 modifies the maximum transfer velocity command signals which are set by the operator to control the velocity of the trolley 16.

Turning to FIG. 13, three signals are input to the transfer limiter circuit network 292. The first signal is the analog signal representing the distance of the trolley 16 from the receiver ship 14 input at line 300, the second is the analog signal representing the distance of the trolley 16 from supply ship 12 input at line 302, and the third is an analog signal representing the commanded landing velocity that is input at line 296. The positive analog signal representing the position of the trolley 16 with respect to the receiver ship 14 is applied to the negative input of operational amplifier 1522 through line 1524 containing resistor R149 and line 1525. The positive input of amplifier 1522 is referenced to ground through line 1526 containing resistor R150. The output of amplifier 1522 at line 1528 is connected in feedback fashion to the negative input thereof through line 1530, line 1534 containing resistor R151 and line 1536. A filter capacitor C25 in line 1538 is connected across line 1530 and 1536. Similarly, diode 1540 in line 1542 is connected across lines 1530 and 1536. The landing velocity command input signal at line 296 is connected to the negative input of amplifier 1522 where it is summed with the trolley to receiver ship distance signal through line 1544 containing resistor R153 and line 1525. A negative 15 volt supply also is connected to the negative input of amplifier 1522 through line 1548 containing a large value resistor R154 and lines 1536 and 1525. The negative 15 volt signal provides a minimum landing velocity signal. The output of amplifier 1522 at line 1528 is connected to the line 306B through line 1550 containing diode 1552 and line 1554. The positive signals input at amplifier 1522 cause the output thereof to be negative which will reverse bias diode 1552. However, as the trolley approaches the receiver ship, the positive signal input to amplifier 1522 will diminish and the negative signal at the output thereof, likewise will diminsh. When the negative signal falls below the value of the negative signal which sets the maximum haul in velocity of the winches in the transfer mode, diode 1552 will become forward biased and the value of the maximum set haul in cable velocity signal for the winches will be reduced or clamped to the value of the signal output from amplifier 1522. The signal output from amplifier 1522 will be reduced until the haul in velocity for the winches reaches that set by the landing velocity command when the trolley 16 reaches distance of 8 meters from the ship 12.

The output of amplifier 1522 at line 1528 is connected to the negative input of an operational amplifier 1556 which functions as an inverter through line 1558 containing resistor R155 and line 1560. Line 1562 containing resistor R156 ties the positive input of amplifier 1556 to ground. The output of amplifier 1556 at line 1564 is tied to the negative input thereof through line 1566 containing feedback resistor R157 and through parallel connected filter capacitor C26 in line 1570. The output of amplifier 1556 is connected to the payout velocity output line 306A through line 1572 containing diode 1574. Consequently, the negative signal output from amplifier 1522 at line 1528 is inverted and seen as a positive output of inverter 1556. This positive output reverse biases diode 1574 and clamps the positive maximum transfer payout cable velocity signal at line 264 to that set by amplifiers 1522 and 1556. In this manner the velocity of the cable being paid out is matched to the velocity of the cable being hauled in.

The positive analog signal representing the position of the trolley 16 with respect to the supply ship 12 at line 302 is connected to the negative input of an operational amplifier 1580 through line 1582 containing resistor R158 and line 1584. Line 1586 containing resistor R159 references the positive input of amplifier 1580 to ground. The landing velocity command input signal at line 296 is connected to the negative input of amplifier 1580 where it is summed with the trolley supply ship distance signal through line 1588 containing resistor R160. Similarly, a negative 15 volt signal at line 1590 is applied to the negative input of amplifier 1580 through a large value resistor R161. Again, the negative 15 volt signal provides a minimum landing velocity command input to amplifier 1580. The output of amplifier 1580 at line 1592 is fed back to the negative input thereof through line 1594 containing resistor R162 and line 1588. A filter capacitor C27 in line 1596 is connected in parallel with resistor R162. Line 1598 containing diode 1600 also is connected across line 1592 and 1598. The output of amplifier 1580 at line 1592 is connected to line 306B through line 1602 which contains diode 1604 and line 1554. The positive inputs to amplifier 1580 causes the output signal at line 1592 to be negative. This negative signal reverse baises diode 1604 to thereby clamp the value of the negative maximum haul in cable velocity signal in the transfer mode to that set by amplifier 1580. In other words, the clamping signal will reduce the transfer mode haul in cable velocity signal from the maximum set by the operator to the set landing speed as the trolley 16 approaches the supply ship 12. The output of amplifier 1580 at line 1592 is connected to the negative input of operational amplifier 1606 which functions as an inverter through line 1608 containing resistor R163 and line 1610. Line 1612 containing resistor R164 ties the positive input of amplifier 1606 to ground. The output of amplifier 1606 at line 1614 is connected in feedbck fashion to the negative input thereof through line 1616 containing resistor R165 and line 1610. Filter capacitor C28 in line 1618 is connected in parallel with line 1616 containing resistor R165. The output of amplifier 1606 at line 1614 is connected to output line 306A through diode 1620. The signal output from amplifier 1606 at line 1614 has the same magnitude but opposite polarity as that output from amplifier 1580. Consequently, the positive signal output at line 1614 cooperates with diode 1620 to clamp the positive maximum payout velocity signal so that the velocity of the paid out cable matches that of the hauled in cable.

From the above, it may be seen that the transfer limiter circuit network 298 functions to limit or clamp the maximum commanded haul in an pay out cable velocity signal in the transfer mode to thereby reduce the velocity of the trolley 16 from the set maximum transfer velocity to the set or commanded landing velocity as the trolley approaches either ship 12 and 14 or to increase the velocity of the trolley 16 from the set landing velocity to the set transfer velocity as the trolley leaves either ship 12 and 14. Furthermore, it may be observed that these velocity changes occur at a constant rate with respect to distance and that the rate is the same regardless of the set transfer and landing velocities.

INITIAL TENSION CONTROL NETWORK

Turning momentarily to FIGS. 5A–5C, it may be seen that the automatic transfer control network represented at block 210 outputs an automatic tension command signal at line 256 to an initial tension control network represented at block 250. Network 250 provides tension command output signals at lines 252 and 254 to the inhaul and outhaul winch controls 102 and 104 respectively when the control is in the automatic mode. Initially, control network 250 outputs equal tension command signals to each of the winch controls 102 and 104 to cause the inhaul and outhaul winches 42 and 46 to exert a preset tension force on the inhaul cable 62 and the outhaul cable 64. This initial tension may be between 2000 and 3000 pounds. The automatic tension command signal at line 256 causes network 250 to output signals at line 252 and 254 which are equal in magnitude but opposite in polarity to the inhaul and outhaul winch controllers 102 and 104. As a result the controllers simultaneously increase the tension in one of the inhaul or outhaul cables 62 and 64 and decrease the tension in the other cable to cause the trolley 16 to move. The tension control network 250 also provides minimum and maximum value for the tension of the inhaul and outhaul winch cables 42 and 46.

Figure 14:
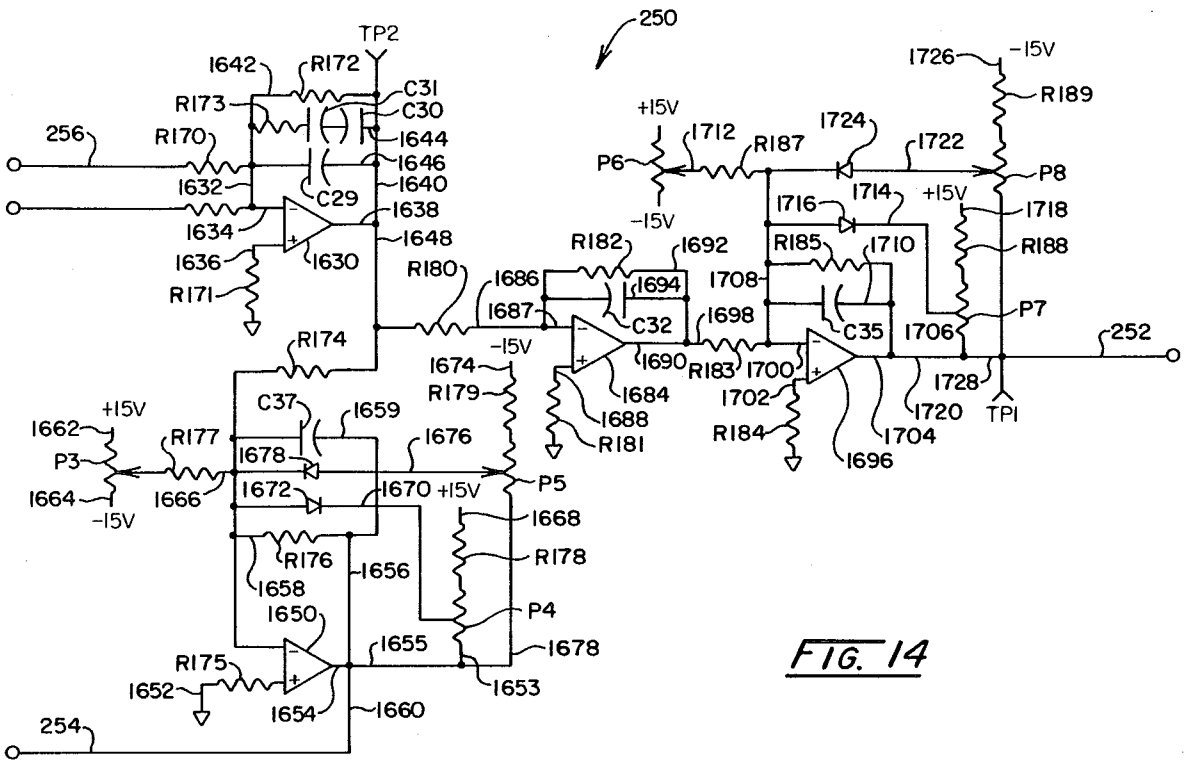
FIG. 14 is an electrical schematic transfer system control which outputs the tension bias signal to the controllers of the inhaul winch and the outhaul winch.

Turning to FIG. 14 a schematic diagram of the initial tension control network represented at block 250 in FIG. 5A is indicated by the same reference numeral. Additionally, the input to tension control network 250 represented in FIG. 5B as line 256 and the outputs thereof represented as lines 25 and 254 are illustrated by the same numerals in FIG. 14.

The tension command input signal from automatic transfer control network 210 at line 256 is connected to the negative input of an operational amplifier 1630 through resistor R170 and lines 1632 and 1634. The positive input of amplifier 1630 is tied to the ground through line 1636 containing resistor R171. The output of amplifier 1638 is connected in feedback fashion with the input thereof through line 1640, line 1642 containing feedback resistor R172 and lines 1632 and 1634. Line 1646 containing filter capacitor C29 is connected in parallel with resistor R172 between line 1640 and 1632. Line 1644 containing capacitors C30 and C31 and resistor R173 also is connected in parallel with resistor R172 by connection with lines 1640 and 1642. Capacitors C30 and C31 and resistor R173 provide gain compensation based on frequency to provide increased system stability. The output of amplifier 1630 is connected to the negative input of an operational amplifier 1650 which functions as an inverter through line 1648 containing resistor R174. Line 1652 containing resistor R175 references the positive input of inverter 1650 to ground. The output of inverter 1650 at line 1654 is connected to the negative input thereof in feedback fashion through line 1656, line 1658 containing resistor R176 and line 1648. Line 1659 containing a filter capacitor C37 is connected in parallel with resistor R176.

The output of amplifier 1650 at 1654 is connected through line 1660 to line 254 which is input to outhaul winch controller 140. A positive signal is output from inverter 1650 if the outhaul winch cable tension is to increase and a negative signal is output if the outhaul winch cable tension is to decrease. Three adjustments signals are applied to amplifier 1650. The first is the initial tension adjustment signal which includes a potentiometer P3 having a wiper connected to line 1666 which is connected to the negative input of amplifier 1650 through resistor R177 and line 1648. A plus 15 volts at line 1662 is applied to the winding of potentiometer P3 and a negative 15 volts at line 1664 also is applied to the winding of potentiometer P3. The setting of potentiometer P3 determines the magnitude of the initial tension command signal output to the outhaul winch control 104. The second adjustment signal is a minimum tension command signal. The circuit of this signal forms a feedback circuit with amplifier 650. The circuit includes a potentiometer P4 having a wiper which is attached to the negative input of amplifier 1650 through line 1670 containing feedback doide 1672 and line 1648. The winding of potentiometer P4 is connected to the output of amplifier 1650 at line 1654 through lines 1653 and 1655. The third adjustment signal is the maximum tension command signal. The circuit for this signal also forms a feedback network with amplifier 1650. The circuit includes a potentiometer P5 having a wiper which is connected to the negative input of amplifier 1650 through line 1676 containing feedback diode 1678. A negative 15 volt signal at line 1674 carrying resistor R179 is connected to the winding of potentiometer P5 which also is connected to the output of amplifier 1650 through lines 1678 and 1655. The combination of the voltage divider networks of resistor R178 and potentiometer P4 and feedback diode 1672 are such that when the output of amplifier 1650 becomes sufficiently negative, diode 1672 will conduct. As a result, the gain of amplifier 1650 will be significantly reduced and the maximum negative signal will be limited or clamped to provide a minimum tension command output at line 254. Similarly, the combination of the voltage divider network of resistor R179 and potentiometer P5 and the feedback diode 1678 are such that when the output of amplifier 1650 becomes sufficiently positive, diode 1678 will condut. This will cause the gain of amplifier 1650 to be significantly reduce and the maximum tension signal output at line 254 will be set.

The tension command input signal at line 265 also is applied to a circuit which sets the tension of the inhaul winch 42. The output of amplifier 1630 at line 1638 is connected to the negative input of amplifier 1684 through line 1648, line 1686 containing resistor R180 and line 1687. The positive input of amplifier 1684 is connected to ground through line 1688 containing resistor R181. The output of amplifier 1684 at line 1690 is connected in feedback fashion to the negative input thereof through line 1692 containing resistor R182 and line 1687. A filter capacitor C32 in line 1694 is connected across line 1692 in parallel with resistor R182. The output of amplifier 1684 at 1690 is connected to the negative input of an operational amplifier 1696 which functions as an inverter through line 1698 containingn resistor R183 and line 1700. The positive input of amplifier 1696 is tied to ground through line 1702 containing resistor R184. Amplifier 1696 functions to provide a tension signal to the inhaul winch control 102 through line 252 which is equal in magnitude but opposite in polarity to the signal output at line 254 to the outhaul winch control 104.

The output of amplifier 1696 at line 1704 is connected in feedback fashion to the negative input thereof through line 1706 containing resistor R185, line 1708 and line 1700. Line 1710 containing filter capacitor C35 is connected between line 1706 and 1708 in parallel with resistor R185. Again, three adjustment signals are applied to the negative input of amplifier 1696 in the same manner as they are applied to amplifier 1650 which outputs the tension signal for the outhaul winch. The initial tension bias circuit includes a potentiometer P6 having a wiper attached to the negative input of amplifier 1696 through line 1712 containing resistor R187 and lines 1708 and 1700. A plus 15 volts and a negative 15 volts are applied to the winding of potentiometer P6. The setting of potentiometer P6 determines the initial tension bias command signal for inhaul winch 42. The second adjustment signal for amplifier 1696 is minimum tension adjustment. The circuit for this adjustment is connected in feedback fashion between the output of amplifier 1696 at line 1704 and the negative input at line 1700. The circuit for this adjustment includes a potentiometer P7 having a wiper attached to the negative input of amplifier 1696 through feedback diode 1716 in line 1714 and lines 1708 and 1700. A plus 15 volt supply at line 1718 containing resistor R188 is connected to one end of the winding of potentiometer P7. The opposite end of the winding is connected to the output of amplifier 1696 at line 1704 through line 1720. The third adjustment signal for amplifier 1696 is a maximum tension adjustment, the circuit of which is connected in feedback fashion between the output and the negative input of amplifier 1696. The circuit for the maximum tension adjustment signal includes a potentiometer P8 having a wiper connected to the negative input of amplifier 1696 through line 1722, containing feedback diode 1724 and lines 1708 and 1700. A negative 15 volts is applied to the line 1726 carrying resistor R189 and to one end of the winding of potentiometer P8. The winding also is connected to the output of amplifier 1696 at line 1728. It may be appreciated that the resistor networks and feedback diodes for the minimum and maximum inhaul winch cable tension signals are set in the same manner as those for the outhaul winch cable signals described above.

From the above, it may be seen that the initial tension control network 250 functions to output initial tension command signals which are equal in magnitude but opposite in polarity to the inhaul and outhaul winch controls 102 and 104. Additionally, the network 250 sets minimum and maximum tension command signals for the inhaul and outhaul winch controls 102 and 104. Lastly, the initial tension control network 250 receives tension command signals from the automatic transfer control network 210 and outputs tension command signal at lines 252 and 254 to the winch controllers 102 and 104 to thereby cause the trolley 16 to move.

Since certain changes may be made to the above-described control system, apparatus, and method without departing from the scope of the invention herein, it is intended that all matter contained in the description thereof or shown in the accompanying drawings shall be interpreted as illustrative and not in a limiting sense.

We claim:

1. An automatic control system for operating inhaul and outhaul winches which are responsive to an automatic transfer control output and which serve as drives for hauling in and paying out inhaul and outhaul winch transfer cables employed in ship to ship transfer of a load wherein sensors are utilized for deriving inhaul and outhaul winch cable position signal inputs and inhaul and outhaul winch cable velocity signal inputs and wherein said automatic control system operates in a landing mode to drive said load at a select landing velocity when said load is within a set distance from a ship and operates in a transfer mode to drive said load at a select transfer velocity when said load is beyond said set distance comprising:

first adjustment means for deriving select haulin and payout transfer velocity signal inputs;

second adjustment means for deriving a select landing velocity signal input;

transfer velocity control means responsive to said cable position signal inputs and said landing velocity signal input for deriving a distance responsive transfer velocity signal input; and transfer control means responsive to said cable velocity signal inputs, said select haulin and payout transfer velocity signal inputs, and said distance responsive transfer velocity signal inputs to derive a variable automatic transfer control output which causes said inhaul and outhaul winches to adjust the velocity of said inhaul and said outhaul winch transfer cables such that the velocity of said load between said select transfer velocity and said select landing velocity changes at a constant rate with respect to distance.

2. The automatic control system of claim 1 which includes:

mode control means responsive to said cable position signal inputs for deriving a distance responsive mode signal which sets said automatic control system in said landing mode when said load is within said set distance and in said transfer mode when said load is beyond said set distance;

minimum landing velocity signal input means for setting a minimum landing velocity for said load when said automatic control system is operating in said landing mode;

landing velocity control means responsive to, said cable position signal inputs, said cable velocity signal inputs said minimum landing velocity signal input and said select landing velocity signal input to derive a distance responsive landing velocity signal input when said automatic control means is in said landing mode;

means for interrupting said select haulin and payout transfer velocity signal inputs when said automatic control means is in said landing mode; and transfer control means being responsive to said distance responsive landing velocity signal input to derive a variable automatic transfer control output which causes said inhaul and outhaul winches to adjust the velocity of said inhaul and outhaul transfer cables such that the velocity of said load between said select landing velocity and said minimum landing velocity changes at a constant rate with respect to distance.

3. The automatic control system of claim 1 in which:

the velocity of said load between said select transfer velocity and said select landing velocity changes at a controlled non-uniform rate with respect to distance.

4. The automatic control system of claim 2 in which:

the velocity of said load between said select landing velocity and said minimum landing velocity changes at a controlled non-uniform rate with respect to distance.

5. The automatic control system of claim 1 in which:

said transfer control means is operative to derive said variable auto transfer control output to cause said inhaul and said outhaul winches to adjust the velocity of said inhaul and said outhaul winch transfer cables when said load is moving from said select landing velocity to said select transfer velocity such that the velocity of said load between said select landing velocity and said select transfer velocity changes at a constant rate with respect to distance as the load moves away from said ship.

6. The automatic control system of claim 5 in which:

the velocity of said load between said select transfer velocity and said select landing velocity changes at a controlled non-uniform rate with respect to distance.

7. The automatic control system of claim 2 in which:

said transfer control means is operative to derive said variable auto transfer control output to cause said inhaul and said outhaul winches to adjust the velocity of said inhaul and said outhaul winch transfer cables when said load is moving from rest to said select landing velocity such that the velocity of the load between rest and said select landing velocity changes at a constant rate with respect to distance as the load moves away from said ship.

8. The automatic control system of claim 7 in which:

the velocity of said load between said select landing velocity and said minimum landing velocity velocity changes at a controlled non-uniform rate with respect to distance.

9. In a control system for operating inhaul and outhaul winches which serve as drives for inhaul and outhaul winch transfer cables employed in ship to ship transfer of a load between a supply ship and a receiver ship and in which one cable is connected between the load and the inhaul winch and the other cable is connected between the load and the outhaul winch, a monitoring circuit which provides a digital display of one of the distance between the load and a landing position on a ship or the distance the load travels from the landing position towards the deck of the ship comprising:

a winch cable signal processor for deriving first cable position up count and down count signal ouputs;

steering circuit means having first up count and down count signal inputs operatively connected to said first up count and down count signal outputs for selectively outputting second up count and downcount signal outputs;

counter means having second up count and down count signal inputs operatively connected to said second up count and down count signal outputs of said steering circuit and responsive thereto to output a count signal representing the distance between the load and a ship and a counter direction signal which indicates a positive direction when the load is away from the ship and a negative direction when the load is moving from said landing position towards the deck of the ship;

driver means responsive to said count signal for deriving a driver signal;

digital display means responsive to said driver signal for providing said digital display of distance; and toggle means operatively connected to said steering circuit means and to said counter means and responsive to said counter direction signal for reversing said second up count and down count signal outputs of said steering circuit means when said count direction signal indicates a negative direction wherein said second up count signal is applied to said second down count input of said counter means and said second down count signal is applied to said second up count input of said counter means to cause said counter means to count up from zero.

10. The control circuit of claim 9 further comprising:

load position signal means responsive to said cable position input signal for derivng a distance-responsive load position signal; and interrupt means responsive to said load position signal for interrupting said drive signal intermittently when said load is within a specified distance of ship.

11. The control circuit of claim 9 in which:

said digital display means includes a negative direction indicator means; and said negative direction indicator means being operative in response to said toggle means reversing said second up count and down count signal output of said steering circuit.

12. The control circuit of claim 9 further comprising:

second counter means responsive to the first said counter signal for outputting a digital distance signal;

digital to analog converter means responsive to said digital distance signal for deriving an analog distance signal;

driver means repsonsive to said analog distance signal for deriving a driver signal output; and visual dislay means responsive to said driver signal ouput for providing a graphic display of the distance between the load and a ship.

13. The control circuit of claim 12 further comprising:

load signal means responsive to said cable position input signal for deriving a distance responsive load position signal;

interrupt means responsive to said load position signal for interrupting said driver means intermittently when said load is within a specified distance of a ship.

14. The control circuit of claim 13 in which:

said interrupt means includes clock means for providing an oscillating signal output to said driver means.

15. The control circuit of claim 12 in which:

said circuit includes dimmer control means for deriving a pulse width modulated timing signal; and said driver means responsive to said pulse width modulated timing signal to set the intensity of said graphic display.

16. In a control circuit for controlling the tension and the velocity of cable which transfer a load between a supply ship and a receiver ship and which has one end attached to an inhaul winch and its other end attached to an outhaul winch, a monitoring circuit which provides a graphic display of the velocity of the load with respect to one of the supply ship or the receiver ship comprising:

an inhaul winch cable velocity pickup having a haulin output signal and a payout output signal;

an outhaul winch cable velocity pickup having a haulin ouput signal and a payout output signal;

first signal conditioning means receiving said inhaul winch haulin and payout output signal for deriving a first analog velocity signal which represents the velocity of said inhaul winch cable and said load with respect to said supply ship;

second signal conditioning means receiving said outhaul winch haulin and payout output signals for deriving a second analog velocity signal which represents the velocity of said outhaul winch cable;

third signal conditioning means receiving said first and said second analog velocity signal for deriving a third analog velocity signal which represents the velocity of said load with respect to said receiver ship;

driver means which alternatively receives said first analog velocity signal for deriving a first driver signal which represents the velocity of said load relative to said supply ship or receives said third analog velocity signal for deriving a second driver signal which represents the velocity of said load relative to said receiver ship;

visual display means resposive to one of said first or said second driver signal for providing a graphic light display representing the velocity of said load and in which the percentage of lights which are illumniated is directly proportional to the velocity of said load; and scale adjust means responsive to one of said first or said second driver signals for setting the percentage of the graphic light display which is illuminated for an incremental change in the magnitude of the driver signal; and wherein said scale adjustments cause a greater percentage of said graphic light display to be illuminated for an incremental change in magnitude of the driver signal when said load is traveling below a set speed than when said load is traveling above said set speed.

17. The control circuit of claim 16 in which:

said circuit includes sensors for deriving inhaul and outhaul cable position signal inputs;

load position signal means responsive to said cable position inputs for deriving a distance resposive load position signal; and interrupt means responsive to said load position signal for interrupting said driver means intermittently when said load is within a specified distance of a ship.

18. The control circuit of claim 17 in which:

said circuit includes dimmer control means for deriving a timing signal; and said driver means being responsive to said timing signal to set the intensity of said graphic light display.

19. The control circuit of claim 17 in which:

said interrupt means includes clock means for providing an oscillating signal output to said driver means.

20. An automatic control system for operating inhaul and outhaul winches which are responsive to an automatic transfer control output and which serve as drives for hauling in and paying out inhaul and outhaul winch transfer cables employed in ship to ship transfer of a load wherein sensors are utilized for deriving inhaul and outhaul winch cable position signal inputs and inhaul and outhaul winch cable velocity signal inputs and wherein said automatic control system operates in a landing mode to drive said load at a select landing velocity when said load is within a set distance from a ship and operates in a transfer mode to drive said load at a select transfer velocity when said load is beyond said set distance comprising:

first adjustment means for deriving select hauling and payout transfer velocity signal inputs;

second adjustent means for deriving a select landing velocity signal input;

transfer velocity control means responsive to said cable position signal inputs and said landing velocity signal input for deriving a distance responsive transfer velocity signal input;

transfer control means responsive to said cable velocity signal inputs, said select haulin and payout transfer velocity signal inputs, and said distance responsive transfer velocity signal inputs to derive a variable automatic transfer control output which causes said inhaul and outhaul winches to adjust the velocity of said inhaul and said outhaul winch transfer cables such that the velocity of said load between said select transfer velocity and said select landing velocity changes at a constant rate with respect to distance;

automatic tension command means for simultaneously deriving inhaul and outhaul winch tension command signals;

said inhaul and outhaul winches include inhaul and outhaul winch controllers being responsive simultaneously to said inhaul and outhaul winch tension command signals to adjust the tension of their respective transfer cables wherein said tension command signals are equal in magnitude when the load is stationary and unequal in magnitude when the load is moving;

said automatic tension command means includes an initial tension command signal input means for providing equal initial winch tension command signals to said inhaul and outhaul winch controllers whereby said inhaul and outhaul winch transfer cables have the same initial tension; and said automatic tension command means being responsive to said initial winch tension command signals and said automatic transfer control output for deriving said inhaul and outhaul winch tension command signals.

21. The automatic control system of claim 20 in which:

said automatic tension command means includes a minimum tension command signal input means for setting a minimum level of said inhaul and outhaul winch tension command signals to ensure that the tension in said inhaul and outhaul winch transfer cables does not go below a set minimum.

22. The automatic control system of claim 20 in which:

said automatic tension command means includes maximum tension command signal input mean for setting a maximum level of said inhaul and outhaul winch tension command signals to ensure that the tension of said inhaul and outhaul winch transfer cables does not go above a set maximum.

23. An automatic control for system operating inhaul and outhaul winches which are responsive to an automatic transfer control output and which serves as drives for hauling in and paying out inhaul and outhaul winch transfer cables employed in ship to ship transfer of a load wherein sensors are utilized for driving inhaul and outhaul winch cable position signal inputs and inhaul and outhaul winch cable velocity signal inputs and wherein said automatic control system operates in a landing mode to drive said load at a select landing velocity when said load is within a set distance from a ship and operates in a transfer mode to drive said load at a select transfer velocity when said load is beyond said set distance comprising:

first adjustment means for deriving a select landing velocity signal input; second adjustment means for deriving select hauling and payout transfer velocity signal inputs;

mode control means responsive to said cable position signal inputs for driving a distance responsive mode signal which sets said automatic control system in said landing mode when said load is within said set distance and in said transfer mode when said load is beyond said set distance;

minimum landing velocity signal input means for setting a minimum landing velocity for said load when said automatic control system is operating in said landing mode;

landing velocity control means responsive to said cable position signal inputs; said cable velocity signal inputs, said minimum landing velocity signal input and said select landing velocity signal input to derive a distance responsive landing velocity signal input when said automatic control means is in said landing mode; and transfer control means responsive to said distance responsive landing velocity signal input to derive a variable automatic transfer control output which causes said inhaul and said outhaul winches to adjust the velocity of said inhaul and outhaul transfer cables such that the velocity of said load between said select landing velocity and said minimum landing velocity changes at a constant rate with respect to distance.

* * * * *